US011372348B2

(12) United States Patent
Maeda et al.

(10) Patent No.: US 11,372,348 B2
(45) Date of Patent: Jun. 28, 2022

(54) DEVELOPING DEVICE, CARTRIDGE, IMAGE FORMING APPARATUS

(71) Applicant: CANON KABUSHIKI KAISHA, Tokyo (JP)

(72) Inventors: Harunobu Maeda, Tokyo (JP); Masahito Kato, Suntou-gun (JP); Kodai Hayashi, Suntou-gun (JP); Takuya Oka, Yokohama (JP); Yu Akiba, Susono (JP); Masato Tanabe, Susono (JP); Koichi Ooishi, Mishima (JP); Takatoshi Hamada, Mishima (JP); Yuichiro Hirata, Susono (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 17/016,468

(22) Filed: Sep. 10, 2020

(65) Prior Publication Data

US 2021/0080870 A1 Mar. 18, 2021

(30) Foreign Application Priority Data

Sep. 17, 2019 (JP) ..... JP2019-168211
Sep. 17, 2019 (JP) ..... JP2019-168212
Sep. 17, 2019 (JP) ..... JP2019-168871

(51) Int. Cl.
*G03G 15/08* (2006.01)

(52) U.S. Cl.
CPC ..... *G03G 15/0894* (2013.01); *G03G 15/0889* (2013.01)

(58) Field of Classification Search
CPC ..... G03G 15/0894; G03G 15/0889; G03G 15/0865; G03G 15/0887; G03G 21/1676
See application file for complete search history.

(56) References Cited

U.S. PATENT DOCUMENTS 7,860,437 B2 12/2010 Kakuta et al.
8,185,023 B2 5/2012 Kakuta et al.
8,532,544 B2 9/2013 Kakuta et al.
(Continued)

FOREIGN PATENT DOCUMENTS

JP 2008-129242 A 6/2008
JP 2009-222945 A 10/2009
(Continued)

*Primary Examiner* — Sandra Brase
(74) *Attorney, Agent, or Firm* — Venable LLP

(57) ABSTRACT

A developing device includes a frame having an accommodation chamber where a developer is accommodated, and a replenishing port replenishing a developer to the accommodation chamber from outside, and a stirring member stirring the developer in the accommodation chamber. The stirring member includes a rotating shaft portion rotatably supported by the frame and a sheet member having one end fixed to the rotating shaft portion and another end as a free end and being rotatable with the rotating shaft portion. When the stirring member is rotated, the free end of the sheet member is capable of contacting an inner wall surface of the accommodation chamber in which the replenishing port is formed, and a through hole penetrating in a thickness direction of the sheet member is provided in a region of the sheet member that comes into contact with the inner wall surface of the accommodation chamber.

40 Claims, 34 Drawing Sheets

(56) References Cited

U.S. PATENT DOCUMENTS

| | | | | |
|---|---|---|---|---|
| 9,904,208 | B2 | 2/2018 | Maeda et al. | |
| 10,496,013 | B2 | 12/2019 | Kubota et al. | |
| 10,564,570 | B2 | 2/2020 | Kanno | |
| 2009/0087229 | A1* | 4/2009 | Shiraki | G03G 15/0896 399/263 |
| 2012/0170955 | A1 | 7/2012 | Kakuta et al. | |
| 2012/0243886 | A1* | 9/2012 | Sunayama | G03G 15/0865 399/27 |
| 2015/0063878 | A1* | 3/2015 | Torimoto | G03G 15/0865 399/263 |
| 2018/0120731 | A1* | 5/2018 | Nakamura | G03G 15/0889 |
| 2018/0120738 | A1* | 5/2018 | Fujiwara | G03G 15/0889 |
| 2018/0364620 | A1 | 12/2018 | Kubota et al. | |
| 2019/0235413 | A1 | 8/2019 | Kanno | |
| 2020/0370942 | A9 | 11/2020 | Kawasaki et al. | |

FOREIGN PATENT DOCUMENTS

| | | | |
|---|---|---|---|
| JP | 2011-253203 | A | 12/2011 |
| JP | 2016-053710 | A | 4/2016 |
| JP | 2016-206215 | A | 12/2016 |
| JP | 2018-072601 | A | 5/2018 |
| JP | 2019-003033 | A | 1/2019 |
| JP | 2019-109341 | A | 7/2019 |
| JP | 2019-132991 | A | 8/2019 |

* cited by examiner

DEVELOPING DEVICE, CARTRIDGE, IMAGE FORMING APPARATUS

BACKGROUND OF THE INVENTION

Field of the Invention

The present invention relates to a developing device and a process cartridge for use in a copying machine, a printer, and the like using an electrophotographic system.

Description of the Related Art

In an image forming apparatus using an electrophotographic system, an image is formed through a process of supplying a developer to an electrostatic latent image formed by performing scanning and exposure on a photosensitive drum, which is an image bearing member, to form a developer image, then transferring and fixing the developer image to a recording material such as a sheet material or the like, and outputting the same.

In recent years, in the image forming apparatus using an electrophotographic image forming process, the life of a process cartridge has been extended, and one of the methods used for this purpose involves providing a process cartridge and a developer accommodation container for replenishing the developer, and replenishing the developer into the process cartridge. The method of replenishing the developer into the process cartridge has a problem called scumming which occurs when the supplied new developer and the old developer in the process cartridge are not sufficiently mixed. In order to suppress the scumming, a technology has been developed, in which a plurality of stirring screws is installed in a developer accommodation chamber where the developer of the process cartridge is accommodated, and the supplied developer and the developer already present in the process cartridge are sufficiently mixed (Japanese Patent Application Publication No. 2019-003033).

SUMMARY OF THE INVENTION

However, with such a configuration, there is a problem that the device becomes large and costly. Therefore, there has been a demand for a developing device capable of suppressing the scumming caused by insufficient mixing of developers without using a plurality of screws for mixing the developers.

An object of the present invention is to provide a developing device making it possible to realize a configuration in which a developer accommodation chamber is provided with a replenishing port through which the developer can be replenished thereto, improve a mixing property of developers in an accommodation chamber, and suppress scumming therein.

In order to achieve the above object, the developing device of the present invention comprises:

a frame having an accommodation chamber in which a developer is accommodated, and a replenishing port for replenishing a developer to the accommodation chamber from outside; and a stirring member stirring the developer in the accommodation chamber, the stirring member including a rotating shaft portion rotatably supported by the frame and a sheet member having one end fixed to the rotating shaft portion and another end as a free end, and the stirring member being rotatable according to a rotating operation of the rotating shaft portion, wherein, when the stirring member is rotated, the free end of the sheet member is capable of contacting an inner wall surface of the accommodation chamber in which the replenishing port is formed, and wherein, a through hole penetrating in a thickness direction of the sheet member is provided in a region of the sheet member that comes into contact with the inner wall surface of the accommodation chamber.

In order to achieve the above object, the developing device of the present invention comprises:

a developing frame including a developing chamber in which a developer bearing member for bearing a developer is accommodated, a developer accommodation chamber which is located below the developing chamber in a posture at a time of use and in which the developer is accommodated, and a communication port through which the developing chamber and the developer accommodation chamber are communicated with each other;

a conveying member provided in the developer accommodation chamber for conveying the developer from the developer accommodation chamber to the developing chamber, the conveying member including a rotatable rotating shaft portion, and an elastically deformable sheet portion which has one end fixed to the rotating shaft portion and another end as a free end;

a deforming portion provided in the developer accommodation chamber, for bending and elastically deforming the sheet portion by coming into contact with the free end of the sheet portion when the sheet portion is rotated according to a rotation operation of the rotating shaft portion; and a restoring portion, provided in the developer accommodation chamber at a position upstream of the communication port and downstream of the deforming portion in a rotation direction of the rotating shaft portion, for restoring the sheet portion by releasing the deformation caused by the deforming portion, so as to convey the developer borne on the sheet portion toward the communication port, wherein, the developer accommodation chamber is provided with a replenishing port for replenishing a developer to the developer accommodation chamber from outside, and, wherein, when viewed along a rotation axis direction of the rotating shaft portion in a posture at a time of use, and a rotation center of the rotating shaft portion and a downstream end of the communication port in the rotation axis direction of the rotating shaft portion being connected by a straight line, regarding said straight line, the communication port is located on one side and the replenishing port is located on the other side, and the restoring portion is not provided on the other side where the replenishing port is located, but is provided on the one side where the communication port is located.

In order to achieve the above object, the developing device of the present invention comprises:

a developing frame including a developing chamber in which a developer bearing member for bearing a developer is accommodated, a developer accommodation chamber which is located below the developing chamber in a posture at a time of use and in which the developer is accommodated, and a communication port through which the developing chamber and the developer accommodation chamber are communicated with each other;

a conveying member provided in the developer accommodation chamber for conveying the developer from the developer accommodation chamber to the developing chamber, the conveying member including a rotatable rotating shaft portion, and an elastically deformable sheet portion which has one end fixed to the rotating shaft portion and another end as a free end;

a deforming portion, provided in the developer accommodation chamber, for bending and elastically deforming the sheet portion by coming into contact with the free end of the sheet portion when the sheet portion is rotated according to a rotation operation of the rotating shaft portion; and a restoring portion, provided in the developer accommodation chamber at a position upstream of the communication port and downstream of the deforming portion in a rotation direction of the rotating shaft portion, for restoring the sheet portion by releasing the deformation caused by the deforming portion, so as to convey the developer borne on the sheet portion toward the communication port, wherein, the developer accommodation chamber is provided with a replenishing port for replenishing a developer to the developer accommodation chamber from outside, and, where a vertical line passing through wherein, when viewed along a rotation axis direction of the rotating shaft portion in a posture at a time of use, and a vertical line that passes through a rotation center of the rotating shaft portion being as a reference, at least a part of the communication port and at least a part of the replenishing port are both located on one side of the vertical line, and the restoring portion is located on the other side of the vertical line.

Further, in order to achieve the above object, the cartridge of the present invention comprises:

the above mentioned developing device; and an image bearing member bearing a developer image, wherein the cartridge is detachably attachable to an apparatus main body of an image forming apparatus.

Further, in order to achieve the above object, the image forming apparatus of the present invention comprises:

the above mentioned developing device; and a transfer member.

In order to achieve the above object, the image forming apparatus of the present invention comprises:

the above mentioned cartridge; and a transfer member.

According to the present invention, it is possible to suppress the scumming, which is caused by the developer replenishment, without using a stirring screw or the like which requires an increase in the size of the apparatus.

Further features of the present invention will become apparent from the following description of exemplary embodiments with reference to the attached drawings.

DESCRIPTION OF THE EMBODIMENTS

Hereinafter, a description will be given, with reference to the drawings, of embodiments (examples) of the present invention. However, the sizes, materials, shapes, their relative arrangements, or the like of constituents described in the embodiments may be appropriately changed according to the configurations, various conditions, or the like of apparatuses to which the invention is applied. Therefore, the sizes, materials, shapes, their relative arrangements, or the like of the constituents described in the embodiments do not intend to limit the scope of the invention to the following embodiments.

Embodiment 1

Overall Configuration of Image Forming Apparatus

Figure 1:
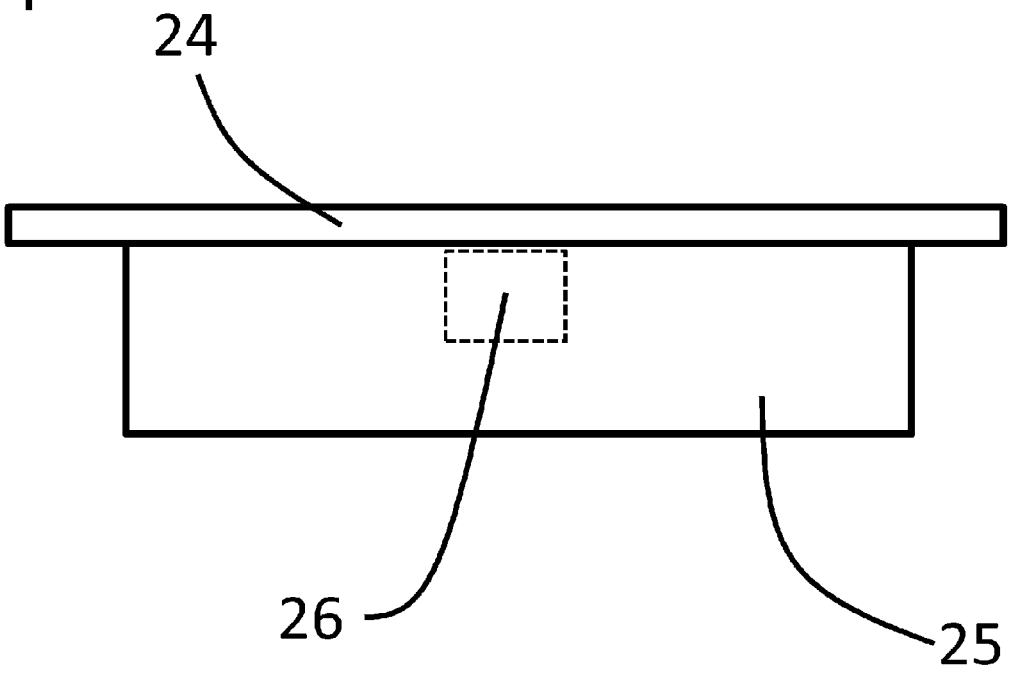
FIG. 1 is a plan view of a stirring member according to Embodiment 1.
Figure 2:
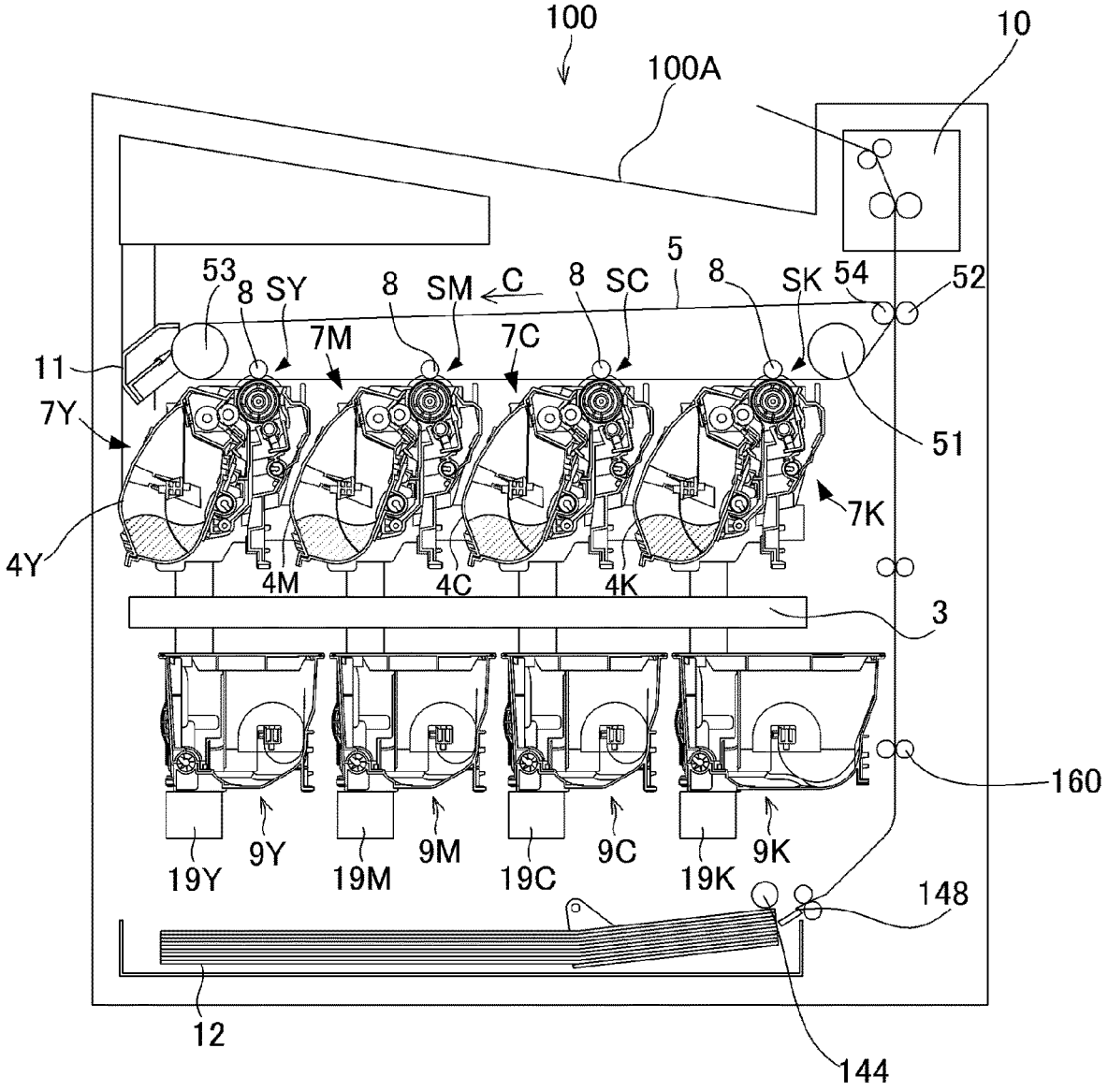
FIG. 2 is a schematic drawing of an image forming apparatus according to Embodiment 1.

First, the overall configuration of an electrophotographic image forming apparatus according to the present invention (hereinafter referred to as an image forming apparatus) will be described. FIG. 2 is a schematic sectional view of an image forming apparatus of Embodiment 1. An image forming apparatus 100 of the present embodiment is a full-color laser printer that employs an in-line method and an intermediate transfer method. The image forming apparatus 100 can form a full-color image on a recording material 12 (for example, recording paper, plastic sheet, cloth, etc.) according to image information. The image information is inputted to an apparatus main body 100A from an image reading device connected to the apparatus main body 100A of the image forming apparatus or from a host device such as a personal computer communicatively connected to the apparatus main body 100A.

The image forming apparatus 100 includes first, second, third, and fourth image forming units for forming images of yellow (Y), magenta (M), cyan (C), and black (K) color, respectively, as a plurality of image forming units SY, SM, SC, and SK. Each of the first to fourth image forming units includes a process cartridge 7 and the like, which will be described hereinbelow. In the present embodiment, the first to fourth image forming units SY, SM, SC, and SK are arranged in a row in a direction intersecting the vertical direction.

In the present embodiment, the configurations and operations of the first to fourth image forming units SY, SM, SC and SK are substantially the same except that the colors of the images to be formed are different. Therefore, in the following description, the subscripts Y, M, C, and K given to the reference numerals to indicate that the elements are provided for the respective colors are omitted and general explanation is given unless a particular distinction is required.

Figure 3:
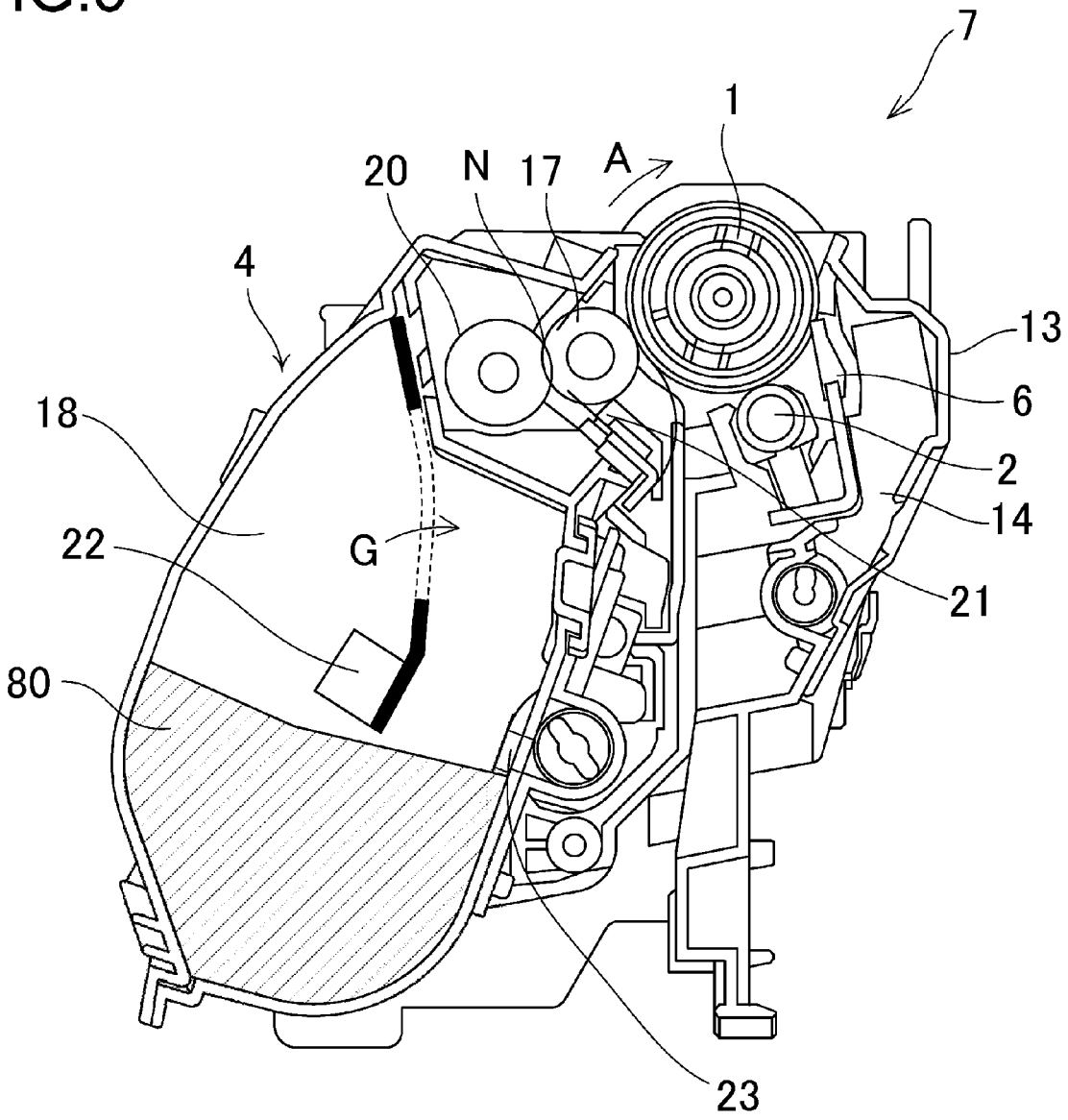
FIG. 3 is a schematic sectional view of a process cartridge according to Embodiment 1.

FIG. 3 shows a sectional view of a process cartridge 7 arranged in the image forming apparatus 100 in the present embodiment.

In the present embodiment, the image forming apparatus 100 has four process cartridges 7 arranged side by side in a direction intersecting the vertical direction. In these four process cartridges, four drum-type electrophotographic photosensitive members, that is, photosensitive drums 1 as shown in FIG. 3, are arranged as a plurality of image bearing members. The photosensitive drum 1 is rotationally driven in a direction indicated by an arrow A (clockwise direction) by a driving unit (driving source) not shown. Arranged around the photosensitive drum 1 are a charging roller 2 as a charging member for uniformly charging the surface of the photosensitive drum 1, and a scanner unit (exposure device) 3 as an exposure unit that performs irradiation with a laser beam on the basis of image information to form an electrostatic image (electrostatic latent image) on the photosensitive drum 1. A developing unit (developing device) 4 as a developing portion for developing the electrostatic image as a toner image, and a cleaning member 6 as a cleaning portion for removing a toner (untransferred toner) remaining on the surface of the photosensitive drum 1 after the transfer are also arranged around the photosensitive drum 1. Further, an intermediate transfer belt 5 as an intermediate transfer member for transferring the toner image on the photosensitive drums 1 to a recording material 12 is arranged facing the four photosensitive drums 1.

In the present embodiment, the developing unit 4 uses a toner 80 of a non-magnetic one-component type as the developer. Further, in the present embodiment, the developing unit 4 carries out reversal development by bringing a developing roller 17 as a developer bearing member into contact with the photosensitive drum 1. That is, in the present embodiment, the developing unit 4 develops the electrostatic image by attaching the toner 80 charged with the same polarity (negative polarity in the present example) as the charging polarity of the photosensitive drum 1 to a portion (image portion, exposed portion) on the photosensitive drum 1 where the charge has been attenuated by the exposure.

In the present embodiment, the photosensitive drum 1, the charging roller 2 as a process unit that acts on the photosensitive drum 1, the developing unit 4, and the cleaning member 6 are integrated, that is, integrally formed into a cartridge, to form a process cartridge 7 shown in FIG. 3. The process cartridge 7 can be detachably attached to the image forming apparatus 100 through a mounting member such as a mounting guide, a positioning member, and the like provided at the apparatus main body 100A of the image forming apparatus. In the present embodiment, the process cartridges 7 for each color have the same shape, and the toners of yellow (Y), magenta (M), cyan (C), and black (K) colors are accommodated in the process cartridges 7 for respective colors.

In the present embodiment, as shown in FIG. 2, a four-color toner accommodation container 9 is provided below the four-color process cartridge 7, and toners are supplied, as appropriate, to the developing unit 4 on the basis of print information from a toner amount detecting member (not shown) provided in the developing unit 4 and the image forming apparatus. At the time of toner supply, the toner discharged from the toner accommodation container 9 to a toner conveying device is conveyed upward as a screw provided in the carrying path is rotationally driven, and is supplied from a supply port provided in the developing unit 4.

Next, the intermediate transfer belt 5 formed of an endless belt as an intermediate transfer member contacts all the photosensitive drums 1 and cyclically moves (rotates) in the direction of arrow C (counterclockwise) in the figure. The intermediate transfer belt 5 is stretched around a driving roller 51, a secondary transfer counter roller 52, and a driven roller 53 as a plurality of support members.

On the inner peripheral surface side of the intermediate transfer belt 5, four primary transfer rollers 8 serving as primary transfer member are arranged side by side so as to face the respective photosensitive drums 1. The primary transfer roller 8 presses the intermediate transfer belt 5 toward the photosensitive drum 1, and forms a primary transfer portion where the intermediate transfer belt 5 and the photosensitive drum 1 contact each other. Then, a bias having a polarity opposite to the regular charging polarity of the toner is applied to the primary transfer roller 8 from a primary transfer bias power source (high-voltage power source) as a primary transfer bias applying unit (not shown). As a result, the toner image on the photosensitive drum 1 is transferred (primary transfer) onto the intermediate transfer belt 5.

A secondary transfer roller 54 as a secondary transfer member is arranged at a position facing a secondary transfer counter roller 52 on the outer peripheral surface side of the intermediate transfer belt 5. The secondary transfer roller 54 is pressed against the secondary transfer counter roller 52, with the intermediate transfer belt 5 interposed therebetween, to form a secondary transfer portion where the intermediate transfer belt 5 and the secondary transfer roller 54 contact each other. Then, a bias having a polarity opposite to the regular charging polarity of the toner is applied to the secondary transfer roller 54 from a secondary transfer bias power source (high-voltage power source) as a secondary transfer bias applying unit (not shown). As a result, the toner image on the intermediate transfer belt 5 is transferred (secondary transfer) to the recording material 12.

A pickup roller 144 and a conveying roller 148 as a conveying unit that conveys the recording material 12 to the secondary transfer unit, and a registration roller 160 are provided. The recording material 12 is fed by the pickup roller 144 at a predetermined timing from the start of exposure. Then, the recording material is conveyed by the conveying roller 148, and further conveyed by the registration roller 160 to a position in front of the secondary transfer roller 54. After that, when the leading edge of the recording material 12 is detected by a paper detection sensor (not shown), the conveying roller 148 and the registration roller 160 are temporarily stopped and put in a standby state. Then, the driving of the conveying roller 148 and the registration roller 160 is restarted at a predetermined timing. As a result, the recording material 12 in the standby state starts to move and is conveyed toward the secondary transfer portion. Since the paper feeding and the paper re-feeding are executed at a predetermined timing from the start of exposure, the toner image on the intermediate transfer belt 5 exactly overlaps the recording material 12 at the secondary transfer portion, so that the toner image is secondarily transferred onto the recording material 12 without displacement.

A series of image forming operations will be explained hereinbelow. First, the surface of the photosensitive drum 1 is uniformly charged by the charging roller 2. Then, the surface of the charged photosensitive drum 1 is scanned and exposed according to the image information by the laser beam emitted from the scanner unit 3, and an electrostatic image corresponding to the image information is formed on the photosensitive drum 1. Next, the electrostatic image formed on the photosensitive drum 1 is developed as a toner image (developer image) by the developing unit 4. The toner image formed on the photosensitive drum 1 is transferred (primary transfer) onto the intermediate transfer belt 5 by the action of the primary transfer roller 8. For example, when forming a full-color image, the above process is sequentially performed in the first to fourth image forming units SY, SM, SC, and SK, and the toner images of the respective colors are then superposed on the intermediate transfer belt 5 and primarily transferred.

After that, the recording material 12 is conveyed to the secondary transfer portion in synchronization with the movement of the intermediate transfer belt 5. The four-color toner images on the intermediate transfer belt 5 are collectively secondarily transferred onto the recording material 12 by the action of the secondary transfer roller 54 that is in contact with the intermediate transfer belt 5 with the recording material 12 interposed therebetween.

The recording material 12 to which the toner image has been transferred is conveyed to the fixing device 10 serving as a fixing unit. By applying heat and pressure to the recording material 12 in the fixing device 10, the toner image is fixed on the recording material 12.

Further, the primary untransferred toner remaining on the photosensitive drum 1 after the primary transfer step is removed and collected by the cleaning member 6. The secondary untransferred toner remaining on the intermediate transfer belt 5 after the secondary transfer step is cleaned by an intermediate transfer belt cleaning device 11. The primary transfer roller 8 and the secondary transfer roller 54 in the above description correspond to the transfer member of the present embodiment.

The image forming apparatus 100 can form a single-color or multi-color image by using only one desired image forming unit or only some (not all) image forming units.

Configuration of Process Cartridge

Next, the overall configuration of the process cartridge 7 installed in the image forming apparatus 100 of the present embodiment will be described. In the present embodiment, the configuration and operation of the process cartridge 7 for each color are substantially the same except for the type (color) of the toner 80 contained therein.

FIG. 3 is a schematic sectional view of the process cartridge 7 of Embodiment 1. The posture of the process cartridge 7 in FIG. 3 relates to a state where the process cartridge 7 is mounted in the image forming apparatus main body. When describing the positional relation, direction, and the like of each member of the process cartridge 7 below, the positional relation, direction, and the like in this posture are shown.

The process cartridge 7 is configured by integrating the photosensitive member unit 13 including the photosensitive drum 1 and the like and the developing unit 4 including the developing roller 17 and the like.

The photosensitive member unit 13 has a cleaning frame 14 as a frame that supports various components in the photosensitive member unit 13. The photosensitive drum 1 is rotatably attached to the cleaning frame 14 through a bearing (not shown). The photosensitive drum 1 is rotationally driven in a direction indicated by arrow A (clockwise direction) in accordance with an image forming operation by transmitting a driving force of a driving motor (not shown) as a driving unit (driving source) to the photosensitive member unit 13. In the present embodiment, the photosensitive drum 1, which is the main component in the image forming process, is an organic photosensitive drum 1 in which an outer peripheral surface of an aluminum cylinder is coated with an underlayer which is a functional film, a carrier generation layer, and a carrier transport layer in this order.

Further, in the photosensitive member unit 13, the cleaning member 6 and the charging roller 2 are arranged so as to contact the peripheral surface of the photosensitive drum 1. The untransferred toner removed from the surface of the photosensitive drum 1 by the cleaning member 6 falls down and is collected in the cleaning frame 14 (hereinafter, a waste toner box). The charging roller 2 serving as a charging unit is driven to rotate by pressing the roller portion made of a conductive rubber against the photosensitive drum 1.

Here, in a charging step, a predetermined DC voltage, with respect to the photosensitive drum 1, is applied to the core metal of the charging roller 2, whereby a uniform dark portion potential (Vd) is formed on the surface of the photosensitive drum 1. A spot pattern of the laser beam emitted correspondingly to the image data from the scanner unit 3 exposes the photosensitive drum 1, and in the exposed portion, the surface charge disappears due to carriers from the carrier generation layer and the potential drops. As a result, an electrostatic latent image having a predetermined bright portion potential (Vl) is formed on the exposed portion, and an electrostatic latent image having a predetermined dark portion potential (Vd) is formed on the unexposed portion on the photosensitive drum 1. In the present example, Vd=−500 V and Vl=−100 V.

Meanwhile, the developing unit 4 has a developing frame 16 as a frame that supports various components in the developing unit 4. The developing unit 4 is provided with the developing roller 17 which is a developer bearing member for bearing the toner 80 as a developer. The developing chamber, in which a toner supply roller 20 as a supply member for supplying the toner 80 to the developing roller 17 is disposed, is formed by the abovementioned developing frame 16 above a below-described toner accommodation chamber 18 in the gravity direction in a posture at the time of use. Further, in the developing unit 4, the toner accommodation chamber 18 having a toner accommodation portion (developer accommodation portion) for accommodating the toner 80 below the toner supply roller 20 in the gravity direction is also formed by the developing frame 16. Further, the developing unit 4 has an upper wall portion and a lower wall portion that separate the developing chamber and the toner accommodation chamber.

Further, the toner supply roller 20 is rotating while forming a toner nip portion N (a portion where the toner is sandwiched between the developing roller 17 and the toner supply roller 20) together with the developing roller 17.

A stirring member 22 is provided in the toner accommodation chamber 18. The stirring member 22 serves to stir the toner 80 accommodated in the toner accommodation chamber 18 and also to convey the toner 80 toward the upper portion of the toner supply roller 20 in the direction of arrow G in the figure.

A developing blade 21 is arranged below the developing roller 17 and brought into contact with the developing roller 17 by a counterweight, and regulates the coat amount of the toner 80 supplied by the toner supply roller 20 and imparts an electric charge thereto. In the present embodiment, a thin plate made of SUS having a leaf spring shape with a thickness of 0.1 mm is used as the developing blade 21, the contact pressure is formed by utilizing the spring elasticity of the thin plate, and the surface of the thin plate is brought into contact with the toner and the developing roller 17. Here, the developing blade is not limited to the above-described plate, and a thin metal plate made of phosphor bronze or aluminum may be used as well. Further, the surface of the developing blade 21 may be coated with a thin film of a polyamide elastomer, a urethane rubber, a urethane resin, or the like.

The toner 80 is triboelectrically charged and provided with an electric charge by rubbing against the developing blade 21 and the developing roller 17, and at the same time, the layer thickness is regulated. Further, in the present example, a predetermined voltage is applied to the developing blade 21 from a blade bias power source (not shown) to stabilize the toner coat. In the present embodiment, V=−500 V is applied as a blade bias.

The developing roller 17 and the photosensitive drum 1 rotate so that surfaces thereof move in the same direction (in the present example, from the bottom to the top) in the opposing portion.

In the present embodiment, the developing roller 17 is arranged in contact with the photosensitive drum 1, but the developing roller 17 may be arranged close to the photosensitive drum 1 with a predetermined gap therebetween.

In the present embodiment, at the developing portion where the toner 80 negatively charged by triboelectric charging with respect to the predetermined DC bias applied to the developing roller 17 contacts the photosensitive drum 1, the toner moves only to the bright potential portion due to the potential difference therebetween to visualize the electrostatic latent image. In the present embodiment, by applying V=−300 V to the developing roller 17, a potential difference ΔV=200 V with the bright potential portion is formed and a toner image is formed.

The toner supply roller 20 is an elastic sponge roller in which a foam layer is formed on the outer periphery of a conductive metal core. The toner supply roller 20 and the developing roller 17 are in contact with each other with a predetermined amount of penetration. The toner supply roller 20 and the developing roller 17 rotate in the nip portion N in opposite directions with a peripheral speed difference, and by this operation, the toner supply roller 20 supplies the toner to the developing roller 17.

Toner Supply to Toner Accommodation Chamber

Figure 6:
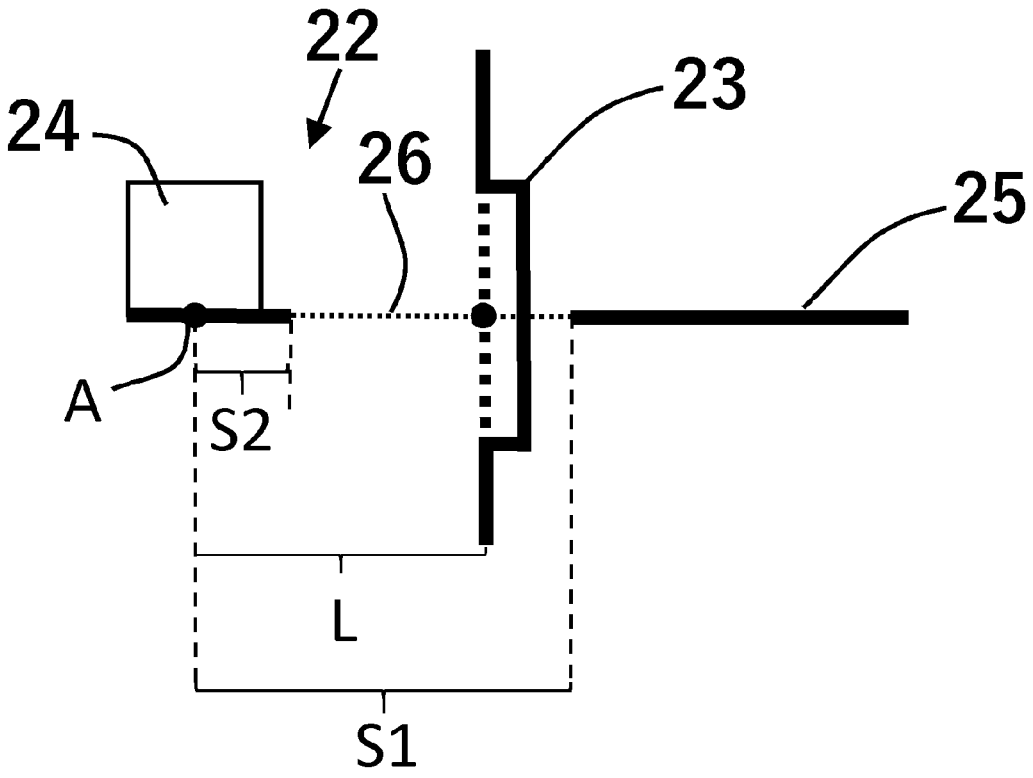
FIG. 6 is a conceptual drawing of a stirring member according to Embodiment 1.

As shown in FIG. 2, in the present embodiment, the toner accommodation containers 9 of the respective colors are arranged to be detachably attachable at positions below the process cartridges 7 of the respective colors and outside the developing unit 4. The toner accommodation container 9 is configured to be able to discharge a desired amount of toner by rotationally driving a screw (not shown) provided inside. The discharged toner is transferred via a toner conveying path from the toner conveying device 19 to a toner receiving port provided in the developing unit 4 on the upper side. The toner conveying device 19 has a space for receiving the toner discharged from the toner accommodation container 9, and also has a drive transmission function for driving a screw (not shown) provided inside the conveying path. The toner transferred to the toner receiving port of the developing unit 4 is supplied to the toner accommodation chamber 18 from a replenishing port 23 provided at the central position in the longitudinal direction via the toner conveying path provided in the developing unit 4 (FIG. 6). The above-mentioned longitudinal direction is parallel to the axial direction of the rotating shaft of the developing roller 17, and is also parallel to the axial direction of a stirring shaft 24 of the stirring member 22, which will be described hereinbelow. In the present embodiment, a method is used in which the toner supply control is performed so that the toner 80 in the developing unit 4 is maintained at 250 g, the toner supply amount is determined based on the print information of the image forming apparatus, and only the determined supply amount of the toner is discharged from the toner accommodation container 9.

Here, the discharging method from the toner accommodation container 9, the conveying method, and the toner supply control are not limited to the methods of the present embodiment, and may be other than in the present embodiment.

Configuration of Stirring Member

Figure 4:
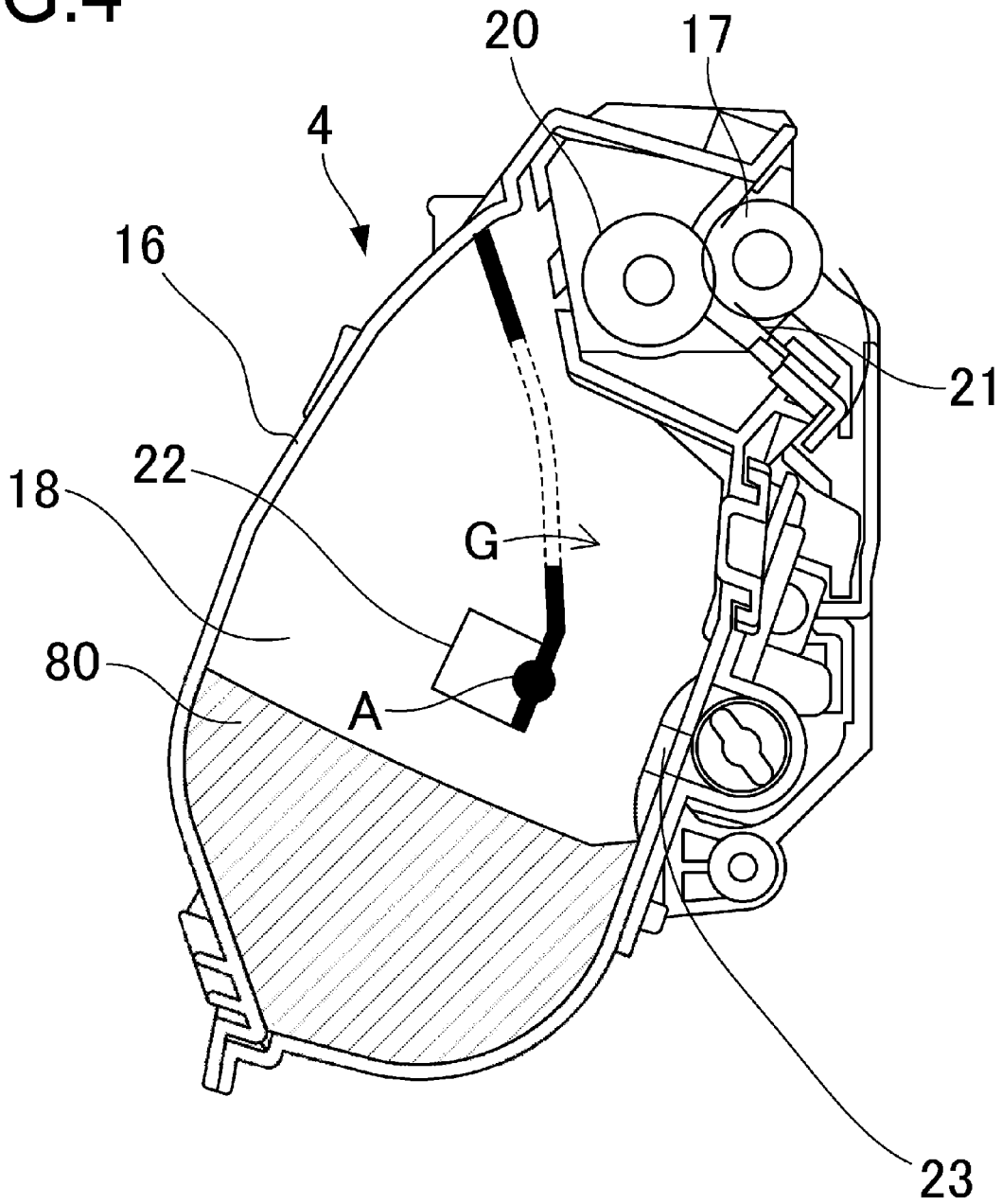
FIG. 4 is a schematic sectional view (long section) of a developing device according to Embodiment 1.
Figure 5:
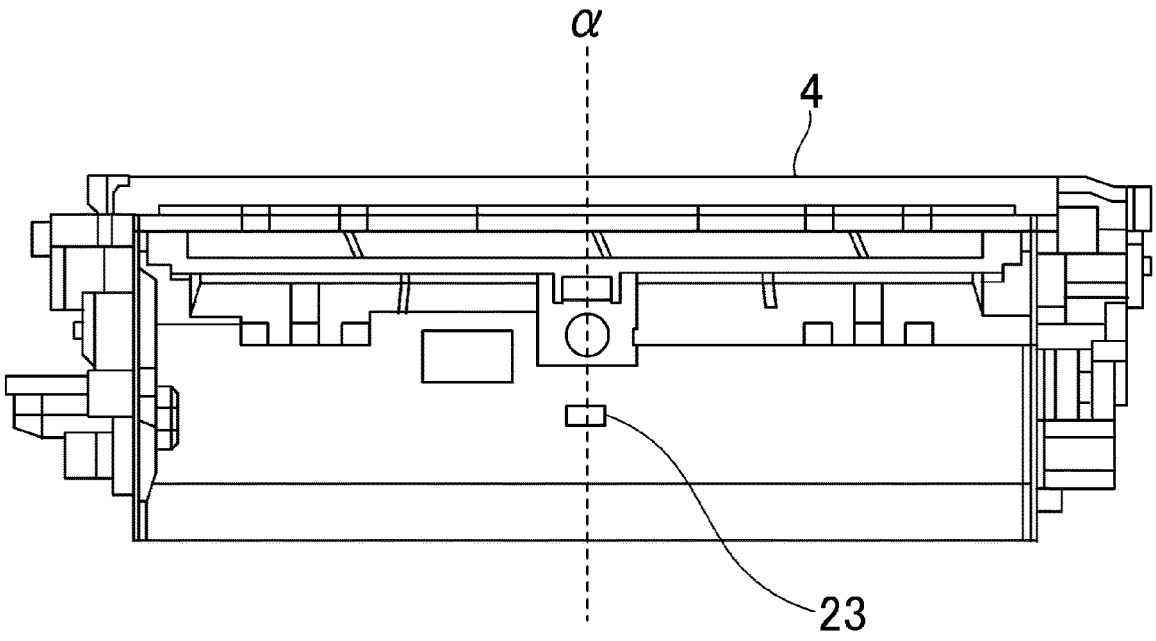
FIG. 5 is a schematic sectional view (short section) of the developing device according to Embodiment 1.

The stirring member, which is a specific feature of the present invention, will be described with reference to FIG. 4. FIG. 4 is a cross section obtained when the developing device is cut at a in FIG. 5. The stirring member 22 of the present embodiment is composed of the stirring shaft 24 serving as a rotating shaft portion that is rotatably supported and a flexible sheet member 25 configured to be fixed at one end to the stirring shaft 24 and be free at the other end. The sheet member 25 can rotate following the rotation operation of the stirring shaft 24. Further, in the sheet member 25, a stirring promotion hole 26, which is a specific feature of the present embodiment, is provided at a central position in the longitudinal direction, which is parallel to the axial direction of the stirring shaft 24, in accordance with the position of the replenishing port 23 provided on the inner wall surface of the frame 16 of the developing unit 4. The stirring member 22 stirs the toner 80 in the toner accommodation chamber 18 by the sheet member 25 as the stirring shaft 24 is driven to rotate. Further, together with the stirring, the stirring member 22 supplies the toner 80 into the developing chamber provided above, thereby making it possible to supply the toner 80 to the developing roller 17 via the supply roller and to develop the toner on the photosensitive drum 1.

Mixing of Toner in Stirring Chamber

A toner 80*a* (hereinafter referred to as "new toner") supplied for replenishment from the toner accommodation container 9 into the toner accommodation chamber through the toner conveying device 19 and the replenishing port 23 is stirred and conveyed in the toner accommodation chamber 18 by the rotation of the sheet member 25 together with a toner 80*b* (hereinafter referred to as "old toner") that has been accommodated in the toner accommodation chamber 18 before being replenished.

Here, as the developing unit 4 is used and the toner circulation is repeated in the developing unit 4, the deterioration of the old toner 80*b* in the toner accommodation chamber 18 is advanced. The deterioration herein refers to a phenomenon in which the behavior such as the charging characteristic of the toner changes with respect to that of the new toner 80*a*, which is supplied for replenishment from the toner accommodation container 9, due to wear and deformation of the toner resin by mechanical rubbing, or the release of an external additive added to the surface and embedding thereof into the resin.

In other words, as the developing unit 4 is used and the old toner 80*b* is deteriorated, a difference in charging characteristic with the new toner 80*a* occurs. Where the charging characteristics of the toner are different, when the electrostatic latent image formed on the photosensitive drum 1 is visualized, the amount of toner that fills the electrostatic latent image can change, and the toner can fly not only to the bright portion potential but also to the dark portion potential. As a result, problems such as density unevenness and scumming will occur.

In order to suppress the occurrence of such problems, the following is required. That is, it is necessary that the new toner 80*a* and the old toner 80*b* be sufficiently stirred in the toner accommodation chamber 18, and the new toner 80*a* be prevented from being unevenly distributed in the old toner 80*b* even when a difference in charging characteristic occurs between the new toner 80*a* and the old toner 80*b*.

In the present invention, the stirring promotion hole 26, which is a through hole penetrating in the thickness direction of the sheet member 25, such as shown in FIG. 6, is provided in a region where the sheet member 25 can be in contact with the inner wall surface of the toner accommodation chamber 18, and the positional relationship with the replenishing port 23 and the length of the stirring promotion hole 26 are specified as described hereinbelow. With this configuration, scumming is suppressed without using an additional member such as a stirring screw. The detailed mechanism thereof will be described below.

Figure 7A:
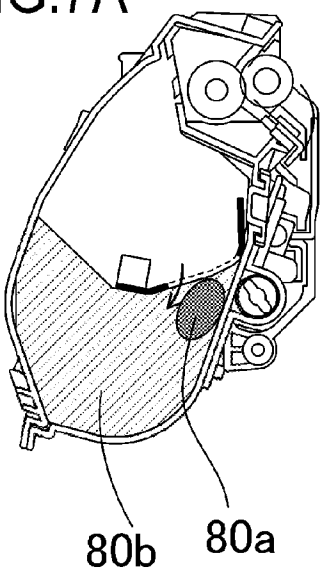
FIGS. 7A to 7D are drawings illustrating toner circulation according to Embodiment 1.
Figure 7B:
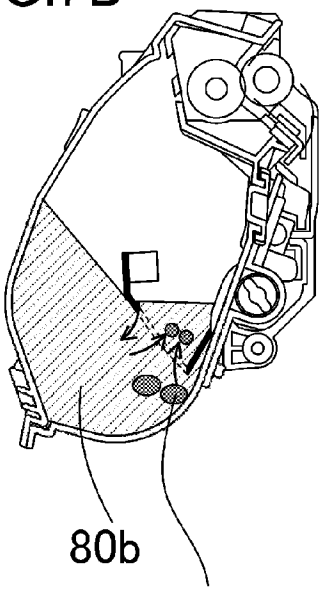
Figure 7C:
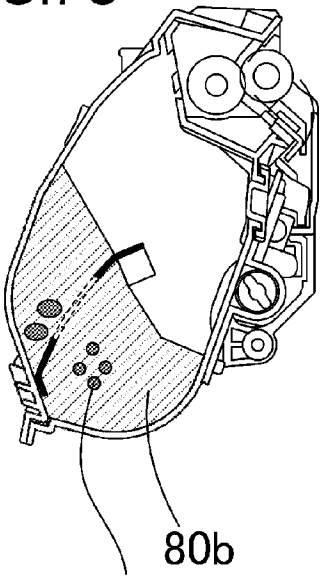
Figure 7D:
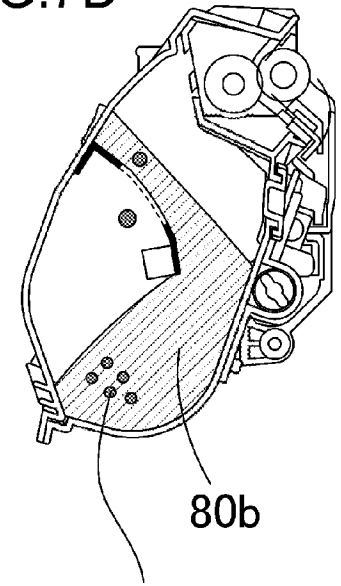

First, the difference in the toner stirring process caused by the presence or absence of the stirring promotion hole will be described with reference to FIGS. 7A to 7D and 8A to 8D. FIG. 7A shows a state in which the toner 80*a* is supplied for replenishment from the replenishing port 23 when the stirring member 22 is in the phase shown in the drawing. Thereafter, as the stirring member 22 is driven to rotate, the toner 80*a* is pushed out and transported by the sheet member 25, but since there is no pressure on the toner at the portion of the stirring promotion hole 26, some of the toner 80*a* passes the stirring promotion hole 26 (FIG. 7B). At this time, a pressure difference is generated in the vicinity of the stirring promotion hole, and a toner flow occurs in the direction opposite to the rotation direction of the stirring member 22. Further, when the sheet member 25 approaches the opening of the developing chamber (FIG. 7C), mixing of the transported toner 80*a* and the toner 80*b* accommodated in the accommodation chamber also progresses, and mixing of the toner 80*a* that has passed through the stirring promotion hole 26 also progresses. After that, when the toner is lifted into the developing chamber, mixing of the toners sufficiently progresses, so that the scumming due to the toner replenishment can be suppressed.

Figure 8A:
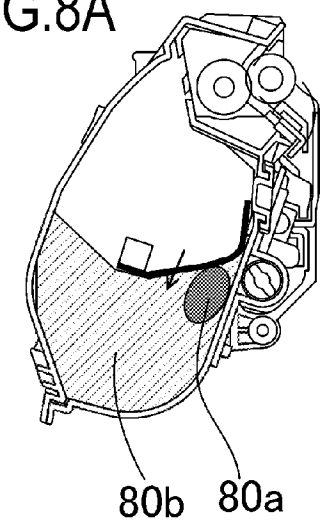
FIGS. 8A to 8D are drawings illustrating toner circulation according to a comparative example of Embodiment 1.
Figure 8B:
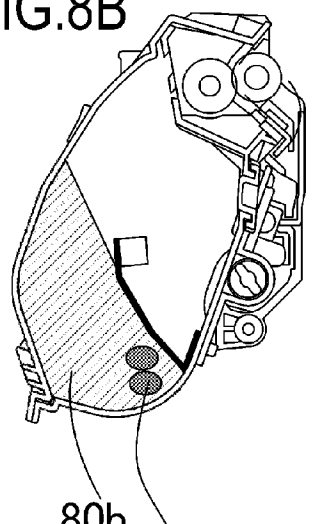
Figure 8C:
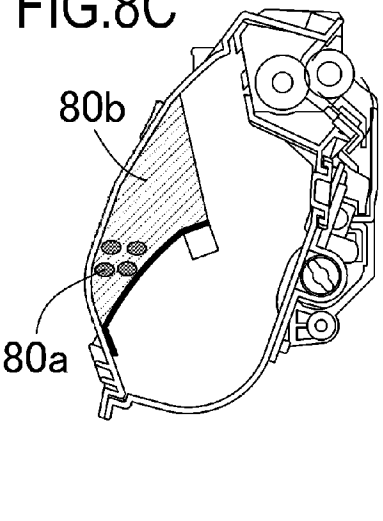
Figure 8D:
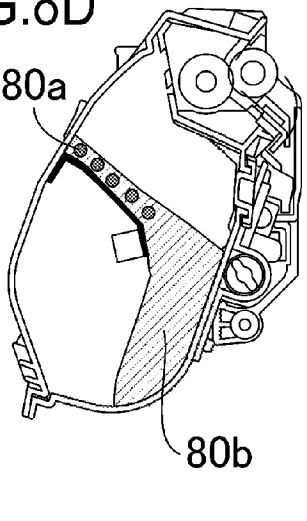

As Comparative Example 1 of the present embodiment, FIGS. 8A to 8D show schematic stirring drawings of a sheet member having no stirring promotion hole. Similar to FIGS. 7A to 7D, when the toner 80*a* is supplied for replenishment from the replenishing port 23 when the stirring member is in the phase shown in FIG. 8A, the toner 80*a* is pushed out and transported as the stirring member is driven to rotate. After that, as the sheet member approaches the opening of the developing chamber, the mixing of the toner 80*a* and the toner 80*b* in the accommodation chamber progresses (FIGS. 8B and 8C), but the toners 80*a* and 80*b* are difficult to mix as compared with the case where the stirring promotion hole is provided (FIG. 8D). In particular, when the use of the process cartridge 7 progresses, the charging capability of the toner in the toner accommodation chamber changes due to the embedding or detachment of an external additive. In such a case, uneven charging of the toner occurs due to the difference in charging capability between the old toner 80*b* and the new toner 80*a*, which causes scumming.

With the aforementioned in view, an effect confirmation test was conducted in order to verify what kind of positional relationship between the stirring promotion hole 26 and the replenishing port 23 is effective. FIG. 6 is a schematic drawing showing the positional relationship between the stirring promotion hole and the replenishing port when viewed from the axial direction of the stirring shaft 24 that is the rotating shaft portion. The reference symbols in FIG. 6 are defined as shown below.

A: Position where the sheet member 25 of the stirring member 22 is fixed to the stirring shaft 24.

L: Distance between the position A and the center position of the replenishing port 23 in the rotation direction of the stirring shaft 24.

S1: Length from the position A in the sheet member 25 to one end of the stirring promotion hole 26 that is closer to the free end of the sheet member 25.

S2: Length from the position A in the sheet member 25 to the other end of the stirring promotion hole 26 that is closer to the stirring shaft 24 of the sheet member 25.

In the following, the relative magnitude relationship of the dimensions represented by the above symbols is a magnitude relationship in the drawing in which the sheet member 25 is not bent, rather than during actual rotation drive when the sheet member 25 of the stirring member 22 is bent. However, in S1 and S2, since the length from the position A to a certain point of the sheet member 25 itself is represented, the sheet member 25 may be bent.

Effect Confirmation Test

In order to verify the effect of the present example, a test was conducted by changing the size of S1. In Example 1, Example 2, and Example 3, the size of S1 was changed. In all the examples, the point at which the stirring promotion hole 26 passes near the replenishing port 23 as the stirring shaft 24 rotates is the same. As comparative examples, Comparative Example 1 represents a case where the stirring promotion hole 26 is not provided, and Comparative Example 2 represents a case where S1 is smaller than L and the stirring promotion hole 26 does not pass near the replenishing port 23. Further, in this test, the length of the stirring promotion hole 26 in the longitudinal direction is unified to 30 mm. As for the test environment, a two-sheet intermittent printing durability test was performed under a high-temperature and high-humidity environment (temperature 30° C., humidity 80%). In this printing durability, horizontal lines with an image ratio of 1% were printed. The present test was started in a state where 200 g of the toner was filled in the process cartridge 7, and control was performed to supply 10 g of the replenishing toner from the toner accommodation container 9 every time the amount of the toner decreased by 10 g. Then, printing durability was performed until the usage amount of the process cartridge 7 reached 100%, and the occurrence of scumming was determined according to the following criteria.

Evaluation of Scumming

The scumming is an image defect manifested by toner being slightly developed in the unexposed area where printing is not originally performed. The image forming apparatus is stopped while printing a solid white image. The toner on the photosensitive drum after development and before transfer is transferred to a transparent tape, and the tape with the toner adhered thereto is attached to a recording paper or the like. Further, a tape without the toner is also attached to the same recording paper at the same time. On these tapes attached to the recording paper, the optical reflectance is measured with a green filter by using an optical reflectance measuring instrument (TC-6DS manufactured by Tokyo Denshoku Co., Ltd.), the reflectance amount of the scumming fraction is obtained by subtracting the reflectance of the tape with the toner adhered thereto from the reflectance of the tape without the toner, and the result is evaluated as the amount of scumming. The amount of scumming was measured on three or more points on the tape, and the average value was obtained.

O: The amount of scumming is less than 3.0%.

X: The amount of scumming is 3.0% or more.

The evaluation results are shown in Table 1.

TABLE 1

| | S2 | L | S1 | Scumming |
|---|---|---|---|---|
| Example 1 | 5 | 18 | 25 | ○ |
| Example 2 | 5 | 18 | 25 | ○ |
| Example 3 | 5 | 18 | 30 | ○ |
| Comparative Example 1 (No stirring promotion hole) | — | 18 | — | X |
| Comparative Example 2 | 5 | 18 | 10 | X |

In Examples 1, 2 and 3, no scumming occurred. This means that it is important to maintain the relationship of S1>L>S2 even if there is a difference in the absolute value of S1. The reason why the scumming has not occurred will be described hereinbelow. First, when S1 is larger than L as in Examples 1 to 3, the end of the stirring promotion hole 26 that is closer to the free end of the sheet member 25 reaches the replenishing port 23. Then, when the stirring shaft 24 of the stirring member 22 rotates, the sheet member 25 comes into contact with the inner wall surface of the toner accommodation chamber 18 as the stirring shaft 24 rotates. The position of the stirring promotion hole 26 of the sheet member 25 becomes arranged at a position overlapping with the position where the replenishing port 23 of the toner accommodation chamber 18 is provided. As a result, the new toner 80*a*, which easily accumulates in the vicinity of the replenishing port, passes the stirring promotion hole 26 and is stirred at a portion of the sheet member 25 where the stirring promotion hole 26 is not present, thereby enabling mixing with the old toner 80*b*.

Meanwhile, in Comparative Example 1 of the present embodiment, there is no stirring promotion hole, and it is considered that scumming has occurred due to the mechanism described with reference to FIGS. 8A to 8D described above.

Comparative Example 2 represents a case where S1 is smaller than L. Under such conditions, the end of the stirring promotion hole 26 that is closer to the free end of the sheet member 25 does not reach the replenishing port 23. Accordingly, even if the sheet member 25 comes into contact with the inner wall surface of the toner accommodation chamber 18 as the stirring shaft 24 rotates, the position of the stirring promotion hole 26 does not overlap with the position where the replenishing port 23 is provided. As a result, the stirring promotion hole 26 cannot pass near the replenishing port, so that the new toner 80*a* and the old toner 80*b* cannot be mixed, and the effect on the scumming is reduced. Summarizing the above, it is understood that the effect of the stirring promotion hole on the scumming depends on the magnitude relationship between S1, S2, and L. Therefore, it is understood that the condition of S1>L>S2 as in Examples 1, 2 and 3 is desirable, and that under the condition of L>S1>S2 as in Comparative Example 2, the effect of the stirring promotion hole is insufficient. With the above-described configuration of the present invention, it is possible to suppress the scumming caused by toner replenishment without using an additional member such as a stirring screw.

Embodiment 2

In the present embodiment, where the length of the sheet member 25 in the axial direction of the stirring shaft 24 is taken as 1, the ratio defined by [the length of the stirring promotion hole]/[the length of the sheet member] is 0.2 or less. An example of solving the image density unevenness due to the toner supply unevenness under a low-temperature and low-humidity environment by such a definition is shown hereinbelow. Detailed description of other features that are the same as those of Embodiment 1 will be omitted.

By providing the stirring promotion hole 26 in the sheet member 25 of the stirring member 22 under the conditions described in Embodiment 1, the toner 80*a* supplied for replenishment and the toner 80*b* already present in the toner accommodation chamber can be sufficiently mixed. Meanwhile, when the stirring promotion hole is large in the longitudinal direction which is a direction parallel to the axial direction of the stirring shaft 24, the toner conveying force may change due to a change in the bending of the sheet member 25. In particular, for example, when a toner is electrostatically aggregated and fluidity thereof is reduced in a low-temperature and low-humidity environment, or when high-speed printing is continuously performed, image density unevenness may occur due to uneven toner supply in the longitudinal direction.

The effect of fixing the size of the stirring promotion hole in the lateral direction, which is the direction orthogonal to the longitudinal direction, and changing the size in the longitudinal direction will be described hereinbelow.

Effect Confirmation Test

An effect confirmation test was carried out in a low-temperature and low-humidity environment (temperature 15° C., humidity 10%), and scumming and image density unevenness were confirmed. Table 2 shows the results.

Evaluation of Image Density Unevenness

Image density unevenness, as referred to herein, indicates an image defect in the form of slight blank dots occurring because the required amount of toner is not supplied to the developing roller when high-speed printing is continuously performed.

After printing 1,000 sheets with a print percentage of 1%, a solid black image was printed, and the image density at that time was measured using "Macbeth reflection densitometer RD918" (manufactured by Macbeth Co.). The evaluation was performed according to the following criteria.

O: The density difference between the black portion and the white portion is 0.1 or less.

Δ: The density difference between the black portion and the white portion is 0.1 to less than 0.2.

X: The density difference between the black portion and the white portion is 0.2 or more.

TABLE 2

| | Length of stirring promotion hole in longitudinal direction (mm) | Length of sheet member in longitudinal direction (mm) | Ratio (= [length of stirring promotion hole]/[length of sheet member]) | Scumming | Image density unevenness |
|---|---|---|---|---|---|
| Example 1 | 30 | 240 | 0.1 | ○ | ○ |
| Example 4 | 5 | 240 | 0.02 | ○ | ○ |
| Example 5 | 10 | 240 | 0.04 | ○ | ○ |
| Example 6 | 40 | 240 | 0.2 | ○ | Δ |
| Comparative example 3 | 60 | 240 | 0.3 | ○ | X |

The ratios shown in Table 2 are defined as [the length of the stirring promotion hole]/[the length of the sheet member] and show the toner supply capability of the sheet member 25. The lower the ratio, the smaller the stirring promotion hole and the easier the toner can be transported, and thus the larger the toner supply capability. The higher the ratio, the larger the stirring promotion hole and the harder the toner to transport, and thus the smaller the toner supply capability. In the case of Examples 1, 4, and 5, the stirring promotion hole has an effect of suppressing the scumming, and the image density unevenness also does not occur. However, where the length of the stirring promotion hole in the longitudinal direction is further increased from that in Example 1 as in Example 6, unevenness in toner supply to the developing chamber is likely to become apparent as the image density unevenness. In the case of Comparative Example 3, the length of the stirring promotion hole in the longitudinal direction is 60 mm, and a certain effect on the scumming is exerted, but when the solid image was continuously printed, the image defects occurred. To summarize the above, the length of the stirring promotion hole in the longitudinal direction is preferably in a range that does not cause unevenness in the amount of toner supplied to the developing chamber, and the ratio needs to be 0.2 or less. It follows from the above that it is possible to confirm a suitable size of the stirring promotion hole in the longitudinal direction, and it is possible to solve the image density unevenness in a low-temperature and low-humidity environment without using a stirring screw.

Embodiment 3

In the present embodiment, the configuration of the stirring member is different from that of Embodiment 1. In the present embodiment, an example is shown in which the number of sheet members of the stirring member is increased to two, thereby realizing an increase in toner supply capability and an increase in stirring capability which are difficult to realize with one sheet member. When the sheet member 25 of the stirring member 22 described in Embodiment 1 is used as a first sheet member 25*a*, a second sheet member 25*b* separate therefrom is fixed to the stirring shaft 24, which is the same rotating shaft portion as that of the stirring member 22, and arranged in the toner accommodation chamber so as to contact the inner wall surface of the toner accommodation chamber 18. The position where the second sheet member 25*b* is fixed to the stirring shaft 24 is different from that of the first sheet member 25*a* in the circumferential direction of the stirring shaft 24. Detailed description of other features that are the same as those of Embodiment 1 will be omitted.

Figure 9:
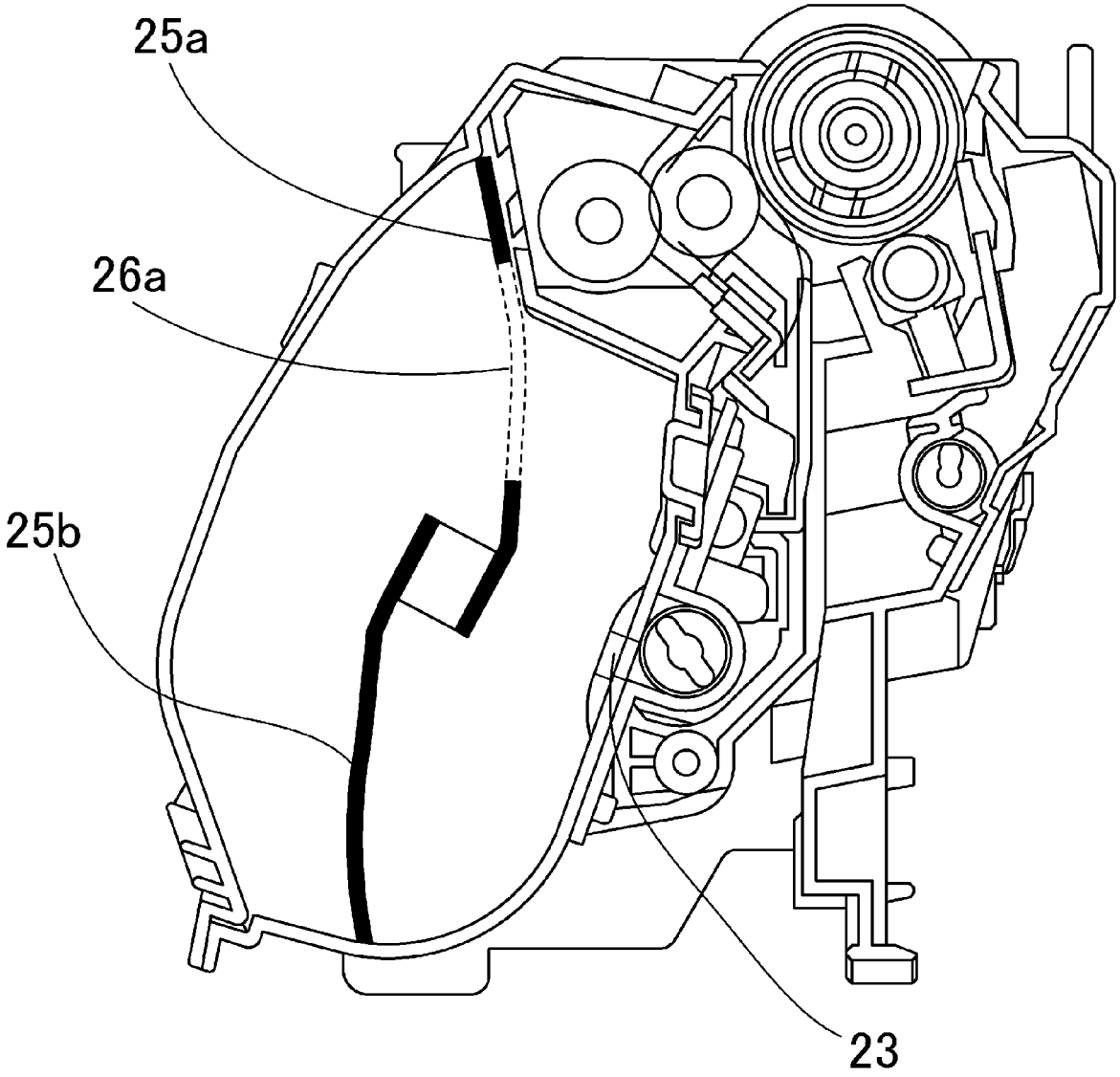
FIG. 9 is a schematic sectional view of a process cartridge according to Embodiment 3.
Figure 10:
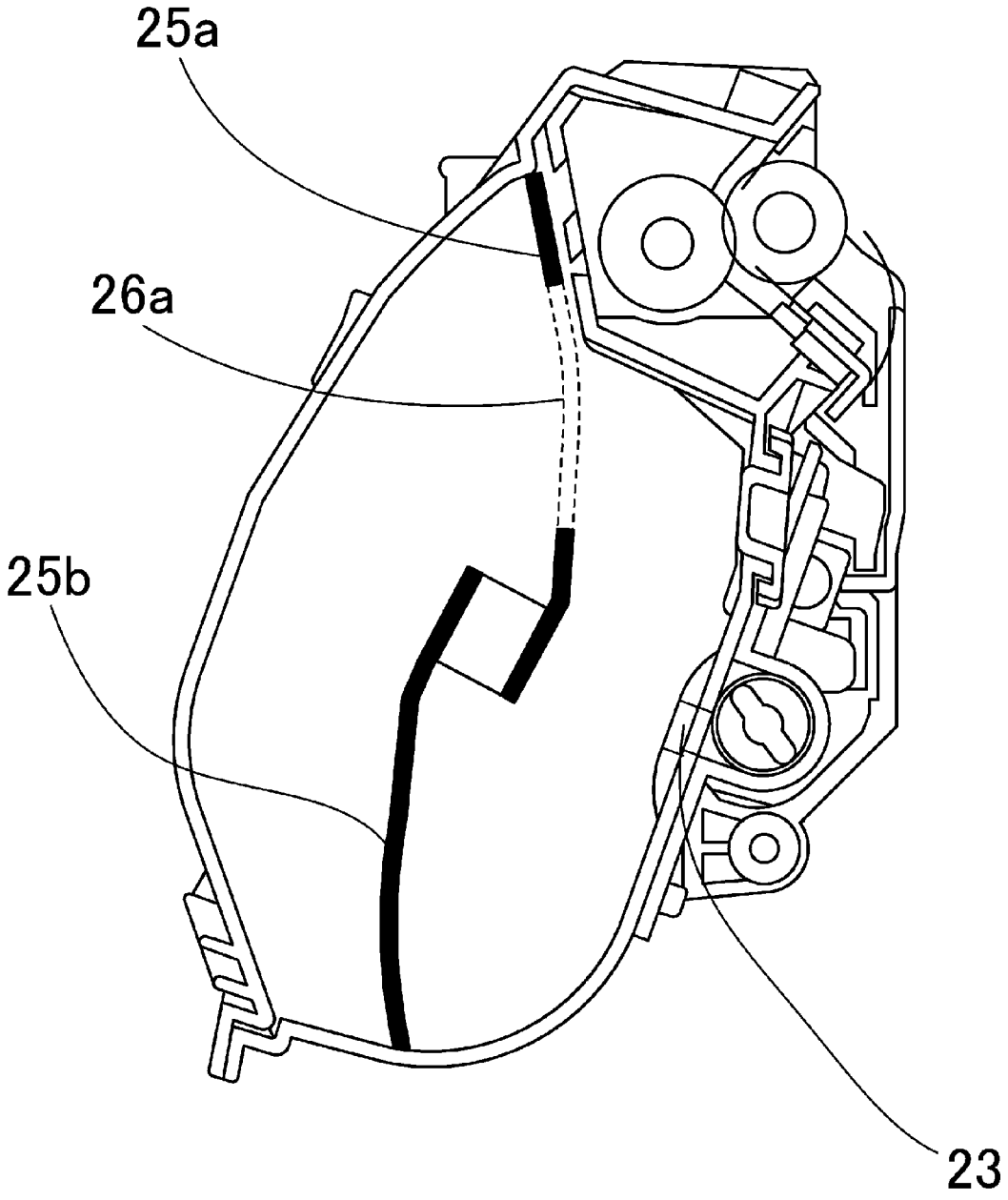
FIG. 10 is a schematic sectional view of a developing device according to Embodiment 3.

FIG. 9 is a schematic sectional view of the process cartridge 7 of the present embodiment, and FIG. 10 is a schematic sectional view of a developing device. The features of the present embodiment will be described in detail using drawings.

The stirring member of the present embodiment is different from that of Embodiment 1 in that two sheet members, namely, the first sheet member 25*a* and the second sheet member 25*b* are provided, which is more preferable because the stirring capability and the toner supply capability to the supply roller 20 can be improved. Another advantage is that, for example, even if the stirring capability or the toner supply capability to the supply roller 20 per one sheet member is reduced due to the reduction in the stirring sheet thickness or the like, the noise or the like caused by the stirring member rubbing against the wall surface can be reduced while maintaining the stirring capability and the supply capability as the stirring member.

Figure 11:
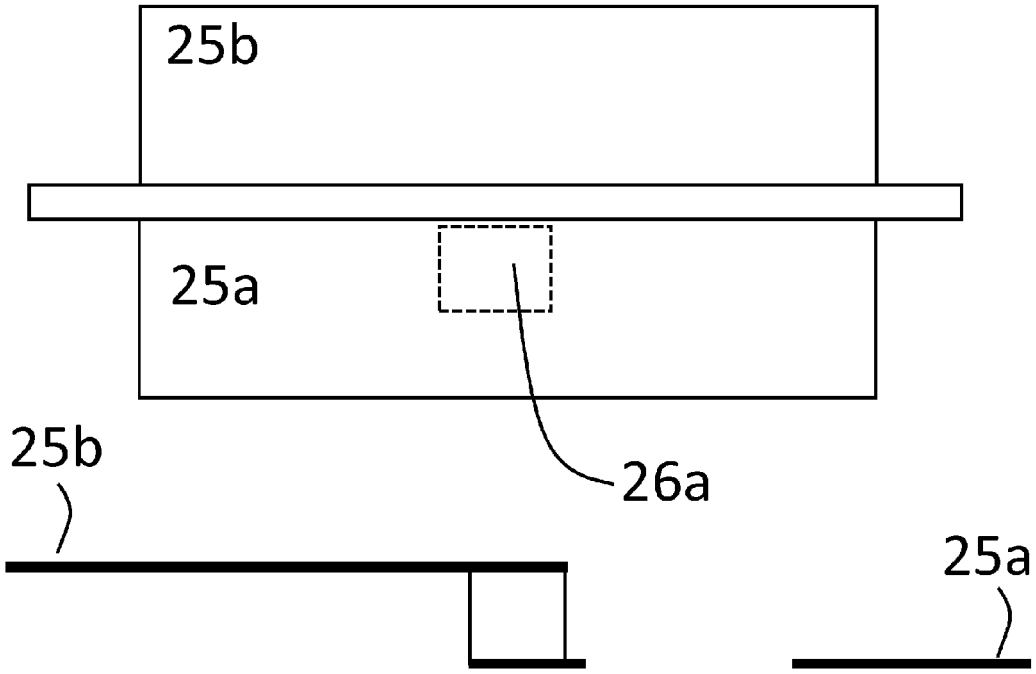
FIG. 11 is a conceptual drawing of a stirring member according to Embodiment 3.

As shown in FIG. 11, the stirring member of the present embodiment has an additional sheet member as compared to Embodiment 1. Specifically, the sheet member of the stirring member 22 in Embodiment 1 is taken as the first sheet member 25*a*, and the second sheet member 25*b* having no stirring promotion hole is fixed at a different position in the circumferential direction of the shaft to the same stirring shaft to which the first sheet member 25*a* has been fixed, and is arranged so as to be able to contact the inner wall surface of the toner accommodation chamber 18. As a result, the toner 80*a* supplied for replenishment as described in Embodiment 1 by the first sheet member 25*a* having the stirring promotion hole and the toner 80*b* in the toner accommodation chamber are efficiently mixed, and the mixed toner can be supplied to the supply roller 20. Further, if the positional relationship between the sheet member and the stirring promotion hole is the same as that of Embodiment 1, the same effect as that of Embodiment 1 can be obtained. That is, considering the movement of the first sheet member 25*a*, since the movement is the same as that of Embodiment 1, the same effect as that of Embodiment 1 can be obtained. Also, considering the movement of the second sheet member 25*b*, since the flow of the toner that has passed through the stirring promotion hole of the first sheet member 25*a* and the flow of the toner transported by the second sheet member 25*b* collide with each other, the old and new toners are mixed, and in this case, the same effect as that of Embodiment 1 can be also obtained.

Figure 12:
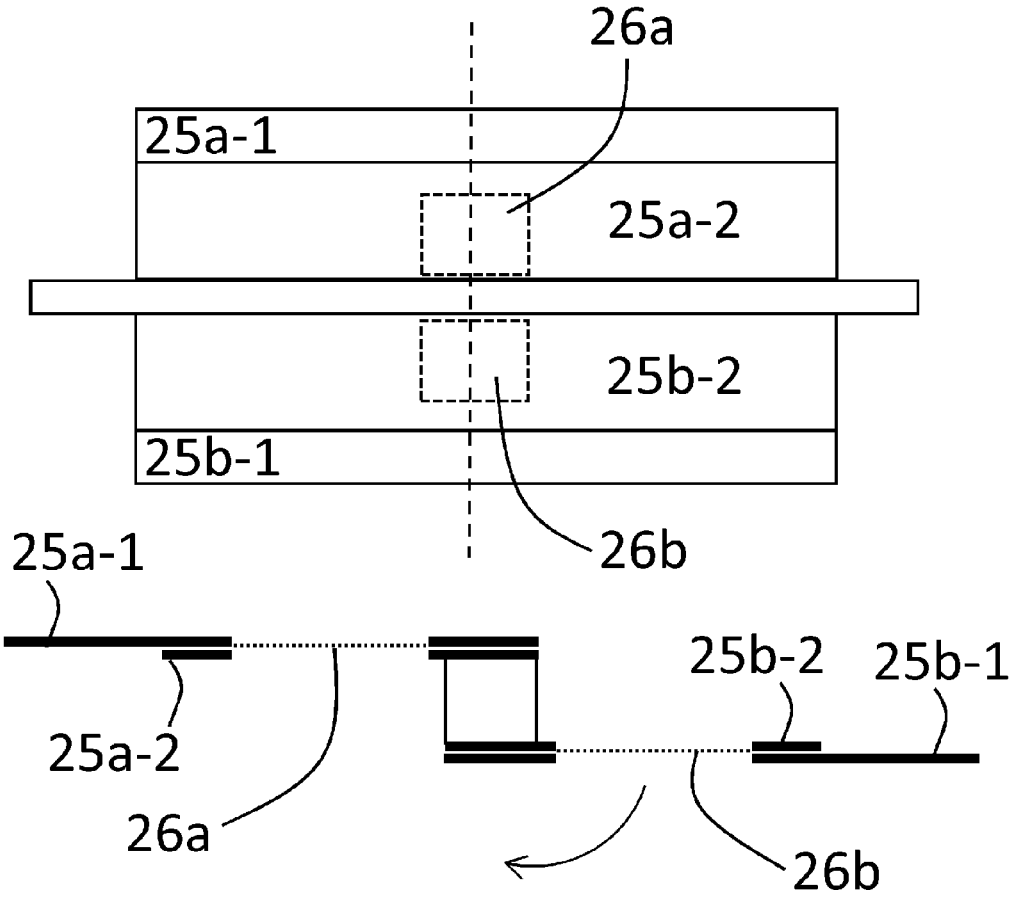
FIG. 12 is a conceptual drawing of a stirring member according to a modification example of Embodiment 3.

Further, for example, there is also a configuration as shown in FIG. 12 which is a modification example of the present embodiment. Here, the first sheet member 25*a* and the second sheet member 25*b* each have a structure in which two sheets are stacked in the thickness direction. The first sheet member 25*a* has a two-layer structure composed of a first sheet portion 25*a*-1 and a second sheet portion 25*a*-2, and the second sheet member 25*b* has a two-layer structure composed of a first sheet portion 25*b*-1 and a second sheet portion 25*b*-2. The length (free length) from the fixed end of the first sheet portions 25*a*-1 and 25*b*-1 fixed to the stirring shaft 22 to the free end is larger than that of the second sheet portions 25*a*-2 and 25*b*-2, respectively. Therefore, when the sheet members rotate in the accommodation chamber, the tips (free ends) of the first sheet portions 25*a*-1 and 25*b*-1 can contact the inner wall surface of the toner accommodation chamber 18, but the tips (free ends) of the second sheet portions 25*a*-2 and 25*b*-2 cannot contact the inner wall surface of the toner accommodation chamber 18. As shown in FIG. 12, the first sheet portions 25*a*-1 and 25*b*-1 of the first sheet member 25*a* and the second sheet member 25*b*, respectively, are arranged on the downstream side in the rotation direction and the second sheet portions 25*a*-2 and 25*b*-2 are arranged on the upstream side in the rotation direction when the sheet members rotate. Further, the first sheet member 25*a* and the second sheet member 25*b* are provided with stirring promotion holes 26*a* and 26*b* in the longitudinal center of the sheet member in the same manner as in Embodiment 1, and the stirring promotion hole is arranged at a position overlapping with the replenishing port 23 in the axial direction of the stirring shaft in each sheet member. Thus, since the first sheet member 25*a* and the second sheet member 25*b* are configured to have a structure in which the sheets are stacked, a state can be obtained in which the flexibility of the sheet member differs between the tip (free end) side of the sheet member that is in contact with the inner wall surface of the toner accommodation chamber 18 and the fixed end side fixed to the stirring shaft. That is, the stirring shaft sides of the first sheet member 25*a* and the second sheet member 25*b* are less likely to be deformed, so that the stirring capability can be further improved. In addition, since the stirring promotion holes are provided for each of the first sheet member 25*a* and the second sheet member 25*b*, the effect of the stirring promotion holes can be further enhanced.

It follows from the above that by increasing the number of sheet members of the stirring member to two, it is possible to realize the improvement of the toner supply capability and the stirring capability, which are difficult to realize when the number of the sheet members is one. Although the number of sheet members is two in the present embodiment, the number of sheet members is not limited to this. That is, with a configuration in which one or more sheet members fixed to the same stirring shaft are provided, it is possible to obtain the effect of improving the toner supply capability and the stirring capability.

Embodiment 4

In the present embodiment, the configuration of the stirring member is partially different from the modification example of Embodiment 3. In the example shown in the present embodiment, the stirring ability is improved as compared with Embodiment 3 by arranging the sheet members having flexibility in two overlapping layers and providing a stirring promotion hole only in one sheet member.

Figure 13:
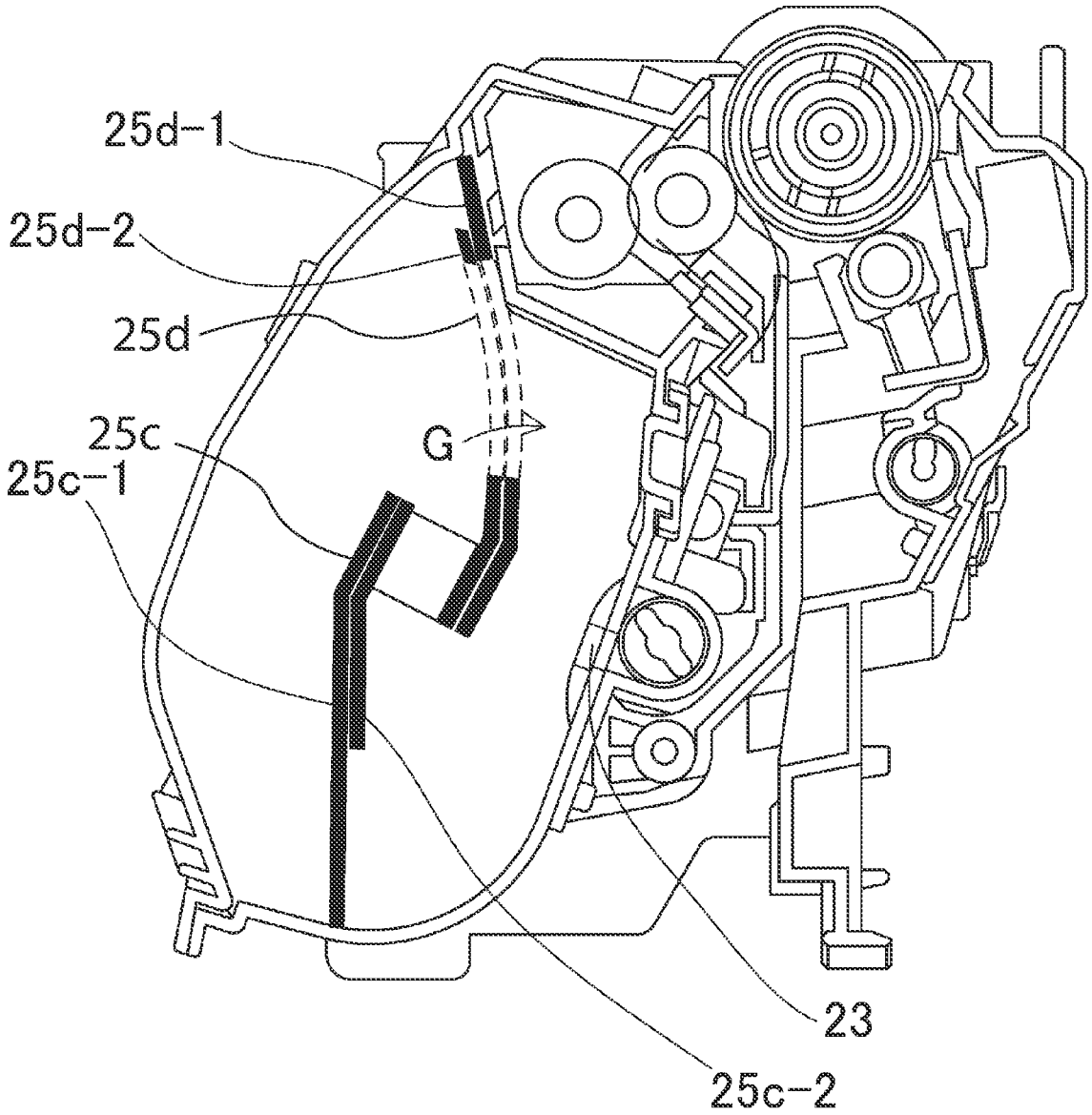
FIG. 13 is a schematic sectional view of a process cartridge according to Embodiment 4.
Figure 14:
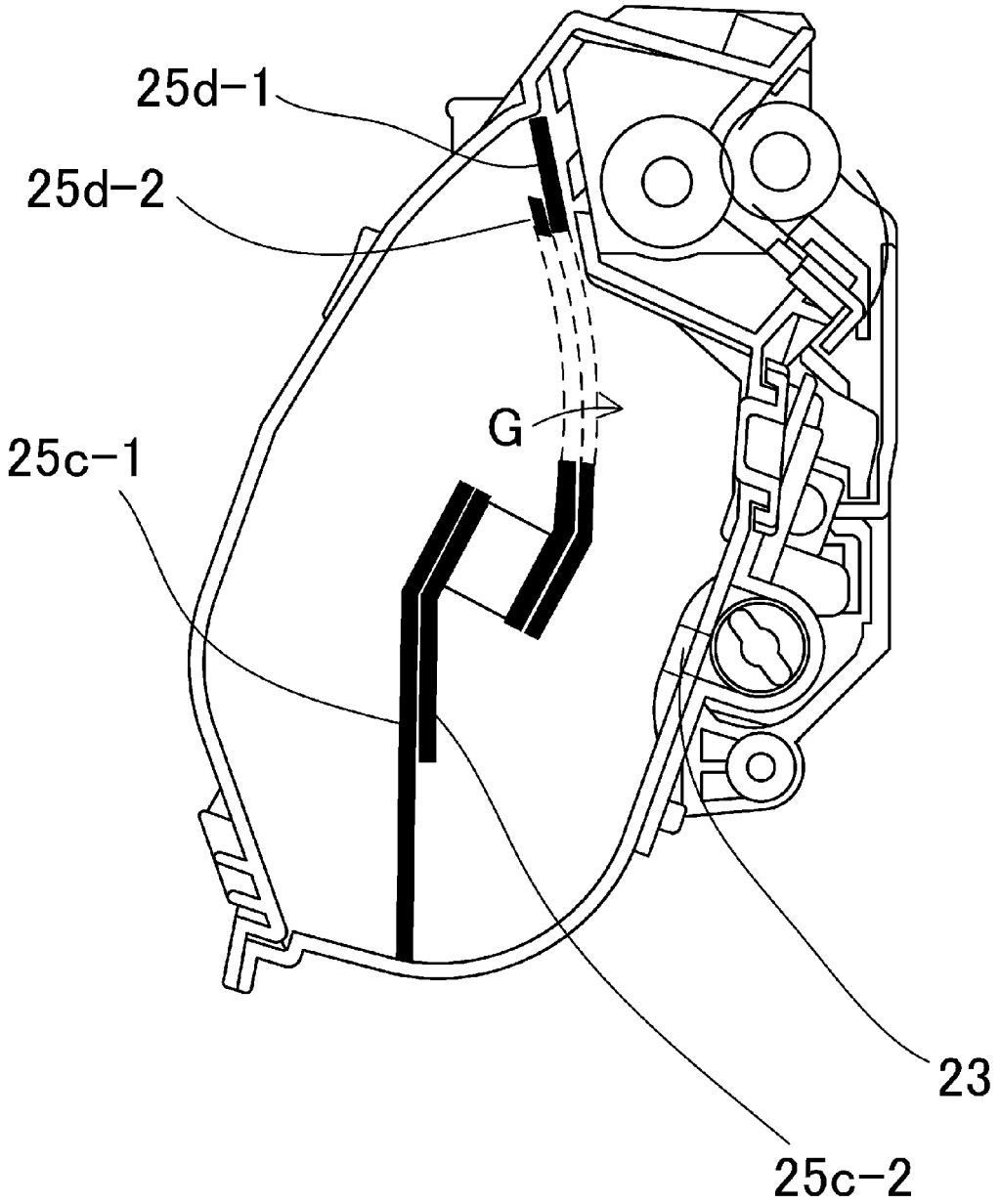
FIG. 14 is a schematic sectional view of a developing device according to Embodiment 4.
Figure 15:
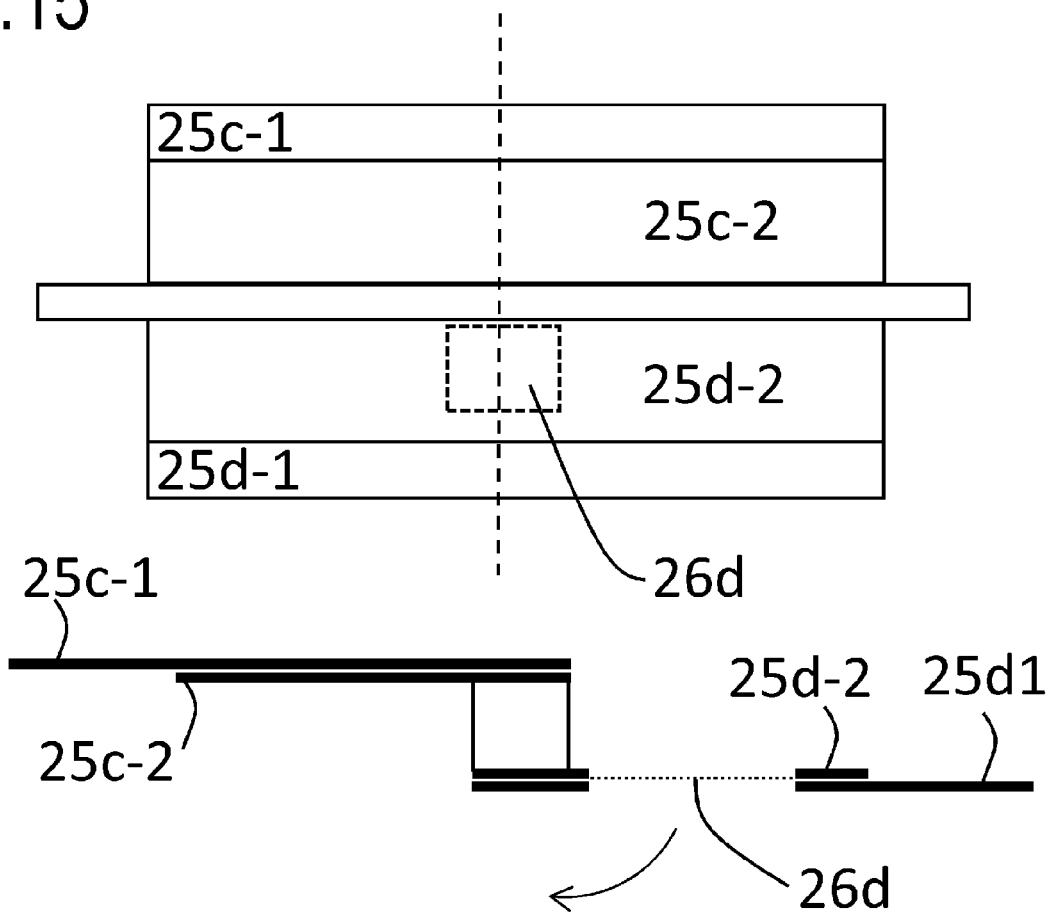
FIG. 15 is a conceptual drawing of a stirring member according to Embodiment 4.

FIG. 13 is a schematic sectional view of the process cartridge 7 of the present embodiment, and FIG. 14 is a schematic sectional view of the developing device of the present embodiment. FIG. 15 is a conceptual drawing of the stirring member according to the present embodiment. The features of the present embodiment will be described in detail using the drawings.

The feature of the stirring member of the present embodiment which is the same as that of the modification example of Embodiment 3 is that where a sheet member 25*c* is taken as the first sheet member and a sheet member 25*d* is taken as the second sheet member, two flexible sheet members are arranged with overlapping for each sheet member. That is, the first sheet member 25*c* has a two-layer structure composed of a first sheet portion 25*c*-1 and a second sheet portion 25*c*-2, and the second sheet member 25*d* has a two-layer structure composed of a first sheet portion 25*d*-1 and a second sheet portion 25*d*-2. The length (free length) from the fixed ends of the first sheet portions 25*c*-1 and 25*d*-1 that are fixed to the stirring shaft 22 to the free ends is larger than that of the second sheet portions 25*c*-2 and 25*d*-2, respectively. Therefore, where the sheet members rotate in the accommodation chamber, the tips (free ends) of the first sheet portions 25*c*-1 and 25*d*-1 can contact the inner wall surface of the toner accommodation chamber 18, but the tips (free ends) of the second sheet portions 25*c*-2 and 25*d*-2 cannot contact the inner wall surface of the toner accommodation chamber 18. As shown in FIGS. 13 to 15, the first sheet portions 25*c*-1 and 25*d*-1 of the first sheet member 25*c* and the second sheet member 25*d*, respectively, are arranged on the downstream side in the rotation direction when rotating. Meanwhile, the second sheet portions 25*c*-2 and 25*d*-2 are arranged on the upstream side in the rotation direction.

The feature of the present embodiment that is different from Embodiment 3 will be described with reference to FIGS. 13 to 15. The difference from Embodiment 3 is that the stirring promotion hole 26*d* is provided only in the second sheet member 25*d*. The second sheet member 25*d* is provided with a stirring promotion hole 26*d* which is a through hole penetrating in the thickness direction at the center in the longitudinal direction of the sheet member as in Embodiments 1 and 3. The stirring promotion hole is arranged at a position overlapping with the replenishing port 23 in the axial direction.

Thus, the two sheet members are each double-layered, and only one sheet member 25*d* is provided with the stirring promotion hole. The advantages of configuring the stirring member in this way will be described hereinbelow. As shown in FIGS. 13 to 15, a state can be obtained in which the flexibility of the sheet member differs between the tip (free end) side of the sheet member that is in contact with the inner wall surface of the toner accommodation chamber 18 and the fixed end side fixed to the stirring shaft. That is, the stirring shaft side of the sheet member is less likely to be deformed, so that the stirring capability can be further improved. In addition, since the stirring promotion hole 26*d* is provided only in the second sheet member 25*d*, the replenished toner and the toner in the toner accommodation chamber are efficiently mixed while more importance is being placed on the toner conveying capability than in Embodiment 3, and the mixed toner can be supplied to the supply roller 20. Further, where the positional relationship between the sheet member and the stirring promotion hole of the stirring member is the same as that of Embodiment 1, the same effect as that of Embodiment 1 can be obtained. This mechanism of this effect is as described in Embodiment 3.

Further, for example, by reducing the sheet thickness of the sheet member 25*c* of the stirring member, it is possible to reduce the noise produced by the sheet member rubbing against the wall surface, while maintaining the stirring capability and the supply capability of the stirring member.

Figure 16:
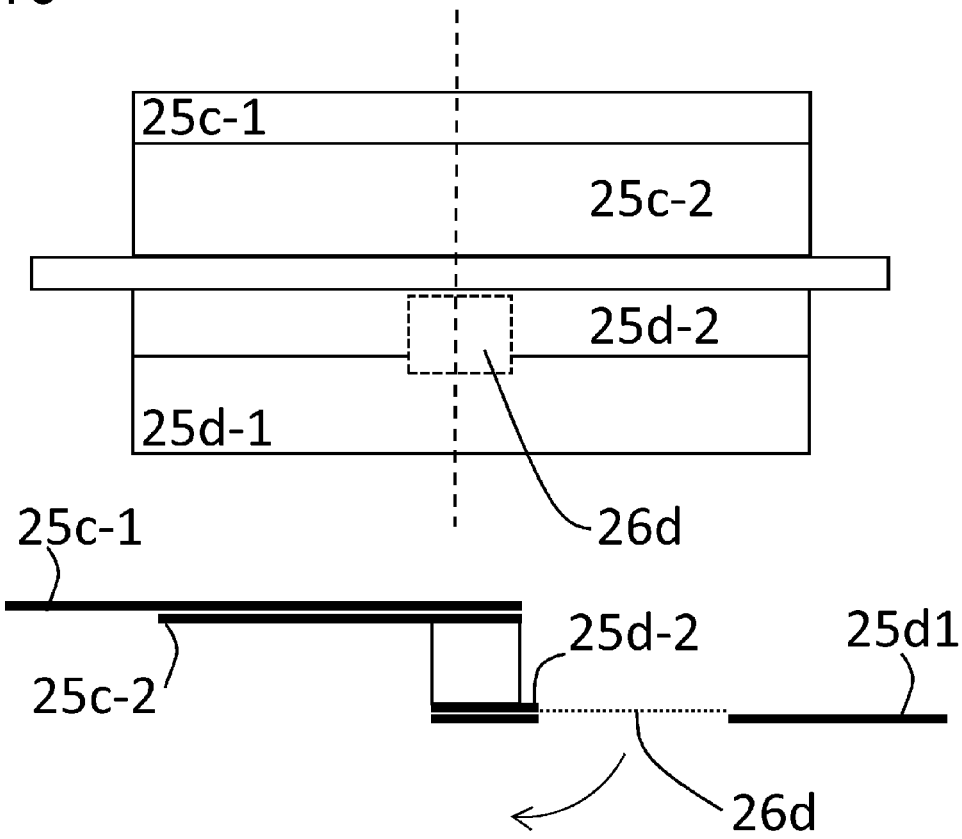
FIG. 16 is a conceptual drawing of a stirring member according to a modification example of Embodiment 4.

Further, as a modification example of the present embodiment, as shown in FIG. 16, the lateral length of the second sheet portion 25*d*-2 overlapping the second sheet member 25*d* may be shorter than the second sheet portion 25*c*-2 overlapping the first sheet member 25*c* without the stirring promotion hole, and the sheet portions may be overlapped only on the stirring shaft side. In such a case, the same effect can be obtained provided that a configuration is used in which the stirring promotion hole 26*d* formed in the second sheet member 25*d* forms a through hole as a stirring promotion hole only in the first sheet of the sheet members to be overlapped.

Other Embodiments

Figure 17:
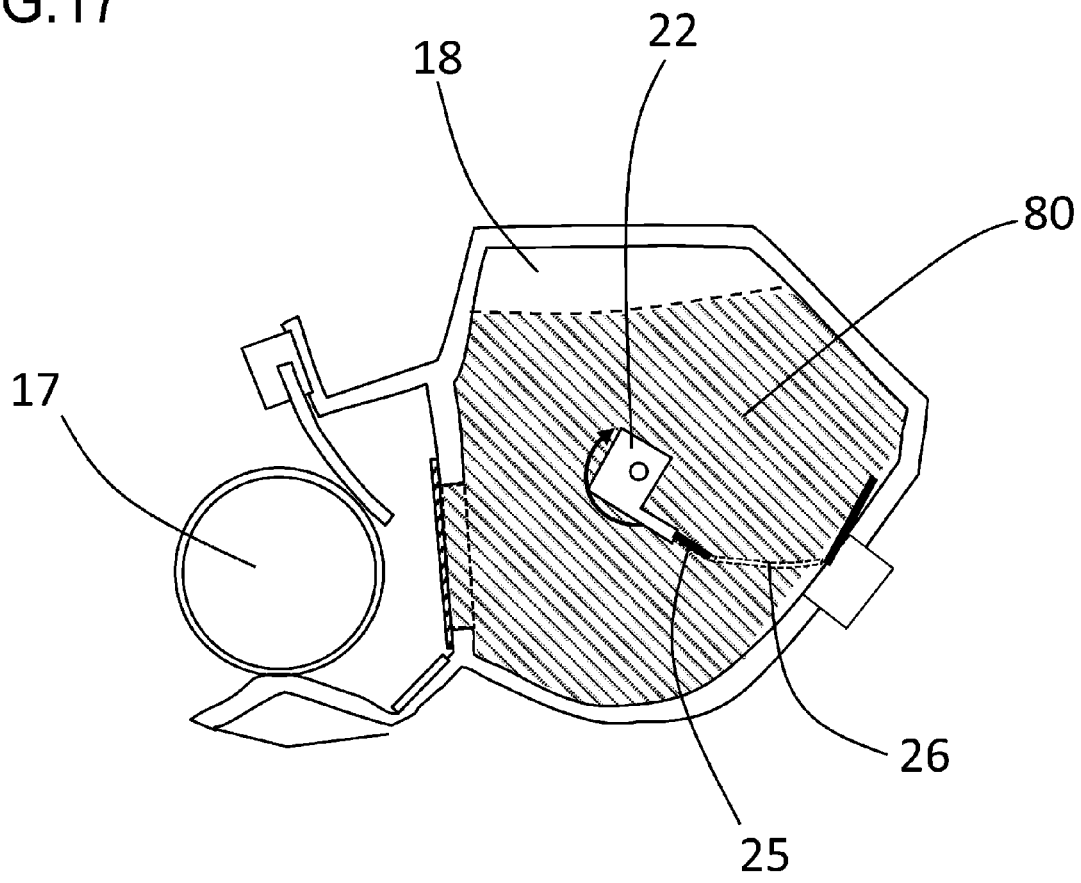
FIG. 17 is a schematic sectional view of a developing device according to another embodiment.

The effect of sufficiently mixing the toner described in Embodiments 1 to 4 is not limited to the above-described lifting system in which the toner is supplied to the developing roller 17 located above the toner accommodation chamber. That is, the developing roller 17 may be provided at substantially the same height as the toner accommodation chamber 18, or a gravity-based configuration in which the developing roller is arranged below the toner accommodation chamber 18 may be used. For example, the configuration shown in FIG. 17 may be used. With such a configuration, the new toner supplied for replenishment in the toner accommodation chamber 18 is likely to be accumulated in the vicinity of the replenishing port. Therefore, by forming the stirring promotion hole 26 specified in the present invention in the sheet member 25 constituting the stirring member, it is possible to mix the toners efficiently.

To summarize the present invention as described above, in Embodiment 1, the problem of suppressing the scumming caused by toner replenishment is resolved by setting the size of the stirring promotion hole in the lateral direction and the positional relationship between the stirring promotion hole and the replenishing port to S1>L>S2. In Embodiment 2, the problem of suppressing the image density unevenness due to the toner supply unevenness in a low-temperature and low-humidity environment is resolved by setting the ratio defined as [the length of the stirring promotion hole in the longitudinal direction]/[the length of the sheet member in the longitudinal direction] to 0.2 or less. In the configurations shown in Embodiments 3 and 4, the stirring capability and the toner supply capability of the stirring member are improved while maintaining the effect of suppressing the scumming demonstrated by the stirring promotion hole, and the noise produced by the stirring member rubbing against the wall surface or the like is reduced.

Embodiment 5

Among the configurations of a developing cartridge (including a developing unit), a process cartridge (including a developing unit and a photosensitive drum), and the like that are detachably attachable (replaceable) with respect to the main body of the image forming apparatus, there is also a configuration as in Japanese Patent Application Publication No. 2011-253203 in which a developer is conveyed by being caused to fly from a lower developer accommodation chamber to an upper developing chamber by elastic deformation (elastic restoring force) of a stirring sheet.

Meanwhile, in order to improve the image forming efficiency, a technique, such as described in Japanese Patent Application Publication No. 2011-253203, in which a replenishing port is provided in a developer accommodation chamber of a cartridge, and the developer is directly supplied for replenishment to the developer accommodation chamber from the outside through the replenishing port has been investigated.

However, in the cartridge described in Japanese Patent Application Publication No. 2011-253203, when a replenishing port is provided in the developer accommodation chamber, the developer inside the developer accommodation chamber may flow back to the replenishing port when conveyed to the developing chamber located at the upper side due to the rotation operation of the stirring sheet arranged in the developer accommodation chamber.

Accordingly, a developing device, a process cartridge, and an image forming apparatus that make it possible to realize a configuration in which the developer can be supplied from the developer accommodation chamber located below to the developing chamber located above, and to suppress the backflow of the developer to the replenishing port provided in the developer accommodation chamber is desired.

The present invention can be embodied as an electrophotographic image forming apparatus (hereinafter may be simply referred to as "image forming apparatus"), or as a process cartridge or a developing device constituting a part of the image forming apparatus.

The image forming apparatus according to the present invention will be described below with reference to the drawings.

The embodiments described below exemplify the present invention, and the scope of the invention is not limited to the dimensions, materials, and shapes of the components described below, or relative positional relationships thereof, unless specifically stated otherwise.

Here, the electrophotographic image forming apparatus in the embodiments described below is an apparatus for forming an image on a recording medium using an electrophotographic image forming method. Examples of the electrophotographic image forming apparatus include an electrophotographic copying machine, an electrophotographic printer (for example, a laser beam printer, an LED printer, etc.), a facsimile machine, a word processor, and the like.

Further, in the embodiments described below, the developing device used in the image forming apparatus has at least a developing unit. Furthermore, the developing device can be made into a cartridge and can be detachably attached to the main body of the electrophotographic image forming apparatus. In addition, the developing device may include a toner cartridge that can be detachably attached to the frame of the developing device and that can supply a toner for replenishment to the developing device.

Further, the process cartridge constituting a part of the image forming apparatus is meant to be obtained by integrally forming a charging member, a developing unit or a cleaning member and an electrophotographic photosensitive drum into a cartridge, and the cartridge can be detachably attached to the main body of the electrophotographic image forming apparatus. Further, at least one of the charging member, the developing unit, and the cleaning member and the electrophotographic photosensitive drum are integrally made into a cartridge so as to be detachably attachable to the main body of the electrophotographic image forming apparatus. Furthermore, at least the developing unit and the electrophotographic photosensitive drum are integrally made into a cartridge so as to be detachably attachable to the main body of the electrophotographic image forming apparatus. The process cartridge can be also fixedly attached to the image forming apparatus and used.

Overall Configuration of Image Forming Apparatus 2100

The overall configuration of the image forming apparatus 2100 according to the present embodiment will be described with reference to FIG. 19.

Figure 19:
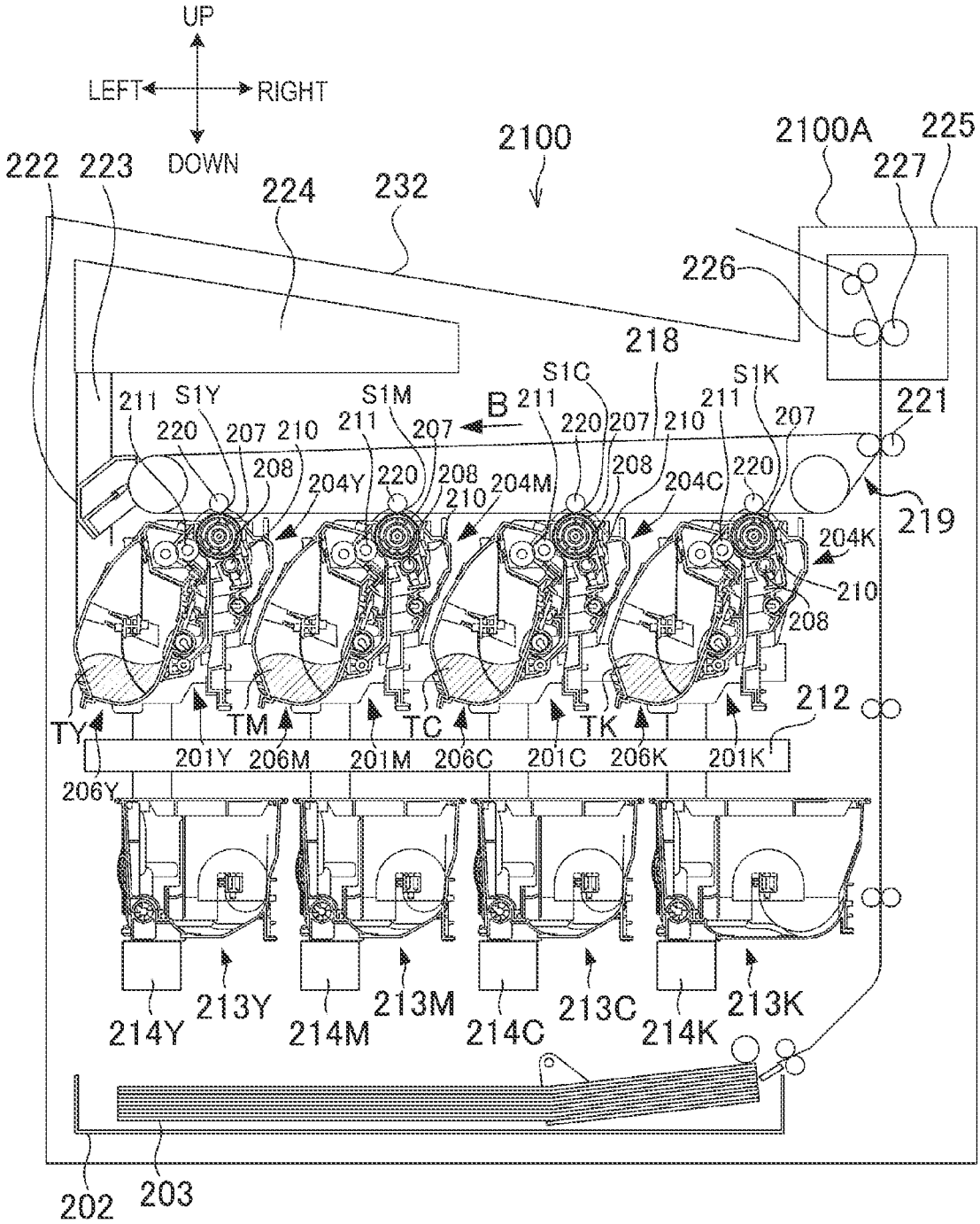
FIG. 19 is a sectional conceptual drawing of an image forming apparatus according to Embodiment 5.

FIG. 19 is a sectional conceptual drawing of the image forming apparatus according to the present embodiment.

In the present embodiment, a process cartridge 201 and a toner cartridge 213 are detachably attachable to an apparatus main body 2100A of the image forming apparatus 2100.

In the present embodiment, the configurations and operations of the first to fourth image forming units are substantially the same except that the colors of the images to be formed are different. Therefore, in the following description, the subscripts Y to K will be omitted and a general description will be given unless the image forming units need to be particularly distinguished from each other.

The first to fourth process cartridges 201 are arranged side by side in the horizontal direction. Each process cartridge 201 is formed of a cleaning unit 204 and a developing unit 206 (developing device).

The cleaning unit 204 includes a photosensitive drum 207 (image bearing member), a charging roller 208 as a charging member for uniformly charging the surface of the photosensitive drum 207, and a cleaning blade 210 as a cleaning unit.

The developing unit 206 accommodates a developing roller 211 (developer bearing member) and a developer T (hereinafter, toner), and has a developing portion for developing an electrostatic latent image on the photosensitive drum 207.

The cleaning unit 204 and the developing unit 206 are swingably supported by each other. Yellow (Y), magenta (M), cyan (C), and black (K) toners are accommodated in the developing unit 206 in the first to fourth process cartridges 201Y, 201M, 201C, and 201K, respectively.

The process cartridge 201 is detachably attachable to the image forming apparatus 2100 through a mounting member such as a mounting guide (not shown) and a positioning member (not shown) provided at the image forming apparatus 2100.

A scanner unit 212 for forming an electrostatic latent image is arranged below the process cartridge 201. Further, in the image forming apparatus, a waste toner conveying unit 223 is arranged behind the process cartridge 201 (downstream in the attachment/detachment direction of the process cartridge 201).

The first to fourth toner cartridges 213 are arranged side by side horizontally below the process cartridge 201 in the order corresponding to the color of the toner contained in each process cartridge 201.

That is, the first to fourth toner cartridges 213Y, 213M, 213C, and 213K accommodate yellow (Y) magenta (M), cyan (C), and black (K) toners, respectively. Each toner cartridge 213 supplied the toner for replenishment to the process cartridge 201 including the toner of the same color.

The replenishment operation of the toner cartridge 213 is performed when a remaining amount detection unit (not shown) provided in the apparatus main body 2100A of the image forming apparatus 2100 detects that the remaining toner amount in the process cartridge 201 is insufficient. The toner cartridge 213 is detachably attachable to the image forming apparatus 2100 through a mounting guide (not shown), a positioning member (not shown), and the like provided at the image forming apparatus 2100. The process cartridge 201 and the toner cartridge 213 will be described in detail hereinbelow.

First to fourth toner conveying devices 214 are arranged below the toner cartridges 213 correspondingly to the respective toner cartridges 213. Each toner conveying device 214 conveys the toner received from the respective toner cartridge 213 upward and supplies the toner to the respective developing unit 206.

An intermediate transfer unit 219 is provided as an intermediate transfer member above the process cartridge 201. The intermediate transfer unit 219 is arranged substantially horizontally with the primary transfer portion S1 side facing downward.

The intermediate transfer belt 218 facing each photosensitive drum 207 is a rotatable endless belt and is stretched around a plurality of stretching rollers. On the inner surface of the intermediate transfer belt 218, a primary transfer roller 220 (transfer member) as a primary transfer member is arranged at a position where the primary transfer roller and the photosensitive drum 207 form a primary transfer portion S1 with the intermediate transfer belt 218 interposed therebetween.

The secondary transfer roller 221 which is a secondary transfer member is in contact with the intermediate transfer belt 218, and forms together with the roller on the opposite side a secondary transfer portion S2 with the intermediate transfer belt 218 interposed therebetween. Further, in the left-right direction (the direction in which the secondary transfer portion S2 and the intermediate transfer belt are stretched), an intermediate transfer belt cleaning unit 222 is arranged on the side opposite to the secondary transfer portion S2.

A fixing unit 225 is arranged further above the intermediate transfer unit 219. The fixing unit is configured of a heating unit 226 and a pressure roller 227 that is in pressure contact with the heating unit. Further, a discharge tray 232 is arranged on the upper surface of the apparatus main body 2100A, and a waste toner collecting container 224 is arranged between a discharge tray 232 and the intermediate transfer unit. In addition, a paper feed tray 202 for accommodating a recording material 203 is arranged at the lowermost portion of the apparatus main body.

Image Forming Process

Next, an image forming operation in the image forming apparatus 2100 will be described with reference to FIGS. 19 and 20.

Figure 20:
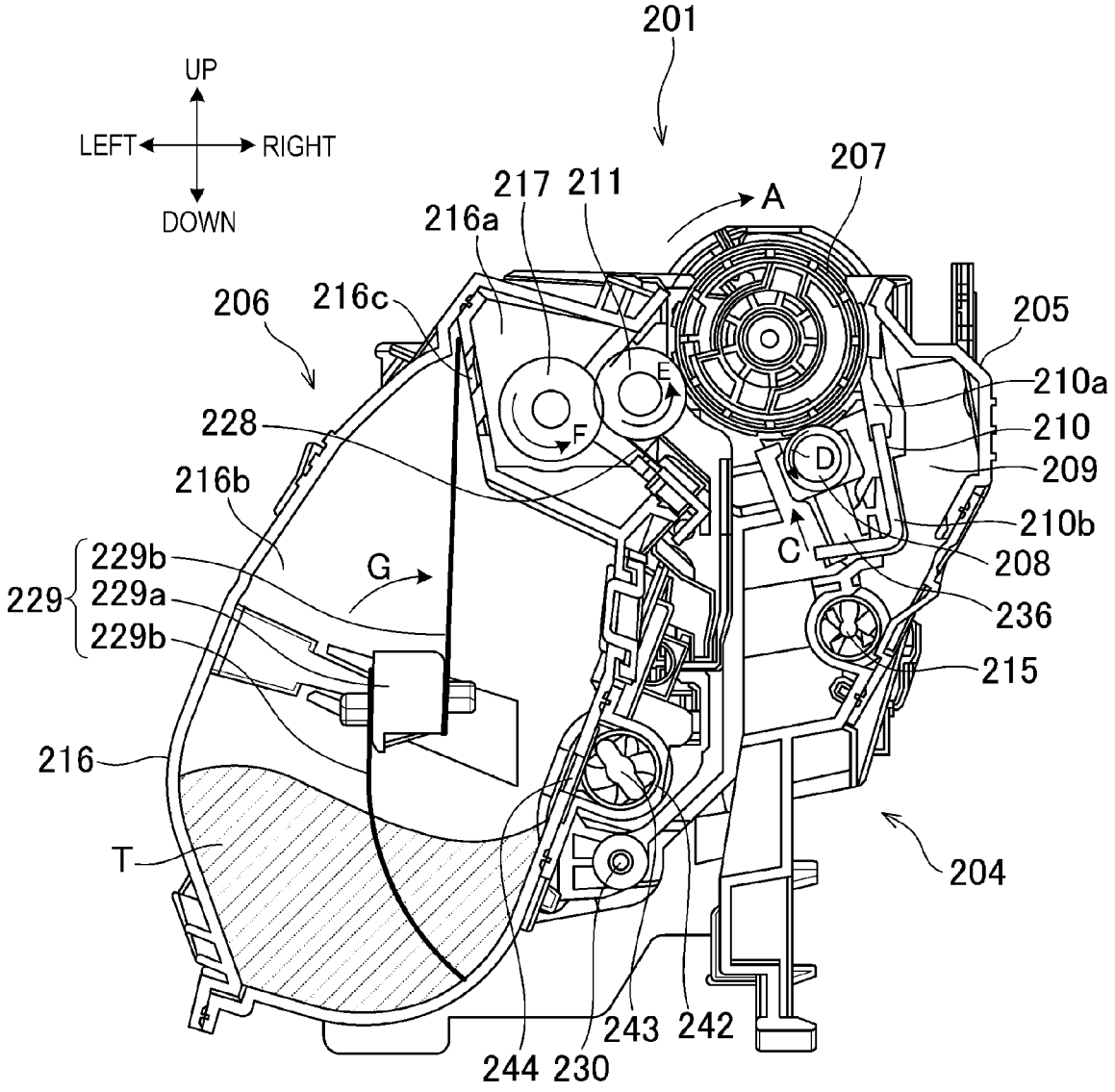
FIG. 20 is a sectional conceptual drawing of a process cartridge used in the image forming apparatus according to Embodiment 5.

FIG. 20 is a sectional conceptual drawing of a process cartridge used in the image forming apparatus according to the present embodiment.

During image formation, the photosensitive drum 207 is rotationally driven at a predetermined speed in the direction of arrow A in FIG. 20. The intermediate transfer belt 218 is rotationally driven in the direction of arrow B (forward direction of rotation of the photosensitive drum 207).

First, the surface of the photosensitive drum 207 is uniformly charged by the charging roller 208. Next, the surface of the photosensitive drum 207 is scanned and exposed by a laser beam emitted from the scanner unit 212, so that an electrostatic latent image based on image information is formed on the photosensitive drum 207.

The electrostatic latent image formed on the photosensitive drum 207 is developed as a toner image by the developing unit 206. At this time, the developing unit 206 is pressurized by a developing pressure unit (not shown) provided in the apparatus main body 2100A. Then, the toner image formed on the photosensitive drum 207 is primarily transferred onto the intermediate transfer belt 218 by the primary transfer roller 220.

For example, when forming a full-color image, the above-described process is sequentially performed in the image forming units S1Y to S1K that are the first to fourth primary transfer units, so that the toner images of the respective colors are sequentially superimposed on the intermediate transfer belt 218.

Meanwhile, the recording material 203 accommodated in the paper feed tray 202 is fed at a predetermined control timing and is conveyed to the secondary transfer portion S2 in synchronization with the movement of the intermediate transfer belt 218. Then, four-color toner images on the intermediate transfer belt 218 are collectively secondarily transferred onto the recording material 203 by the secondary transfer roller 221 that is in contact with the intermediate transfer belt 218 with the recording material interposed therebetween 203.

After that, the recording material 203 to which the toner image has been transferred is conveyed to the fixing unit 225. The recording material 203 is heated and pressed in the fixing unit 225, so that the toner image is fixed to the recording material 203. Thereafter, the recording material 203 subjected to fixing is conveyed to the discharge tray 232 to complete the image forming operation.

Further, the primary untransferred toner (waste toner) remaining on the photosensitive drum 207 after the primary transfer process is removed by the cleaning blade 210. The secondary untransferred toner (waste toner) remaining on the intermediate transfer belt 218 after the secondary transfer process is removed by the intermediate transfer belt cleaning unit 222.

The waste toner removed by the cleaning blade 210 and the intermediate transfer belt cleaning unit 222 is transported by the waste toner conveying unit 223 provided in the apparatus main body 2100A and accumulated in the waste toner collecting container 224. The image forming apparatus 2100 is also capable of forming a single-color or multi-color image by using a desired single image forming unit or only some (not all) image forming units.

Process Cartridge

Next, the overall configuration of the process cartridge 201 mounted on the image forming apparatus 2100 according to the present embodiment will be described with reference to FIGS. 18A, 18B, 20, 21, 22A, and 22B.

Figure 18A:
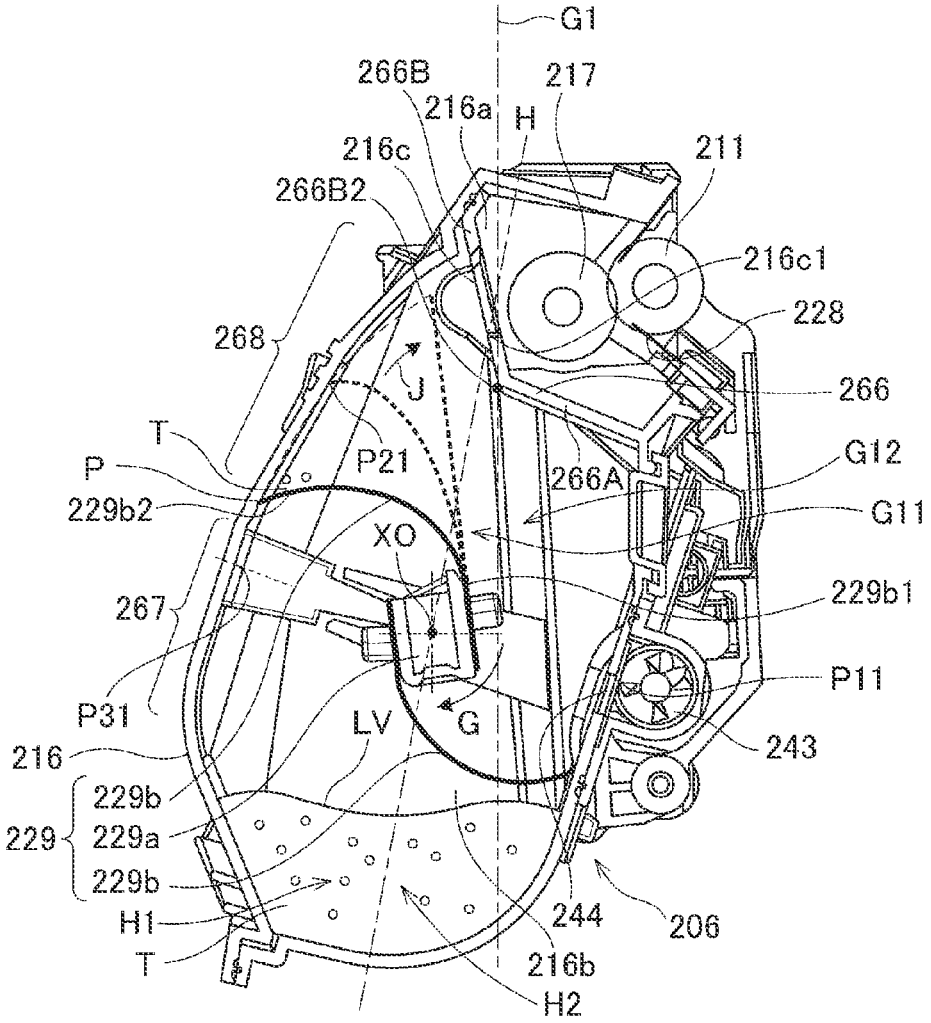
FIG. 18A is a sectional conceptual drawing of a developing unit used in an image forming apparatus according to Embodiment 5.
Figure 18B:
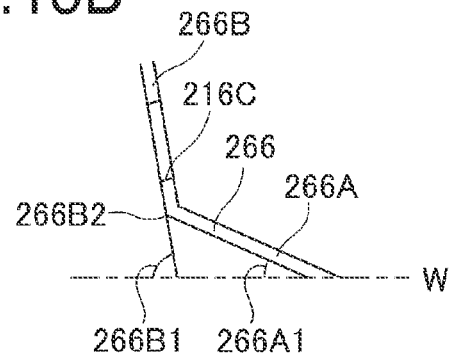
FIG. 18B is an enlarged view of a main portion of the developing unit.

FIG. 18A is a sectional conceptual drawing of a developer unit used in the image forming apparatus according to the present embodiment. FIG. 18B is an enlarged view of a main portion of the developing unit.

Figure 21:
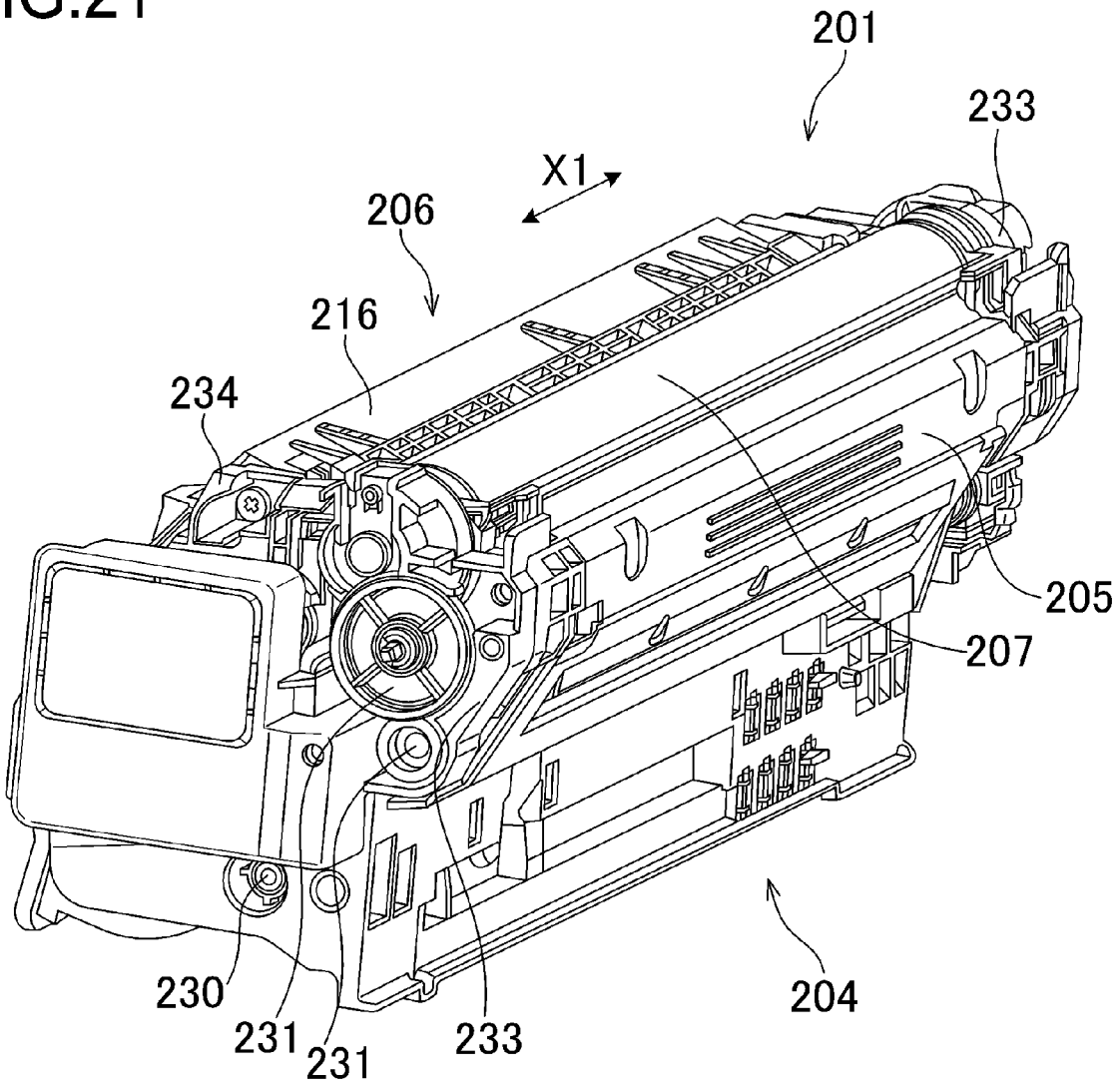
FIG. 21 is a perspective conceptual drawing of the process cartridge according to Embodiment 5 as viewed from above on a non-drive side.

FIG. 21 is a perspective conceptual drawing of the process cartridge according to the present embodiment as viewed from above on the non-drive side. That is, FIG. 21 shows a state of the process cartridge 201 when viewed from the front (upstream side in the process cartridge attachment/detachment direction).

Figure 22A:
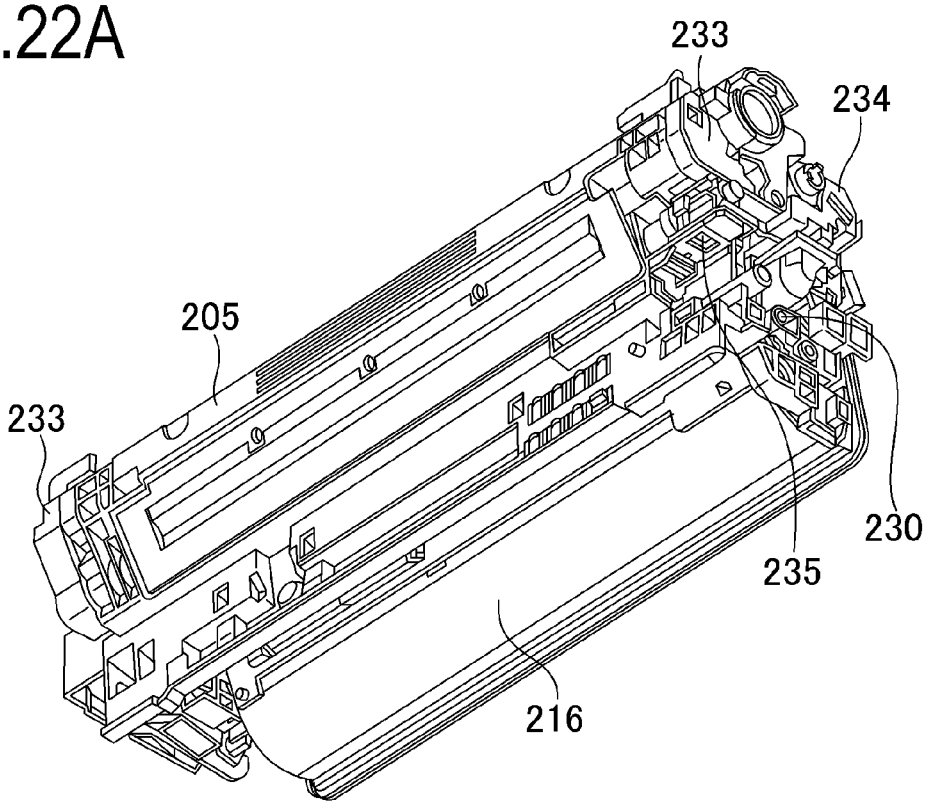
FIG. 22A is a perspective conceptual drawing of the process cartridge according to Embodiment 5 as viewed from below on a drive side.
Figure 22B:
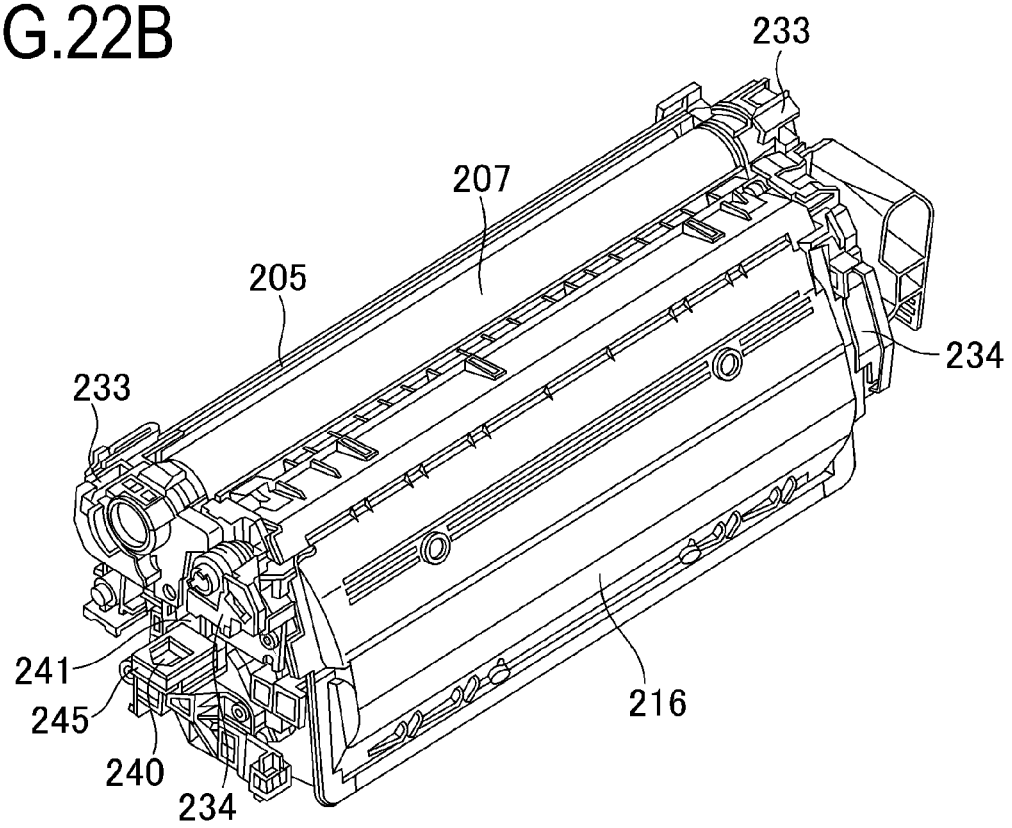
FIG. 22B is a perspective conceptual drawing of the process cartridge as viewed from above on the drive side.

FIG. 22A is a perspective conceptual drawing of the process cartridge according to the present embodiment as viewed from below on the drive side. FIG. 22B is a perspective conceptual drawing of the process cartridge as viewed from above on the drive side. That is, FIG. 22A shows a state of the process cartridge 201 when viewed from the rear (downstream side in the process cartridge attachment/detachment direction).

The process cartridge 201 is formed of the cleaning unit 204 and the developing unit 206. The cleaning unit 204 and the developing unit 206 are connected to be swingable about a rotation support pin 230.

The cleaning unit 204 has a cleaning frame 205 that supports various members inside the cleaning unit 204. Further, in the cleaning unit 204, a waste toner screw 215 extending in a direction parallel to the rotation axis direction of the photosensitive drum 207 is provided in addition to the photosensitive drum 207, the charging roller 208, and the cleaning blade 210.

In the cleaning frame 205, cleaning bearings 233 that rotatably support the photosensitive drum 207 and include a cleaning gear train 231 for transmitting drive from the photosensitive drum to the waste toner screw 215 are provided at both longitudinal ends of the cleaning unit 204.

The charging roller provided in the cleaning unit 204 is biased toward the photosensitive drum 207 in the direction of arrow C by charging roller pressure springs 236 arranged at both ends. The charging roller is provided so as to follow the drive of the photosensitive drum, and when the photosensitive drum 207 is rotationally driven in the direction of arrow A during image formation, the charging roller rotates in the direction of arrow D (forward direction of rotation of the photosensitive drum 207).

The cleaning blade 210 provided in the cleaning unit 204 is configured of an elastic member 210*a* for removing untransferred toner (waste toner) remaining on the surface of the photosensitive drum 207 after the primary transfer, and a support member 210*b* for supporting the elastic member 210*a*. The waste toner removed from the surface of the photosensitive drum 207 by the cleaning blade 210 is accommodated in the waste toner accommodation chamber 209 formed by the cleaning blade 210 and the cleaning frame 205.

The waste toner accommodated in the waste toner accommodation chamber 209 is conveyed toward the rear of the image forming apparatus 2100 (downstream in the attachment/detachment direction of the process cartridge 201) by the waste toner screw 215 installed in the waste toner accommodation chamber 209. The conveyed waste toner is discharged from a waste toner discharge unit 235 and is transferred to the waste toner conveying unit 223 of the image forming apparatus 2100.

The developing unit 206 has a developing frame 216 that supports various members in the developing unit 206. The developing frame 216 is divided into a developing chamber 216*a* in which the developing roller 211 and a supply roller 217 (supply member) are installed, and a toner accommodation chamber 216*b* (developer accommodation chamber) in which the toner is accommodated and a stirring member 229 (conveying member) is provided.

The developing roller 211, the supply roller 217, and a developing blade 228 are provided in the developing chamber 216*a*. The developing roller 211 bears the toner, rotates in the direction of arrow E during image formation, and contacts the photosensitive drum 207 to convey the toner to the photosensitive drum 207.

Further, the developing roller 211 is rotatably supported on the developing frame 216 by developing bearing units 234 at both ends in the longitudinal direction (rotational axis direction) thereof. The supply roller 217 is rotatably supported on the developing frame 216 by the developing bearing units 234 to be capable of rotating while being in contact with the developing roller 211, and rotates in the arrow F direction during image formation. Further, the developing blade 228 as a layer thickness regulating member that regulates the thickness of the toner layer formed on the developing roller 211 is arranged so as to contact the surface of the developing roller 211.

The toner accommodation chamber 216*b* is provided with the stirring member 229 for stirring the accommodated toner T and for transporting the toner to the supply roller 217 through a developing chamber communication port 216*c* (communication port). The stirring member 229 has a rotating shaft 229*a* (rotating shaft portion) parallel to the rotating shaft axis direction of the developing roller 211, and a stirring sheet 229*b* as a conveying member which is a flexible sheet. One end (229*b*1) of the stirring sheet 229*b* is attached to the rotating shaft portion 229*a*, and the other end (229*b*2) of the stirring sheet 229*b* is a free end. The rotating shaft portion 229*a* rotates and the stirring sheet 229*b* rotates in the direction of arrow G (rotation direction), whereby the stirring sheet 229*b* stirs the toner.

The developing unit 206 has the developing chamber communication port 216*c* that communicates the developing chamber 216*a* and the toner accommodation chamber 216*b*. In the present example, the developing chamber 216*a* is located above the toner accommodation chamber 216*b* in the posture in which the developing unit 206 is normally used (posture at the time of use). The toner in the toner accommodation chamber 216*b* lifted by the stirring member 229 is supplied to the developing chamber 216*a* through the developing chamber communication port 216*c*.

Further, the developing unit 206 is provided with a receiving port 240 at one end on the downstream side in the attachment/detachment direction. A receiving port sealing member 245 and a toner receiving port shutter 241 movable in the front-rear direction are arranged above the toner receiving port 240. When the process cartridge 201 is not mounted on the image forming apparatus 2100, the toner receiving port 240 is closed by a receiving port shutter 241. The receiving port shutter 241 is configured to be opened by being urged by the image forming apparatus 2100 in conjunction with the attachment/detachment operation of the process cartridge 201.

A receiving and conveying path 242 is provided so as to communicate with the toner receiving port 240, and a receiving and conveying screw 243 is arranged inside the receiving and conveying path. Further, an accommodation chamber communication port 244 (replenishing port) for supplying the toner to the toner accommodation chamber 216*b* is provided near the longitudinal center of the developing unit 206, and communicates the receiving and conveying path 242 with the toner accommodation chamber 216*b*. The receiving and conveying screw 243 extends parallel to the rotation axis direction of the developing roller 211 and the supply roller 217, and conveys the toner received from the toner receiving port 240 to the toner accommodation chamber 216*b* through the accommodation chamber communication port 244.

As described above, in the present embodiment, the developing unit includes the developing frame (216) and the conveying member 229.

The developing frame (216) includes the developing chamber (216*a*) in which the developer bearing member (211) bearing the developer is accommodated, the developer accommodation chamber (216*b*) that is located below the developing chamber in the posture at the time of use and accommodates the developer, and the communication port (216*c*) that communicates the developing chamber with the developer accommodation chamber.

The conveying member 229 is provided in the developer accommodation chamber and conveys the developer accommodated in the developer accommodation chamber to the developing chamber. The conveying member includes a rotatable rotating shaft portion (229*a*) and an elastically deformable sheet portion (229*b*) that has one end (229*b*1) fixed to the rotating shaft portion and the other end (229*b*2) free.

The developer accommodation chamber is provided with a deforming portion (267), and by coming into contact with the free end of the sheet portion that rotates with the rotation operation of the rotating shaft portion, the deforming portion bends and elastically deforms the sheet portion.

Further, a restoring portion (268) is provided in the developer accommodation chamber. The restoring portion (268) is provided in the developer accommodation chamber at a position upstream of the communication port and downstream of the deforming portion in the rotation direction (G) of the rotating shaft portion. The restoring portion can release the sheet portion elastically deformed by the deforming portion to restore the sheet portion, thereby causing the developer carried on the sheet portion to fly toward the communication port.

Also, the developer accommodation chamber is provided with a replenishing port (244) for replenishing the developer from the outside to the developer accommodation chamber.

When viewed along the rotation axis direction (X1) of the rotating shaft portion in the posture at the time of use, the rotation center (X0) of the rotating shaft portion and the downstream end (216*c*1) of the communication port in the rotation direction of the rotating shaft portion are assumed to be connected by a virtual straight line (H). At this time, the communication port and the replenishing port are arranged on different sides (H1, H2) of the straight line.

The restoring portion is not provided on the one side (H2) where the replenishing port is present, but is provided on the other side (H1) where the communication port is present.

Toner Cartridge

Next, the overall configuration of the toner cartridge 213 mounted on the image forming apparatus 2100 according to the present embodiment will be described with reference to FIGS. 23A and 23B.

Figure 23A:
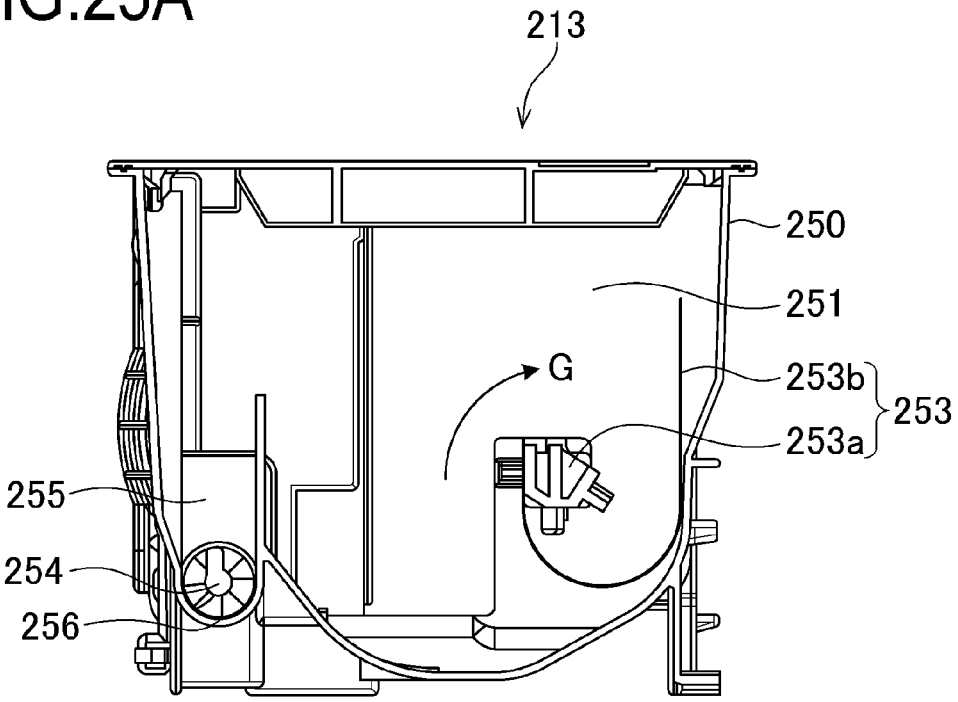
FIG. 23A is a sectional conceptual drawing of toner cartridges (Y•M•C) used in the image forming apparatus according to Embodiment 5 at an A-A position shown in FIGS. 25A and 25B.
Figure 23B:
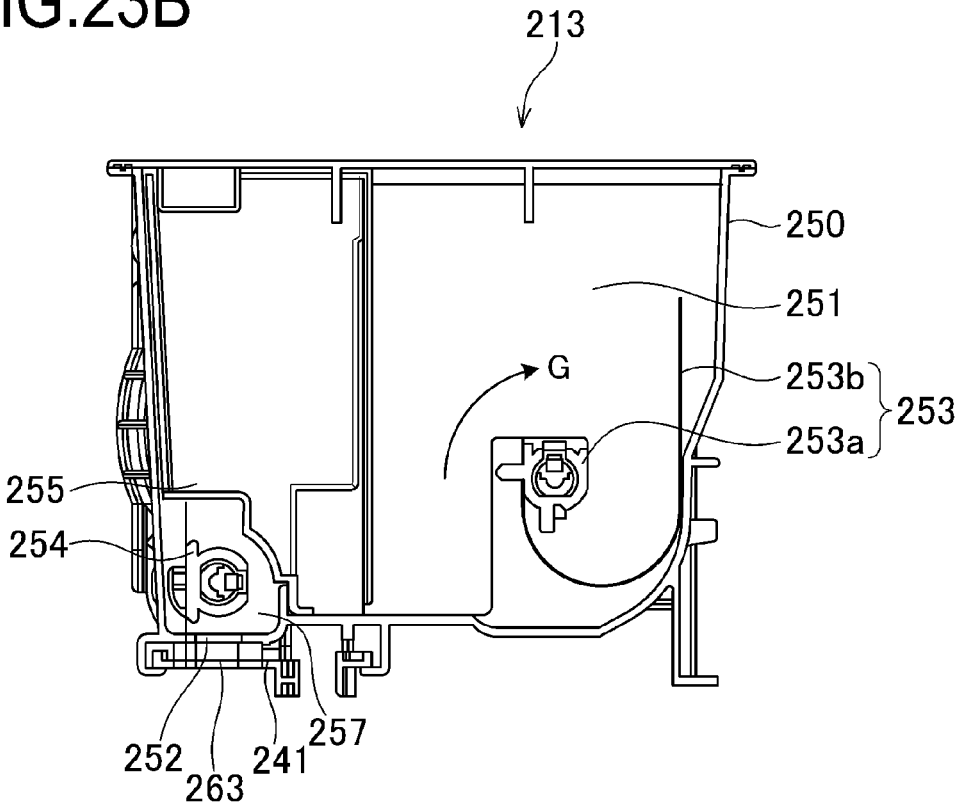
FIG. 23B is a sectional conceptual drawing of the toner cartridges (Y•M•C) at a position B-B shown in FIGS. 25A and 25B.

FIG. 23A is a sectional conceptual drawing of the toner cartridge (Y•M•C) used in the image forming apparatus according to the present embodiment, the view being taken at a position A-A shown in FIGS. 25A and 25B described later. FIG. 23B is a sectional conceptual drawing of the toner cartridge (Y•M•C) at the position B-B shown in FIGS. 25A and 25B.

That is, FIG. 23A shows a cross section of the central portion of the toner cartridge (213Y, 213M, 213C) in the longitudinal direction (front-back direction). Further, FIG. 23B shows a cross-sectional view of the toner cartridge (213Y, 213M, 213C) at the replenishing frame opening 252 on the rear side in the longitudinal direction (front-back direction).

Figure 24A:
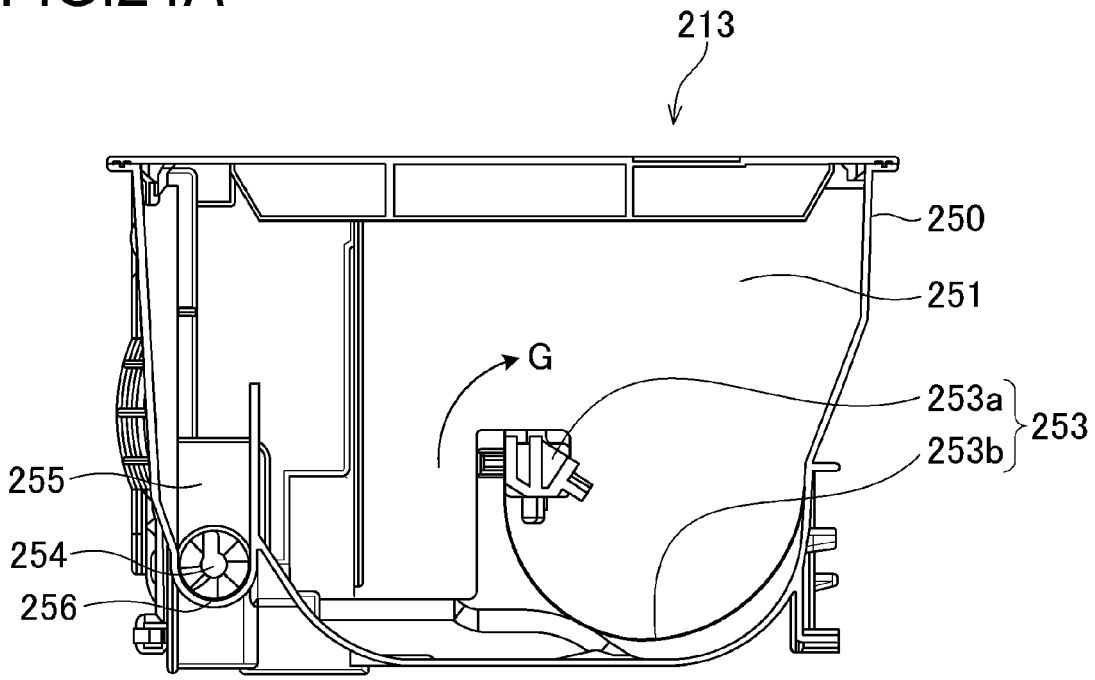
FIG. 24A is a sectional conceptual drawing of a toner cartridge (K) used in the image forming apparatus according to Embodiment 5 at an A-A position shown in FIGS. 25A and 25B.
Figure 24B:
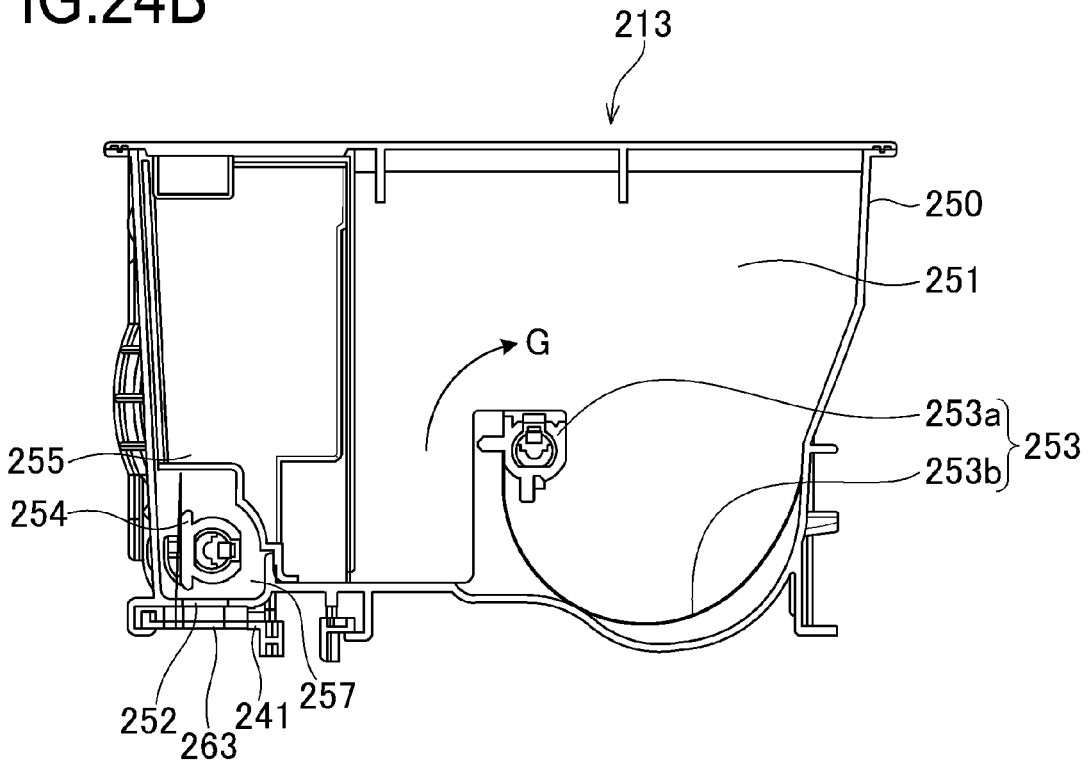
FIG. 24B is a sectional conceptual drawing of the toner cartridge (K) at a position B-B shown in FIGS. 25A and 25B.

FIG. 24A is a sectional conceptual drawing of the toner cartridge (K) used in the image forming apparatus according to the present embodiment, the view being taken at a position A-A shown in FIGS. 25A and 25B described later. FIG. 24B is a sectional conceptual drawing of the toner cartridge (K) at the position B-B shown in FIGS. 25A and 25B.

That is, FIG. 24A shows a cross section of the central portion of the toner cartridge (213K) in the longitudinal direction (front-back direction). Further, FIG. 24B shows a cross section of the toner cartridge (213K) at the replenishing frame opening 252 on the rear side in the longitudinal direction (front-rear direction).

Figure 25A:
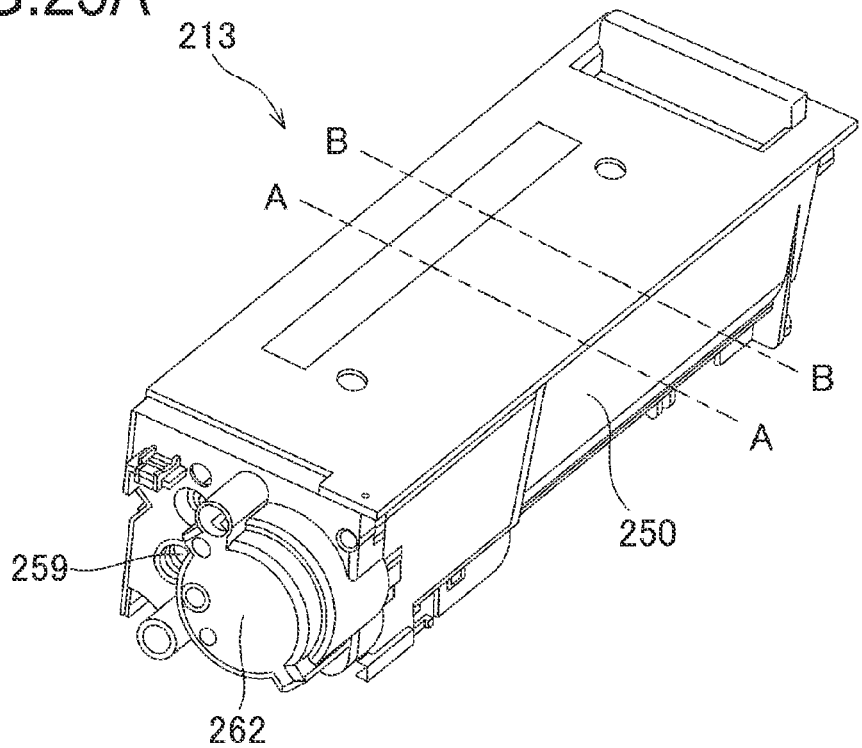
FIG. 25A is a perspective conceptual drawing of the toner cartridges (Y•M•C•K) of Embodiment 5 as viewed from above on the drive side.
Figure 25B:
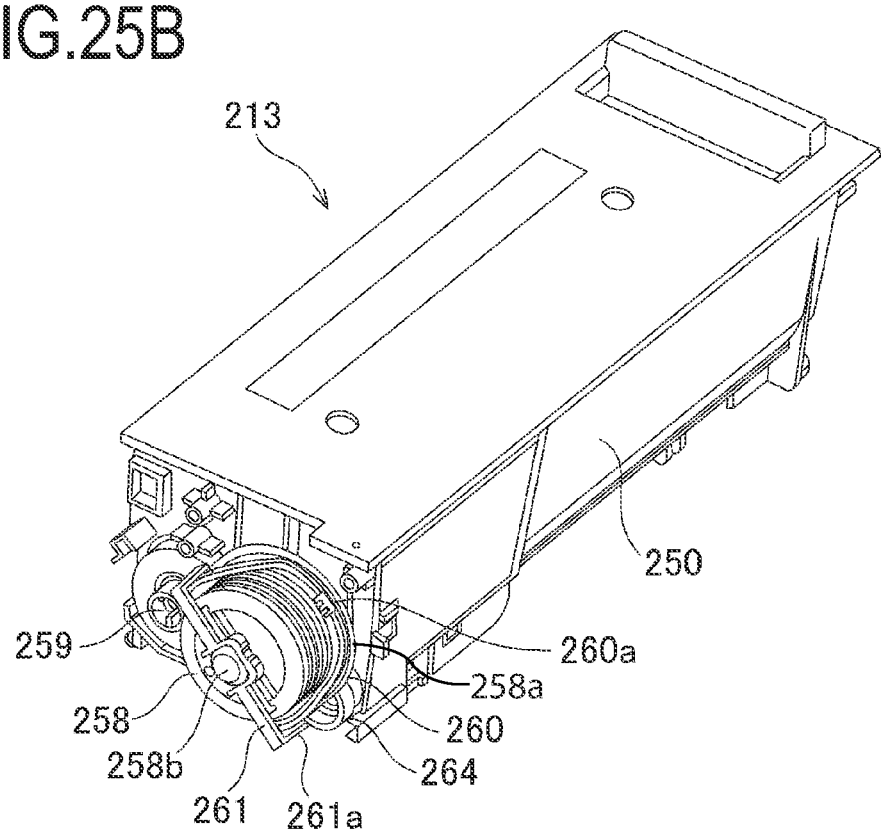
FIG. 25B is a perspective conceptual drawing of the toner cartridges (Y•M•C•K) from which a side cover has been removed.

FIGS. 25A and 25B is a perspective conceptual drawing of the toner cartridge (Y•M•C•K) according to the present embodiment as viewed from above on the drive side. FIG. 25B is a perspective conceptual drawing of the toner cartridge (Y•M•C•K) with the side cover removed.

That is, FIG. 25A shows a state of the toner cartridge (213Y, 213M, 213C) when viewed from the rear. FIG. 25B shows a state in which a side cover 262 is removed when the toner cartridge (213Y, 213M, 213C) is viewed from the rear.

The toner cartridge 213 includes a replenishing frame 250 that supports various members in the toner cartridge 213, and a replenishing toner accommodation chamber 251 that accommodates the toner therein. In addition, in a normally used posture (posture at the time of use), a replenishing frame opening 252 is provided on the lower side.

A replenishing toner stirring member 253, a replenishing toner conveying screw 254, and a partition member 255 are provided inside the replenishing toner accommodation chamber 251. In the present embodiment, the black (K) toner cartridge (213K) is larger in the width direction (left-right direction) than the color (Y•M•C) toner cartridges (213Y, 213M, 213C).

The replenishing toner stirring member 253 is arranged parallel to the longitudinal direction of the toner cartridge 213, and is rotatably supported by the replenishing frame 250. Further, the replenishing toner stirring member 253 has a rotating shaft 253*a* and a replenishing toner stirring sheet 253*b* as a conveying member which is a flexible sheet. One end of the replenishing toner stirring sheet 253*b* is attached to the rotating shaft 253*a*, and the other end of the replenishing toner stirring sheet 253*b* is a free end. When the rotating shaft 253*a* rotates and the replenishing toner stirring sheet 253*b* rotates in the direction of arrow G, the toner is stirred by the replenishing toner stirring sheet 253*b*, and the toner is sent to the replenishing toner conveying screw 254.

The replenishing toner conveying screw 254 is arranged parallel to the rotation axis of the replenishing toner stirring member, and is rotatably supported by the replenishing frame 250. By rotating the replenishing toner conveying screw 254, the toner in the replenishing toner accommodation chamber is conveyed from the front side to the rear side (from the upstream side to the downstream side in the toner cartridge attachment-detachment direction). That is, the toner is conveyed toward the toner replenishing frame opening 252.

The partition member 255 forms a tunnel portion 256 together with the replenishing frame 250. The tunnel portion 256 is formed corresponding to the outer diameter of the replenishing toner conveying screw 254, and has a role of scraping off the toner conveyed by the replenishing toner conveying screw 254 and conveying the toner in a fixed amount. Similarly, the partition member 255 and the replenishing frame 250 form a toner discharge chamber 257.

The replenishing frame opening 252 is provided in the toner discharge chamber 257. Further, a pump 258 including an expandable and contractible bellows portion 258*a* is provided in communication with the inside. The pump 258 can be expanded and contracted by a drive train described hereinbelow and the internal volume thereof can be changed. As the pump 258 expands and contracts, the internal pressures of the replenishing toner accommodation chamber 251 and the toner discharge chamber 257 change, and the toner can be stably discharged by suction and discharge from the replenishing frame opening 252.

The drive train is arranged on the rear side of the toner cartridge 213. A drive input gear 259 receives rotational drive from the apparatus main body 2100A and transmits the rotation to a cam gear 260. The cam gear 260 is provided with a cam groove 260*a*, and a link protrusion 261*a* of a link mechanism 261 is engaged with the cam groove 260*a*.

The link mechanism 261 is supported by the side cover 262 so as to be movable in the front-rear direction. The link mechanism 261 reciprocates in the front-rear direction as the cam gear 260 rotates and the link protrusion 261*a* alternately passes the peaks and valleys of the cam groove 260*a*.

The link mechanism 261 is connected to a coupling portion 258*b* of the pump 258, and the pump 258 interlocks with the link mechanism 261 so that the coupling portion 258*b* reciprocates. As the bellows portion 258*a* of the pump 258 expands and contracts, the internal volume of the pump 258 changes, and as a result, the internal pressures of the replenishing toner accommodation chamber 251 and the toner discharge chamber 257 change.

Next, a screw gear 264 is provided at the end of the replenishing toner conveying screw 254, and the screw gear 264 receives the rotational drive from the cam gear 260 and rotates the replenishing toner conveying screw 254.

Further, in the toner discharge chamber 257, in a normally used posture (posture at the time of use), a replenishing port shutter 241 provided with the replenishing frame opening 252 and a replenishment port 263 on the lower surface is supported by the replenishing frame 250 so as to be movable in the front-rear direction. The replenishing frame opening 252 is closed by the replenishing port shutter 241 when the toner cartridge 213 is not mounted on the image forming apparatus 2100.

The replenishing port shutter 241 is configured to be interlocked with the attachment/detachment operation of the toner cartridge 213 and to move to a predetermined position by being urged by the image forming apparatus 2100. When the replenishing port shutter 241 is mounted on the image forming apparatus 2100, the replenishing frame opening 252 and the replenishment port 263 communicate with each other, and the toner can be discharged from the toner cartridge 213.

Toner Conveying Configuration

Next, the toner conveying configuration in the developing unit 206 will be described in detail with reference to FIGS. 18A and 18B.

FIG. 18A shows a toner conveyance state. Further, FIG. 18B shows the configuration near a developer chamber communication port.

In the present embodiment, in the configuration of the developing unit 206, the terms indicating directions such as upper, lower, vertical, and horizontal indicate the directions when viewed in the normal usage state thereof unless otherwise specified. That is, the normal usage state of the developing unit 206 is a state in which the developing unit 206 is properly mounted on the properly arranged apparatus main body 2100A of the image forming apparatus and can be used for the image forming operation.

As shown in FIG. 18A, the developing unit 206 has the developing chamber 216*a* and the toner accommodation chamber 216*b*. The developing roller 211, the supply roller 217, the developing blade 228, and the like are accommodated in the developing chamber 216*a*. The toner accommodation chamber 216*b* is provided with a stirring member 229 (conveying member) that accommodates the toner supplied to the developing chamber 216*a* and supplies the toner to the developing chamber 216*a*.

The toner accommodation chamber 216*b* is arranged vertically below the developing chamber 216*a*. Therefore, the toner is conveyed from the toner accommodation chamber 216*b* to the developing chamber 216*a* against the gravity.

As described above, when the stirring member 229 conveys the toner from the toner accommodation chamber 216*b* to the developing chamber 216*a* against the gravity, the toner is conveyed from the toner cartridge to the replenishing port (the accommodation chamber communication port 244) for replenishing the toner. As a result, toner clogging occurs in the accommodation chamber communication port 244, which easily leads to improper supply of toner from the receiving and conveying screw 243 to the toner accommodation chamber 216*b*.

Therefore, the object of the present embodiment is to prevent the toner, which is conveyed from the toner accommodation chamber 216*b* to the developing chamber 216*a*, from flowing back to the accommodation chamber communication port 244 when the toner is conveyed against the gravity.

The developing unit 206 has the developing chamber 216*a* and the toner accommodation chamber 216*b* formed in the developing frame 216. The developing roller 211 and the supply roller 217 are provided in the developing chamber 216*a*. The toner accommodation chamber 216*b* is arranged below the developing chamber 216*a*. Here, the toner accommodation chamber 216*b* accommodates the toner to be supplied to the developing chamber 216*a*.

A partition 266 (partitioning portion) having a developing chamber communication port 216*c* for the passage of toner is provided between the developing chamber 216*a* and the toner accommodation chamber 216*b*. Here, the developing chamber communication port 216*c* is provided above the toner accommodation chamber 216*b*. The elastic stirring member 229 for supplying the toner to the developing chamber 216*a* is rotatably provided in the toner accommodation chamber 216*b*.

Further, the toner accommodation chamber 216*b* is provided with the deforming portion 267, which is in contact with the stirring sheet 229*b*, below the developing chamber communication port 216*c*. By rotating, the stirring sheet 229*b* comes into contact with the deforming portion 267. The stirring sheet 229*b* thus receives a force from the deforming portion 267. As a result, the stirring sheet 229*b* is deformed against the elastic force of the stirring sheet 229*b*.

Further, the stirring sheet 229*b* rotates while being in contact with the deforming portion 267, so that the stirring sheet conveys the toner borne on the surface on the downstream side in the rotation direction thereof. In the present embodiment, the deforming portion 267 refers to a portion of the inner wall of the toner accommodation chamber 216*b* from below the developing chamber communication port 216*c* to a point P where the stirring sheet 229*b* is separated (only a portion is shown in FIG. 18A).

Further, the toner accommodation chamber 216*b* is also provided with a restoring portion 268 on the downstream side of the deforming portion 267 in the rotation direction of the stirring member 229 and on the upstream side of the developing chamber communication port 216*c*. Here, the restoring portion 268 is a portion for releasing the contact between the stirring sheet 229*b* and the inner wall of the toner accommodation chamber 216*b*. In the present example, the restoring portion 268 refers to a portion of the inner wall of the toner accommodation chamber 216*b* from the point P position to the developing chamber communication port 216*c*. Further, the restoring portion 268 is arranged above the horizontal plane including the rotation axis of the stirring member 229.

Therefore, when the stirring member 229 rotates in the direction of arrow G, the tip on the free end side (the inner wall side of the toner accommodation chamber 216*b*) of the stirring sheet 229*b* passes the deforming portion 267, and then the contact between the stirring sheet 229*b* and the inner wall of the toner accommodation chamber 216*b* is released. Accordingly, the stirring sheet 229*b* is released from the deformed state by the deforming portion 267, and is restored to the natural state (original shape) by the elastic restoring force of the stirring sheet 229*b*.

Due to the shape change of the stirring sheet 229*b* in the restoration direction (direction of arrow J), the toner borne and conveyed on the stirring sheet 229*b* is conveyed toward the developing chamber communication port 216*c* against the gravity. The developing chamber communication port 216*c* is located downstream of the restoring unit 268 in the rotation direction of the stirring member 229.

Positional Relationship of Accommodation Chamber Communication Port

Next, the positional relationship of the accommodation chamber communication port 244 in the developing unit 206 will be described in detail with reference to FIGS. 18A and 26.

FIGS. 26A to 26D are conceptual drawings showing the toner conveyance state in the developing unit in the present embodiment. In the configuration of the present embodiment, the toner is conveyed in the order of FIGS. 26A to 26D.

Further, as shown in FIG. 18A, when viewed along the rotation axis direction X1, the rotation center X0 of the stirring member 229 and the end (216*c*1) (downstream end) of the developing chamber communication port 216*c* on the downstream side of the stirring member 229 in the rotation direction G can be connected by a (virtual) straight line H. In the present embodiment, when the straight line H is taken as a reference, the restoring portion 268 is provided on the other side (H1) where the developing chamber communication port 216*c* is present.

Figure 26A:
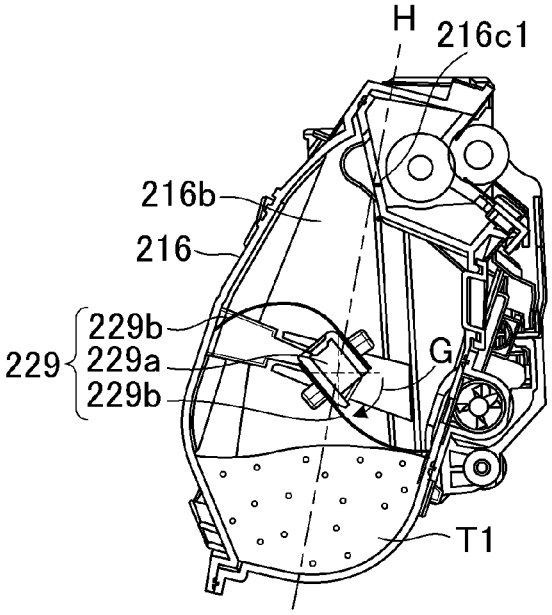
FIGS. 26A to 26D are conceptual drawings showing a toner conveyance state in the developing unit according to Embodiment 5.

Further, as shown in FIG. 26A, the density of a toner T1 before the stirring member 229 is rotated and the toner is conveyed (pressed) by the stirring sheet 229*b* represents "a sparse state". Meanwhile, as shown in FIG. 26B, when the stirring member 229 rotates, the toner T2 is sandwiched between the wall surface of the toner accommodation chamber 216*b* and the stirring sheet 229*b* (combined action of the pressing force of the stirring sheet, the reaction force of the wall surface, and the gravity), whereby the (density of the) toner assumes a "dense state".

Investigated hereinbelow is a case where the accommodation chamber communication port 244 is provided below the point P position on the other side (H1) where the developing chamber communication port 216*c* is present when the straight line H is used as a reference.

Figure 26B:
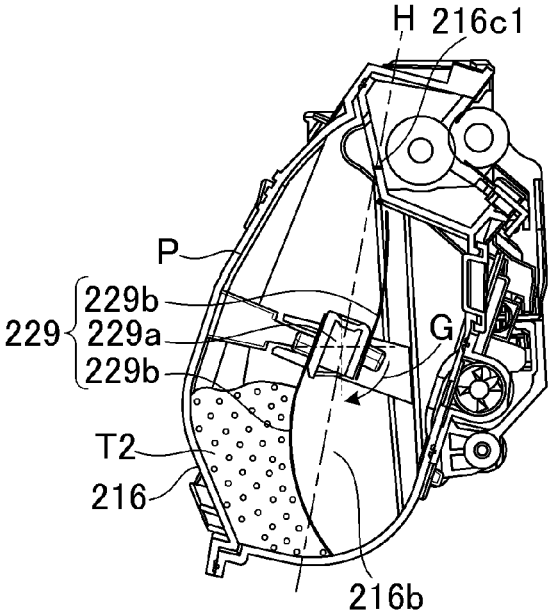
Figure 26C:
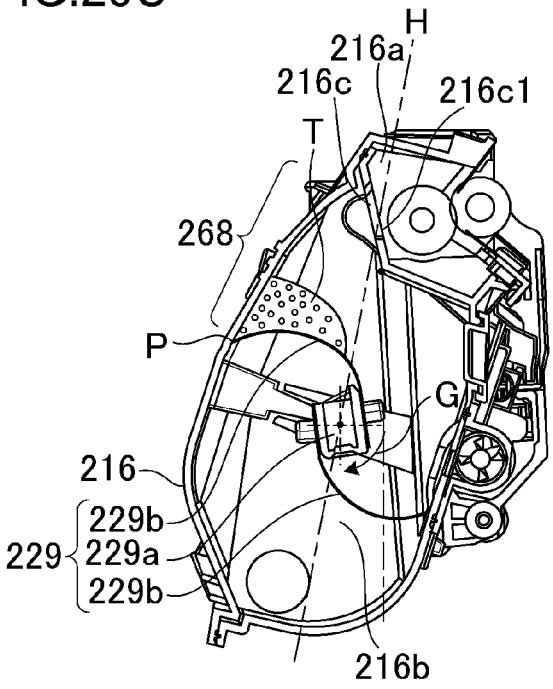

In this case, when the stirring member 229 is rotated, as shown in FIG. 26B, the pressure applied to the wall surface of the toner accommodation chamber 216*b* by the dense toner T2 conveyed by the stirring sheet 229*b* is higher than that applied by the sparse toner T1 such as shown in FIG. 26A. For this reason, there is a possibility that the toner will flow back from the toner accommodation chamber 216*b* through the accommodation chamber communication port 244 to the receiving and conveying path 242 for the toner to be replenished, and the receiving and conveying path will be clogged by the toner, thereby causing a failure of toner supply from the toner cartridge.

Investigated hereinbelow is a case where the accommodation chamber communication port 244 is provided above the point P position on the other side (H1) where the developing chamber communication port 216*c* is present when the straight line H is used as a reference.

Figure 26D:
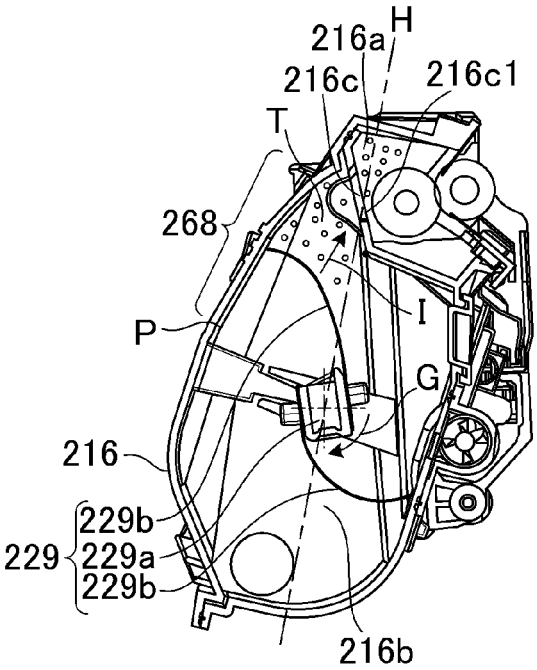

In this case, as shown in FIG. 26D, there is a possibility that the toner conveyed against the gravity toward the developing chamber communication port 216*c* (direction of an arrow I) will flow back from the toner accommodation chamber 216*b* through the accommodation chamber communication port 244 to the receiving and conveying path 242 for the toner to be replenished. Therefore, the receiving and conveying path is likely to be clogged by the toner, and a failure of toner supply from the toner cartridge may occur.

Therefore, in the present embodiment, the accommodation chamber communication port 244 is provided on the one side (H2) where the developing chamber communication port 216*c* is not present and below the partition wall 266 when the straight line H is used as a reference. As a result, after the stirring member 229 has rotated and the stirring sheet 229*b* has passed through the deforming portion 267, the toner borne and conveyed on the released stirring sheet 229*b* is conveyed against the gravity toward the developing chamber communication port 216*c*. Therefore, it is possible to suppress the toner conveyance (backflow) to the accommodation chamber communication port 244 provided on the one side (H2) of the straight line H taken as a reference.

The configuration of the present invention can be summarized as follows.

(1) The developing device (206) of the present invention has the developing frame (216) including the developing chamber (216*a*) in which the developer bearing member (211) for bearing a developer is accommodated, the developer accommodation chamber (216*b*) which is located below the developing chamber in a posture at the time of use and in which the developer is accommodated, and the communication port (216*c*) through the developing chamber and the developer accommodation chamber are communicated with each other; and the conveying member (229) that is provided in the developer accommodation chamber (216*b*) and that conveys the developer from the developer accommodation chamber to the developing chamber.

The conveying member 229 includes the rotatable rotating shaft portion (229*a*) and the elastically deformable sheet portion (229*b*) in which one end (229*b*1) is fixed to the rotating shaft portion and the other end (229*b*2) is a free end.

The developing device (206) further has the deforming portion (267) that is provided in the developer accommodation chamber (216*b*) and bends and elastically deforms the sheet portion by coming into contact with the free end (229*b*2) of the sheet portion (229*b*) when the sheet portion is rotated according to a rotation operation of the rotating shaft portion (229*a*); and the restoring portion (268) that is provided in the developer accommodation chamber (216*b*) at a position upstream of the communication port (216*c*) and downstream of the deforming portion (267) in the rotation direction (G) of the rotating shaft portion (229*a*).

The restoring portion (268) is configured to cause the developer borne on the sheet portion (229*b*) to fly toward the communication port (216*c*) by releasing and restoring the sheet portion (229*b*) elastically deformed by the deforming portion (267).

Further, the developer accommodation chamber (216*b*) is provided with the replenishing port (244) for replenishing the developer from the outside to the developer accommodation chamber;

when the rotation center (X0) of the rotating shaft portion (229*a*) and the downstream end (216*c*1) of the communication port (216*c*) in the rotation direction (G) of the rotating shaft portion (229*a*) are connected by a straight line (H) when viewed along the rotation axis direction (X1) of the rotating shaft portion (229*a*) in a posture at the time of use, the communication port (216*c*) and the replenishing port (244) are located on different sides (H1, H2) of the straight line (H), and the restoring portion (268) is not provided on the other side (H2) where the replenishing port (244) is located, but is provided on the one side (H1) where the communication port (216*c*) is located.

(2) In the developing device of the present invention, in a posture at the time of use, at least a part of the replenishing port (244) may be located below the rotation center (X0) of the rotating shaft portion (229*a*).

(3) In the developing device of the present invention, in a posture at the time of use, the highest position (P11) of the replenishing port (244) may be located below the lowest position (P21) of the restoring portion (268). In the present invention, the lowest position of the restoring portion (268) is a position at which the free end (229*b*2) of the sheet portion (229*b*) starts changing from a state of contact with the inner wall surface of the developing frame, which constitutes the restoring portion (268), to a state of separation during rotation.

(4) In the developing device of the present invention, in a posture at the time of use, the highest position (P11) of the replenishing port (244) may be located below the highest position (P31) of the deforming portion (267). The highest position of the deforming portion (267) is a position where the distance to the rotation center X0 of the rotating shaft portion (229*a*) is the shortest on the inner wall surface of the developing frame constituting the deforming portion (267).

(5) In the developing device of the present invention, in a posture at the time of use, the highest position (P11) of the replenishing port (244) may be located above the developer surface (LV) of the developer accommodated in the developer accommodation chamber (216*b*) in the unused state.

(6) In the developing device of the present invention, the developing frame (216) may have the partitioning portion (266) so the developing chamber (216*a*) and the developer accommodation chamber (216*b*) are partitioned from each other, and the partitioning portion (266) may include the first partitioning portion (266A) and the second partition (266B) located upstream of the first partitioning portion (266A).

In a posture at the time of use, the second partitioning portion (266B) may be set to a larger inclination angle (266B1) with respect to the horizontal direction (W) than the first partitioning portion (266A) (266B1>266A1); and the communication port (216*c*) may be provided in the second partitioning portion (266B).

(7) In the developing device of the present invention, a vertical line (G1) passing through a position at the lower end (266B2), which is a lowest portion of the second partition portion (266B), can be taken as a reference when viewed along the rotation axis direction (X1) of the rotating shaft portion (229*a*).

In this case, the replenishing port (244) may be located on the side (G12) opposite to the side (G11) where the communication port (216*c*) is located, regarding to the vertical line.

(8) In the developing device of the present invention, the developing chamber (216*a*) may be provided with the supply member (217) that is in contact with the developer bearing member (211) and supplies the developer to the developer bearing member.

(9) In the developing device of the present invention, the developer may be a one-component nonmagnetic developer.

(10) In the developing device of the present invention, the developing device (206) may be detachably attachable to the image forming apparatus (2100) that forms an image.

(11) The process cartridge (201) of the present invention includes the image bearing member (207) bearing a developer image, and the developing device (206), wherein the process cartridge is detachably attachable to the image forming apparatus (2100).

(12) In the process cartridge of the present invention, the developer bearing member (211) may collect a developer remaining on the image bearing member after the developer image has been transferred from the image bearing member (207).

(13) The image forming apparatus of the present invention includes at least one of the developing device (206) and the process cartridge (201); and the transfer member (220).

Embodiment 6

Configurations in which a developing cartridge (including a developing unit) or a process cartridge (including a developing unit and a photosensitive drum) can be detachably attached (replaced) to the main body of an electrophotographic image forming apparatus are well known. Among them, a cartridge, such as disclosed in Japanese Patent Application Publication No. 2011-253203, is known in which a developer is conveyed by causing to fly from a developer accommodation chamber located on the lower side to the developing chamber located on the upper side through a communication port by elastic deformation (elastic restoring force) of a stirring sheet.

In such a cartridge, when a replenishing port is provided in the developer accommodation chamber in order to improve image forming efficiency, the developer newly replenished from the replenishing port into the developer accommodation chamber may be conveyed through a communication port to the developing chamber located on the upper side without being sufficiently mixed with the already present toner. As a result, the stability of the formed image may be reduced.

A developing device, a process cartridge and an image forming apparatus which realize a configuration capable of supplying the developer from the lower side to the upper side and improve the mixing property of a developer newly supplied to a developer accommodation chamber from a replenishing port and the developer already present therein will be described below.

Similarly to Embodiment 5, the present invention can be implemented in the form of an electrophotographic image forming apparatus (hereinafter, may be simply referred to as "image forming apparatus"), or a process cartridge or a developing device constituting a part of the image forming apparatus.

The examples of the present embodiment described below are for exemplifying the present invention, and the scope of the invention is not limited to the dimensions, materials, and shapes of the components described below, or relative positional relationships thereof, unless specifically stated otherwise.

EXAMPLES

The image forming apparatus and the process cartridge according to the present invention will be described below with reference to the drawings.

Overall Configuration of Image Forming Apparatus

First, the overall configuration of an electrophotographic image forming apparatus 3100 (hereinafter, simply referred to as image forming apparatus) will be described with reference to FIG. 27.

Figure 27:
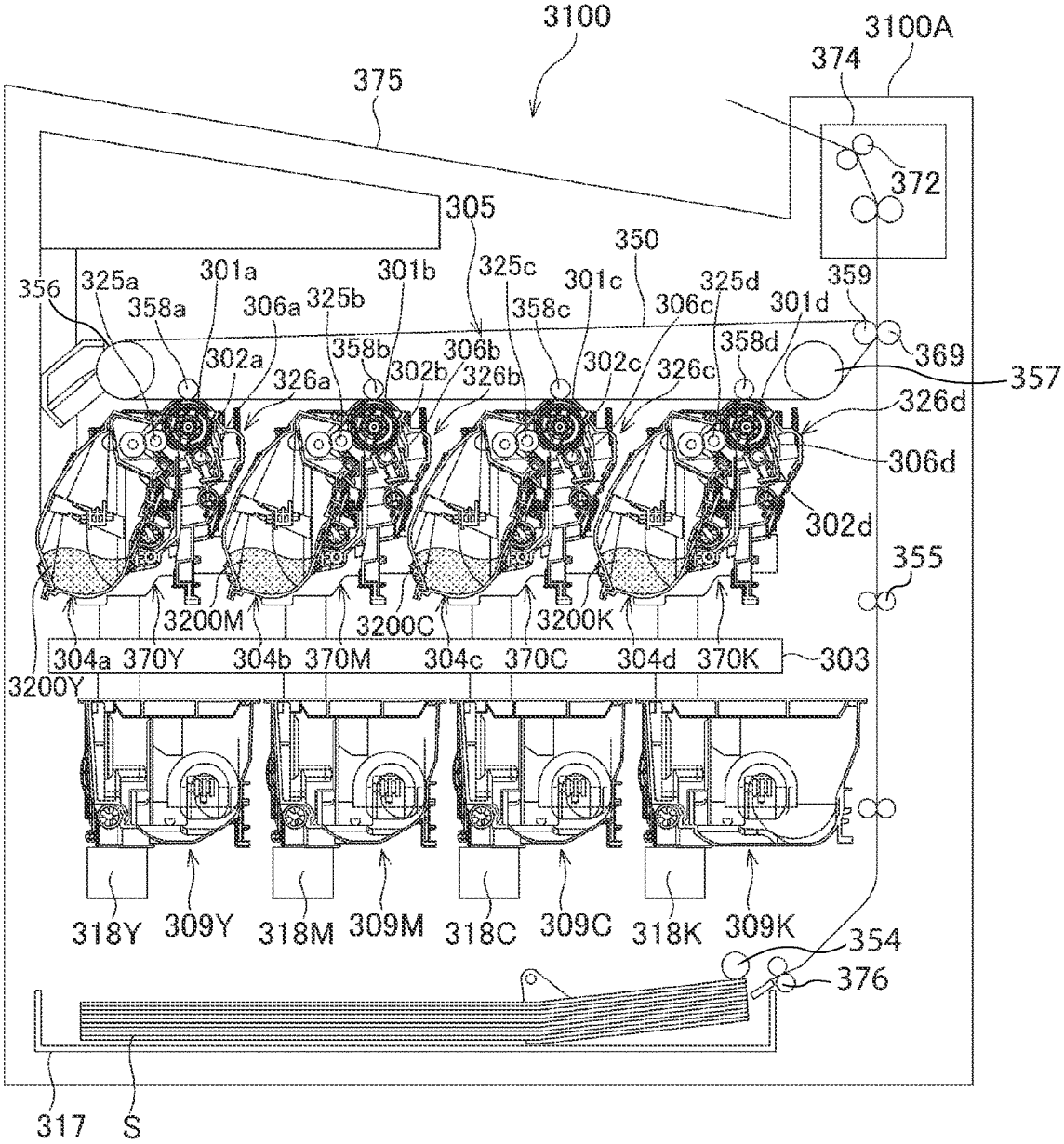
FIG. 27 is a sectional conceptual drawing of an image forming apparatus according to Embodiment 6.

FIG. 27 is a sectional conceptual drawing of an image forming apparatus according to an example of the present invention.

As shown in FIG. 27, four detachably attachable process cartridges 370 (370Y, 370M, 370C, 370K) are mounted by mounting members (not shown). Further, the upstream side in the mounting direction of the process cartridge 370 on the image forming apparatus 3100 is defined as the front surface side, and the downstream side in the mounting direction is defined as the rear surface side.

Process unit such as a photosensitive drum 301 (301*a* to 301*d*), a charging roller 302 (302*a* to 302*d*) around the photosensitive drum 301 (image bearing member), a developing roller 325 (325*a* to 325*d*), and a cleaning member 306 (306*a* to 306*d*) are integrally arranged in each process cartridge 370.

The charging roller 302 is for uniformly charging the surface of the photosensitive drum 301, and the developing roller 325 (developer bearing member) develops and visualizes a latent image, which has been formed on the photosensitive drum 301, by development with a toner (hereinafter referred to as developer). The cleaning member 306 removes the developer remaining on the photosensitive drum 301 after the toner image formed on the photosensitive drum 301 is transferred to a recording medium.

A scanner unit 303 for forming a latent image on the photosensitive drum 301 by selectively exposing the photosensitive drum 301 based on image information is provided below the process cartridge 370.

A cassette 317 storing the recording medium S is mounted on the lower portion of an apparatus main body 3100A of the image forming apparatus 3100. A recording medium conveying member is provided so that a recording medium S passes a secondary transfer roller 369 and a fixing unit 374 and is conveyed above the apparatus main body 3100A.

That is, a feeding roller 354 that separates and feeds one by one the recording medium S located in the cassette 317, a conveying roller pair 376 that conveys the fed recording medium S, and a registration roller pair 355 for synchronizing a latent image to be formed on the photosensitive drum 301 and the recording medium S are provided.

An intermediate transfer unit 305 serving as an intermediate transfer portion for transferring the toner image formed on each photosensitive drum 301 (301*a* to 301*d*) is provided above the process cartridges 370 (370Y, 370M, 370C, 370K).

The intermediate transfer unit 305 includes a driving roller 356, a driven roller 357, primary transfer rollers 358 (358*a* to 358*d*) at positions facing the photosensitive drum 301 of each color, and an opposing roller 359 at a position facing a secondary transfer roller 369, and a transfer belt 350 is stretched around these rollers.

The transfer belt 350 circulates so as to face and contact all the photosensitive drums 301, and a voltage is applied to the primary transfer roller 358 (transfer member), whereby primary transfer is performed from the photosensitive drums 301 onto the transfer belt 350. The toner on the transfer belt 350 is transferred onto the recording medium S by applying a voltage to the opposing roller 359 and the secondary transfer roller 369 arranged on the inner side of the transfer belt 350.

At the time of image formation, each photosensitive drum 301 is rotated, and the photosensitive drum 301 uniformly charged by the charging roller 302 is selectively exposed by the scanner unit 303. As a result, an electrostatic latent image is formed on the photosensitive drum 301.

Further, by developing the electrostatic latent image with the developing roller 325, each color toner image is formed on the respective photosensitive drum 301. In synchronization with this image formation, the registration roller pair 355 conveys the recording medium S to the secondary transfer position where the opposing roller 359 and the secondary transfer roller 369 are in contact with each other with the transfer belt 350 interposed therebetween.

Then, by applying a transfer bias voltage to the secondary transfer roller 369, each color toner image on the transfer belt 350 is secondarily transferred to the recording medium S. As a result, a color image is formed on the recording medium S.

The recording medium S on which the color image has been formed is heated and pressed by the fixing unit 374 to fix the toner image. After that, the recording medium S is discharged to a discharge unit 375 by a discharge roller 372. The fixing unit 374 is arranged above the apparatus main body 3100A.

The first to fourth toner cartridges 309 are arranged side by side in the horizontal direction below the process cartridge 370 in the order corresponding to the color of the toner accommodated in each process cartridge 370.

That is, the first toner cartridge 309Y accommodates a yellow (Y) toner, and similarly, the second toner cartridge 309M accommodates a magenta (M) toner, the third toner cartridge 309C accommodates a cyan (C) toner, and the fourth toner cartridge 309K accommodates a black (K) toner. Then, each toner cartridge 309 supplies the toner to the process cartridge 370 accommodating the respective color toner.

The replenishment operation of the toner cartridge 309 is performed when the remaining amount detection unit (not shown) provided in the apparatus main body 3100A of the image forming apparatus 3100 detects that the amount of toner remaining in the process cartridge 370 is insufficient. The toner cartridge 309 is detachably attachable to the image forming apparatus 3100 through a mounting guide (not shown), a positioning member (not shown), and the like provided at the image forming apparatus 3100. A detailed description of the process cartridge 370 and the toner cartridge 309 will be given later.

First to fourth toner conveying devices 318 are arranged below the toner cartridges 309 correspondingly to the respective toner cartridges 309. Each toner carrying device 318 conveys upward the toner received from the respective toner cartridge 309, and supplies the toner to the respective developing unit 304 (developing device).

Process Cartridge

Next, the process cartridge 370 embodying the present invention will be described with reference to FIG. 28.

Figure 28:
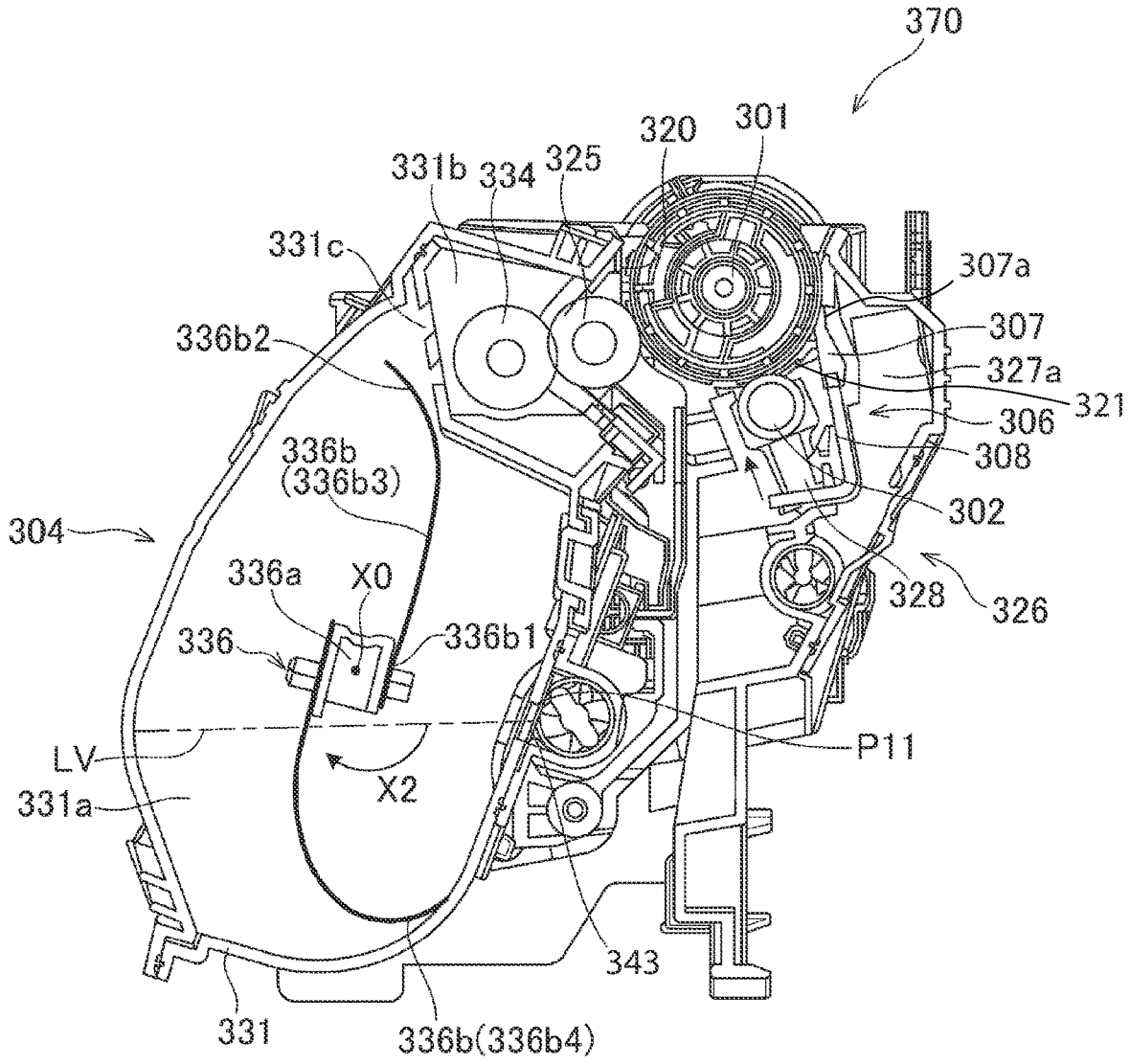
FIG. 28 is a sectional conceptual drawing of a process cartridge used in the image forming apparatus according to Embodiment 6.

FIG. 28 is a sectional conceptual drawing of a process cartridge used in the image forming apparatus according to an example of the present invention.

Specifically, FIG. 28 shows a main cross section of the process cartridge 370 containing the toner. The cartridge 370Y containing yellow toner, the cartridge 370M containing magenta toner, the cartridge 370C containing cyan toner, and the cartridge 370K containing black toner have the same configuration.

The process cartridge 370 (370Y, 370M, 370C, 370K) has a cleaning unit 326 (326*a* to 326*d*) and a developing unit 304 (304*a* to 304*d*). The cleaning unit 326 includes a photosensitive drum 301 (301*a* to 301*d*), a charging roller 302 (302*a* to 302*d*), and a cleaning member 306 (306*a* to 306*d*). The developing unit 304 (developing device) includes a developing roller 325.

As described above, the charging roller 302 and the cleaning member 306 are arranged on the circumference of the photosensitive drum 301. The cleaning member 306 is configured of an elastic member 307 formed of a rubber blade and a cleaning support member 308.

A tip portion 307*a* of the rubber blade 307 is arranged in contact in the counter direction with respect to the rotation direction of the photosensitive drum 301. The residual toner removed from the surface of the photosensitive drum 301 by the cleaning member 306 falls into a removed toner chamber 327*a*.

Further, a scooping sheet 321 that prevents the removed toner in the removed toner chamber 327*a* from leaking is in contact with the photosensitive drum 301. By transmitting the driving force of a main body driving motor (not shown), which is a driving source, to the cleaning unit 326, the photosensitive drum 301 is rotationally driven according to the image forming operation.

The charging roller 302 is rotatably attached to the cleaning unit 326 through a charging roller bearing 328, is pressed toward the photosensitive drum 301 by a charging roller pressing member 346, and is driven to rotate by the photosensitive drum 301.

Developing Unit and Toner Conveying Means

Next, the developing unit and the toner conveying member will be described with reference to FIGS. 28 to 31A and 31B.

Figure 29:
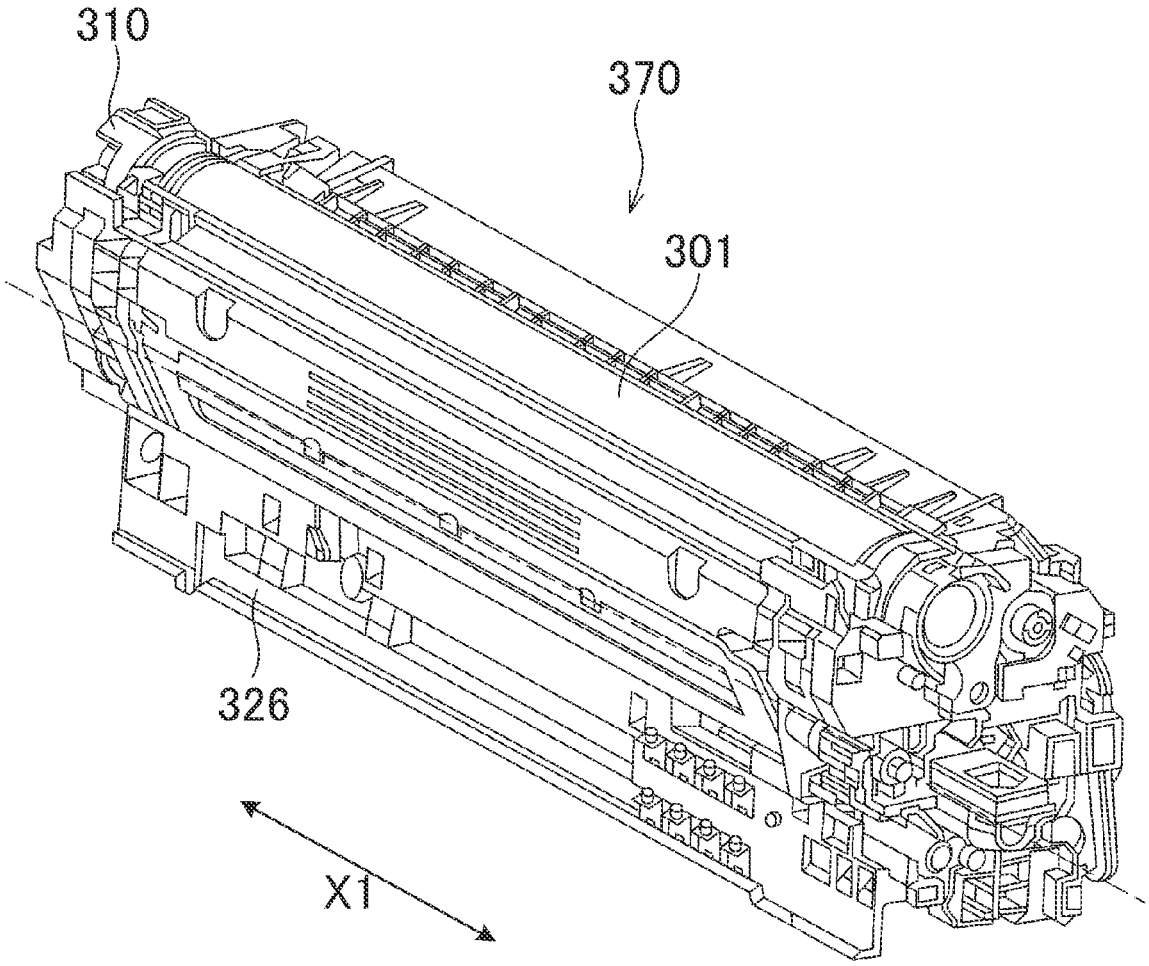
FIG. 29 is a perspective conceptual drawing of the process cartridge according to Embodiment 6 as viewed from above on the drive side.

FIG. 29 is a perspective conceptual drawing of the process cartridge according to an example of the present invention as viewed from above the drive side.

Figure 30:
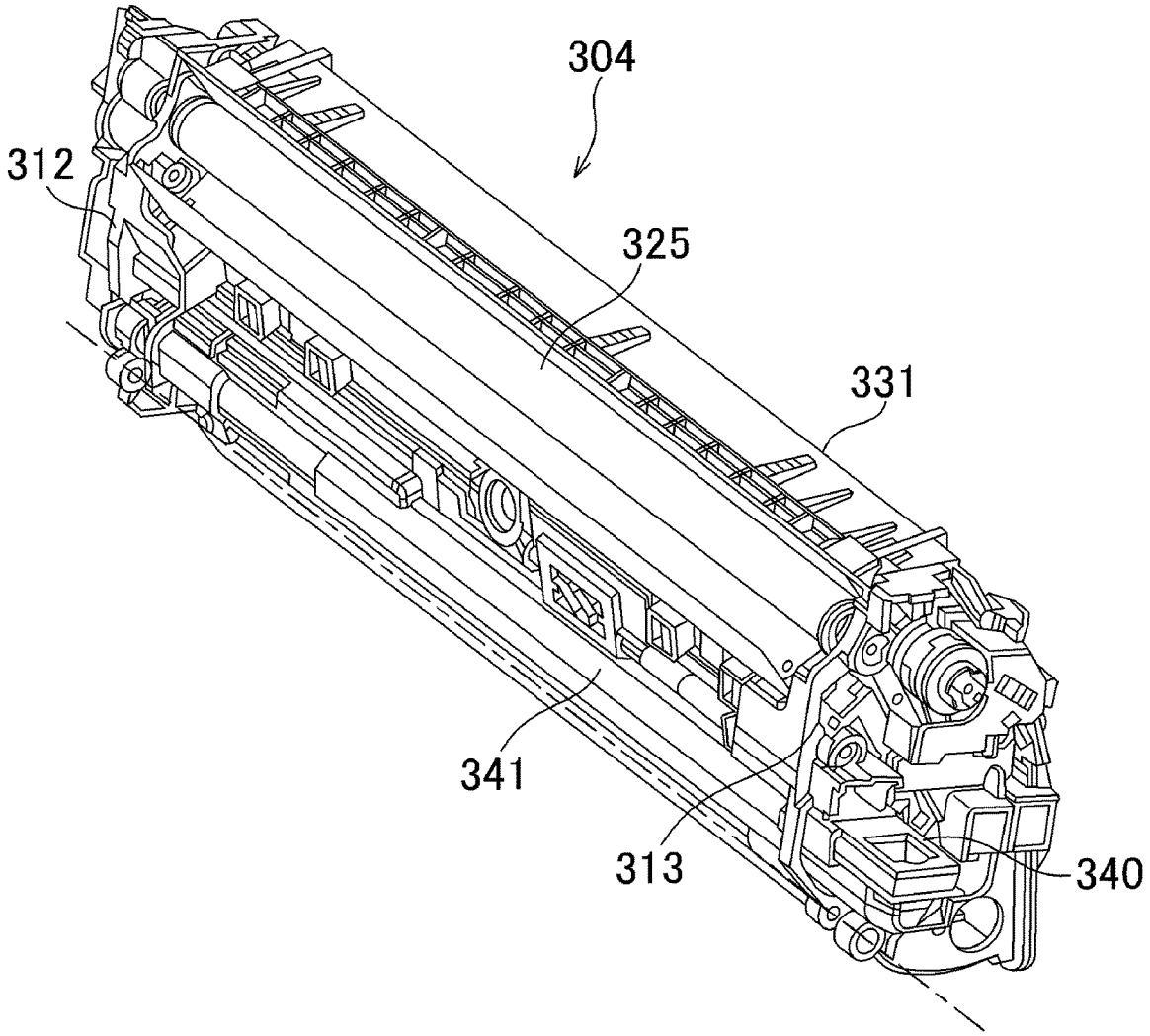
FIG. 30 is a perspective conceptual drawing of a developing unit used in the image forming apparatus according to Embodiment 6 as viewed from above on the drive side.

FIG. 30 is a perspective conceptual drawing of the developing unit used in the image forming apparatus according to an example of the present invention as viewed from above the drive side.

Figure 31A:
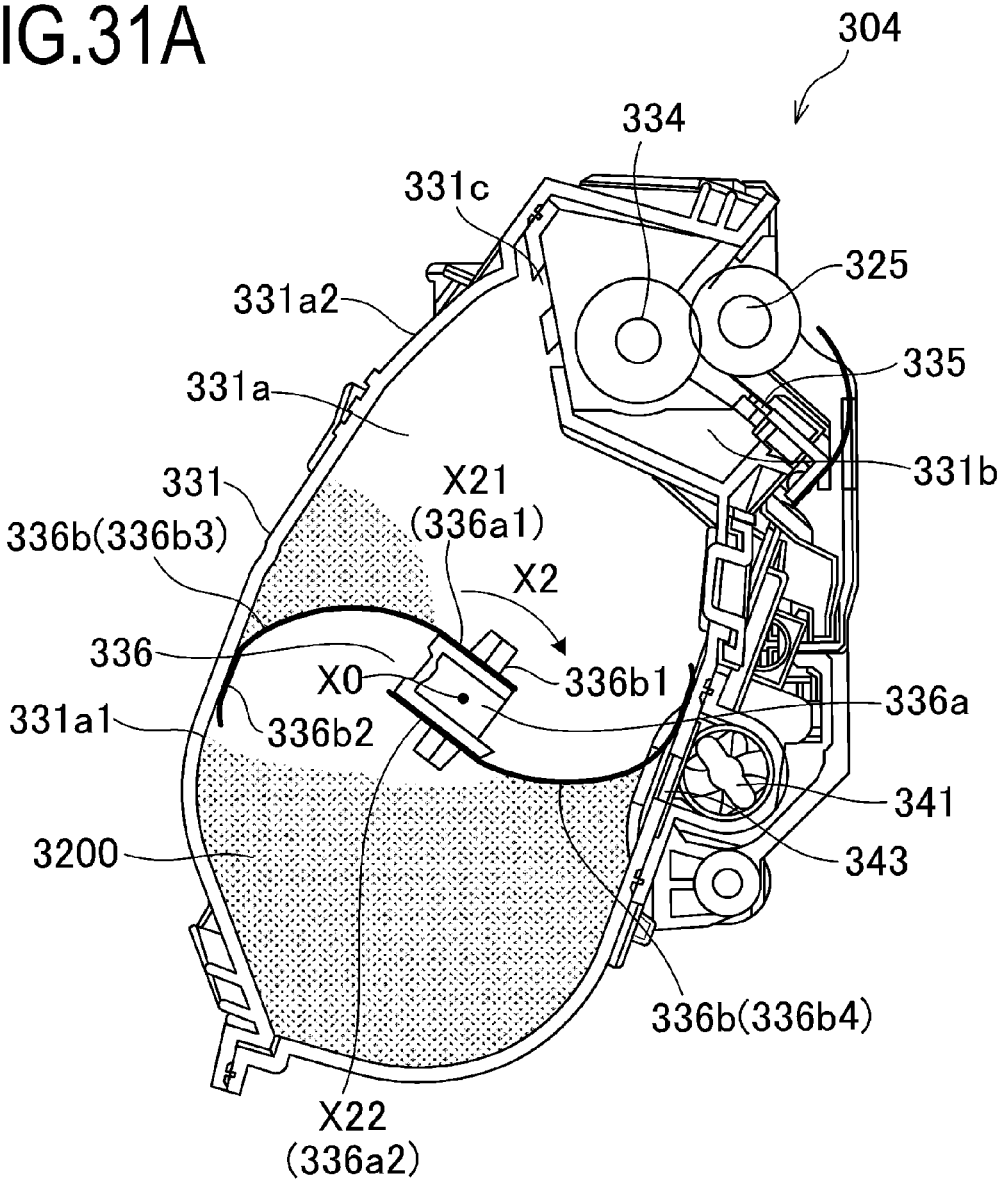
FIG. 31A is a conceptual drawing showing a stirring state of toner in the developing unit of Embodiment 6.
Figure 31B:
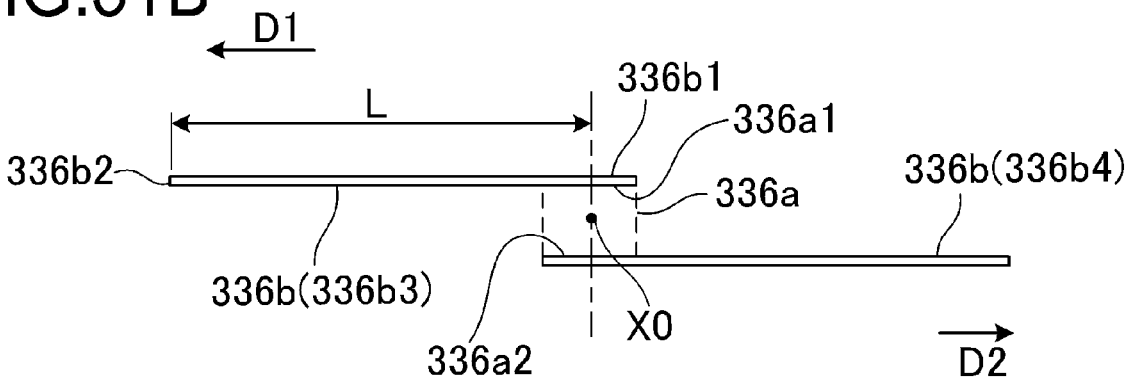
FIG. 31B is a conceptual drawing showing a free length L (free state) of a sheet member of a stirring member.

FIG. 31A is a conceptual drawing showing a stirring state of toner 3200 in the developing unit according to an example of the present invention. FIG. 31B is a conceptual drawing showing a free length L (free state) of the sheet member of the stirring member.

As shown in FIGS. 28 and 29, the developing unit 304 is configured of a developing roller 325 that rotates in contact with the photosensitive drum 301, and a developing frame 331 that supports the developing roller 325.

The developing roller 325 is rotatably supported by the developing frame 331 through pre-developing bearings 312 and developing device inner bearings 313 attached at both sides of the developing frame 331 (see FIG. 30). Further, a toner supply roller 334 (supply member) that contacts the developing roller 325 and rotates in the direction of arrow C and a developing blade 335 for regulating the toner layer on the developing roller 325 are arranged on the circumference of the developing roller 325, When the toner supplied from the toner supply roller 334 to the developing roller 325 passes the developing blade 335, the toner coat amount on the developing roller 325 is regulated and the toner is charged. As a result, a toner coat most optimum for developing the latent image formed on the photosensitive drum is formed.

The developing roller 325 and the photosensitive drum 301 rotate so that surfaces thereof move in the same direction (the direction from the bottom to the top in the present example) at the opposing portion (contact portion). In the present example, the toner triboelectrically charged negatively with respect to the predetermined DC bias applied to the developing roller 325 is transferred by this potential difference only to a bright potential portion and visualizes the electrostatic latent image in the developing portion that is in contact with the photosensitive drum 301.

Further, a blow-out prevention sheet 320 is arranged as a development contact sheet for preventing the toner from leaking from the developing frame 331 contacting the developing roller 325. Furthermore, a toner conveying member 336 (conveying member) for stirring the contained toner and conveying the toner to the toner supply roller 334 is provided in a toner storage chamber 331*a* (developer accommodation chamber) of the developing frame 331.

As shown in FIG. 31A, the toner conveying member 336 is configured of a stirring shaft 336*a* (rotating shaft portion) rotatable by a driving force from the outside, and a sheet member 336*b* (sheet portion) attached to the stirring shaft 336*a* and rotating together with the stirring shaft 336*a*.

Next, the toner conveyance in the developing unit will be described. The toner accommodation chamber 331*a* is provided with a deforming portion 331*a*1 that contacts the sheet member 336*b* below an opening 331*c* (communication port). The sheet member 336*b* contacts the deforming portion 331*a*1 as the sheet member rotates.

The sheet member 336*b* thus receives a force from the deforming portion 331*a*1. As a result, the sheet member 336*b* is deformed against the elastic force of the sheet member 336*b*. Further, the sheet member 336*b* is rotated while being in contact with the deforming portion 331*a*1, so that the toner is conveyed while being borne on the surface of the sheet member on the downstream side of the rotation. In the present example, as shown in FIG. 31A, the deforming portion 331*a*1 refers to a portion of the inner wall of the toner accommodation chamber to a point where the sheet member 336*b* is separated.

Further, the toner accommodation chamber 331*a* is also provided with a restoring portion 331*a*2 on the downstream side of the deforming portion 331*a*1 in the rotation direction of the sheet member 336*b* and on the upstream side of an opening 331*c*. Here, the restoring portion 331*a*2 is a portion for releasing the contact between the sheet member 336*b* and the inner wall of the toner accommodation chamber 331*a*. In the present example, the restoring portion 331*a*2 is arranged above the horizontal plane including the rotating shaft of the stirring member.

Therefore, when the sheet member 336*b* rotates, the tip on the free end side of the sheet member 336*b* passes the deforming portion 331*a*1, and then the contact with the inner wall of the sheet member 336*b* is released at the restoring portion 331*a*2. Accordingly, the sheet member 336*b* is released from the deformed state by the deforming portion 331*a*1, and is restored to the natural state (original shape) by the elastic restoring force of itself.

Due to the shape change of the sheet member 336*b* in the restoration direction, the toner borne and conveyed on the sheet member 336*b* flies toward the opening 331*c* against the gravity. The opening 331*c* is located downstream of the restoring portion 331*a*2 in the rotation direction of the sheet member 336*b*.

A part of the toner flying toward the opening 331*c* is conveyed into the developing chamber 331*b*. Meanwhile, the toner that has not reached the inside of the developing chamber 331*b* falls down inside the toner accommodation chamber 331*a*, stays at the bottom of the toner accommodation chamber 331*a*, and returns to the original state again. By repeating this cycle, the toner is stirred and conveyed.

Toner Replenishing Operation

Next, the toner supply operation in the present example will be described.

As shown in FIG. 30, the developing unit 304 is provided with a receiving port 340 at one end on the downstream side in the attachment/detachment direction. A receiving and conveying path 341 is provided in communication with the toner receiving port 340, and a receiving and conveying screw (not shown) is arranged inside. The receiving and conveying path 341 extends parallel to the rotation axis direction of the developing roller 325 and the supply roller 334.

Further, an accommodation chamber communication port 343 (replenishing port) for supplying the toner to the toner storage chamber 331*a* is provided in the vicinity of the longitudinal center of the developing unit 304, and the receiving transport path 341 and the toner storage chamber 331*a* are communicated with each other. The toner discharged from the toner cartridge 309 is caused to reach the toner receiving port 340 by the toner carrying device 318 provided in the device main body 3100A. The toner received from the toner receiving port 340 is conveyed and replenished into the toner storage chamber 331*a* through the accommodation chamber communication port 343.

More specifically, as described above, the developing unit 304 of the present example includes the developing frame 331.

The developing frame 331 includes the developing chamber 331*b* in which the developing roller 325 bearing the toner is accommodated, the toner accommodation chamber 331*a* located below the developing chamber in a posture at the time of use and accommodating the toner, and the opening 331*c* that communicates the developing chamber and the toner accommodation chamber with each other.

The toner accommodation chamber 331*a* is provided with the toner conveying member 336 for conveying the toner accommodated in the toner accommodation chamber to the developing chamber 331*b*.

The toner conveying member 336 includes the rotatable stirring shaft 336*a* and the elastically deformable sheet member 336*b*. One end 336*b*1 of the sheet member 336*b* is fixed to the stirring shaft 336*a*, and the other end 336*b*2 is a free end.

The deforming portion 331*a*1 is provided in the toner accommodation chamber 331*a*.

When the free end (336*b*2) of the sheet member 336*b* that rotates with the rotation of the stirring shaft 336*a* comes into contact with the deforming portion 331*a*1, the sheet member is bent and elastically deformed.

The toner accommodation chamber 331*a* is provided with the restoring portion 331*a*2 at a position upstream of the opening 331*c* and downstream of the deforming unit 331*a*1 in a rotation direction X2 of the stirring shaft 336*a*.

The (free end of the) sheet member 336*b* elastically deformed by the deforming portion 331*a*1 is released by the restoring portion 331*a*2 and elastically restored. As a result, the toner borne on the upper surface of the sheet member 336*b* is caused to fly toward the opening 331*c* and is supplied to the developing chamber 331*b*.

The toner accommodation chamber 331*a* is provided with the accommodation chamber communication port 343 for supplying the replenishing toner to the toner accommodation chamber 331*a* from the outside.

Mixing of Toner Inside Toner Accommodation Chamber

The toner is supplied for replenishment from the toner cartridge 309 into the toner accommodation chamber 331*a* through the toner conveying device 318 and the accommodation chamber communication port 343. The replenishing toner (hereinafter referred to as "new toner") and the toner (hereinafter referred to as "old toner") that was already present in the toner accommodation chamber 331*a* before the replenishment are stirred (mixed) inside the toner accommodation chamber 331*a* by the rotation of the sheet member 336*b* and conveyed.

Here, as the developing unit 304 is used and the toner circulation is repeated in the developing unit 304, the deterioration of the old toner in the toner accommodation chamber 331*a* is advanced. The deterioration herein refers to a phenomenon in which the behavior such as the charging characteristic of the toner changes with respect to that of the new toner, which is supplied for replenishment from the toner replenishing container, due to wear and deformation of the toner resin by mechanical rubbing, or due to release of an external additive added to the surface and embedding thereof into the resin.

In other words, as the developing unit 304 is used and the old toner is deteriorated, a difference in charging characteristic with the new toner occurs. Where the charging characteristics of the toners are different, when the electrostatic latent image formed on the photosensitive drum 301 is visualized, the amount of toner that fills the electrostatic latent image can change, and the toner can fly not only to the bright portion potential but also to the dark portion potential. As a result, image defects such as "density unevenness" and the below-described "fogging" will occur.

In order to suppress the occurrence of such a problem, it is necessary that the new toner and the old toner be sufficiently stirred in the toner accommodation chamber 331*a*, and the degree of uneven distribution of the new toner in the old toner be reduced even when a difference in charging characteristic occurs between the new toner and the old toner.

According to the present invention, the positions of the opening 331*c* and the restoring portion 331*a*2, and the position of the accommodation chamber communication port 343 are defined as described below, so that the above-mentioned problem is resolved with a simple configuration without providing an additional member or a complicated configuration.

Next, the relationship between the positions of the opening 331*c* and the restoring portion 331*a*2, the position of the accommodation chamber communication port 343, and the occurrence of the problem will be described in detail.

Figure 32:
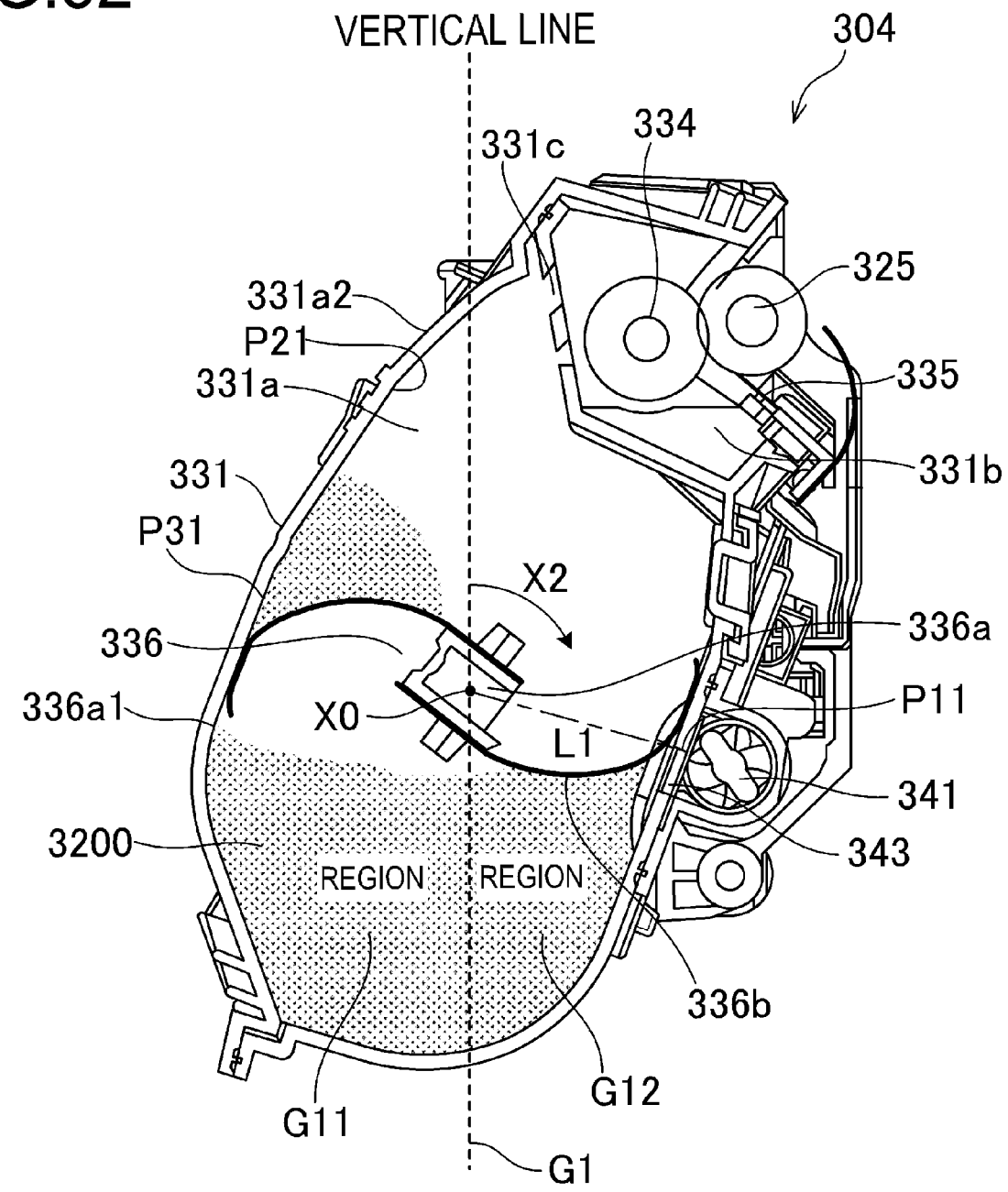
FIG. 32 is a conceptual drawing showing a region A and a region B in the developing unit of Embodiment 6.

FIG. 32 is a conceptual drawing showing a region A and a region B in the developing unit according to an example of the present invention.

Figure 33A:
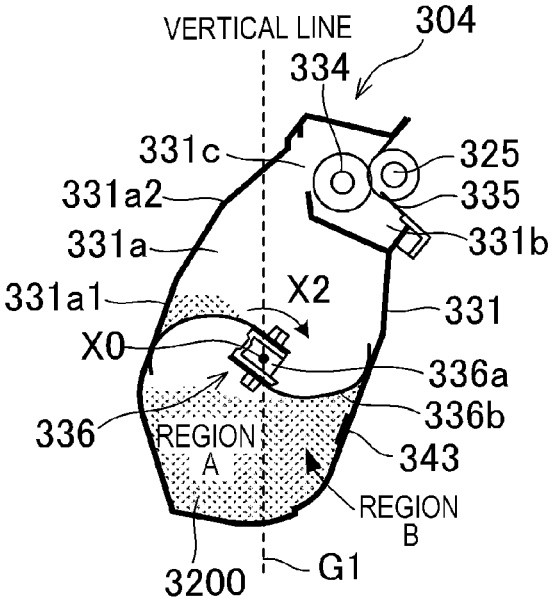
FIG. 33A is a conceptual drawing showing the posture of the developing unit and the position of a replenishing port in the example of Embodiment 6.
Figure 33B:
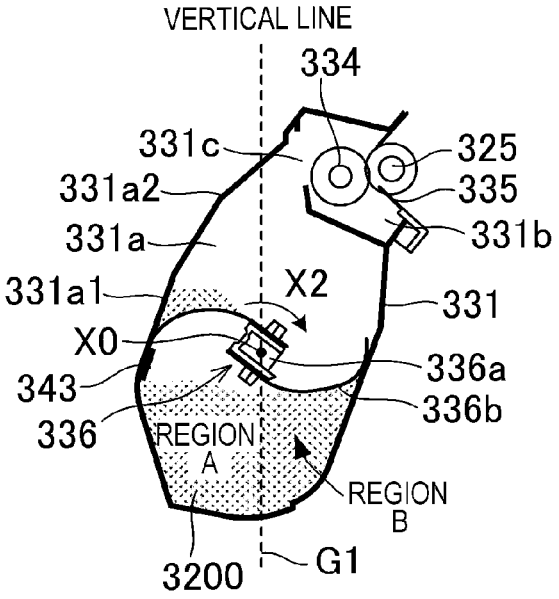
FIGS. 33B to 33D are conceptual drawing a showing the posture of the developing unit in a comparative example related to the example of Embodiment 6.
Figure 33C:
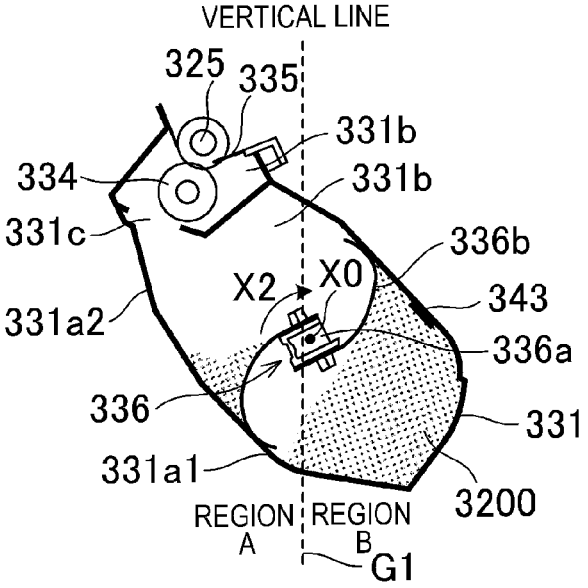
Figure 33D:
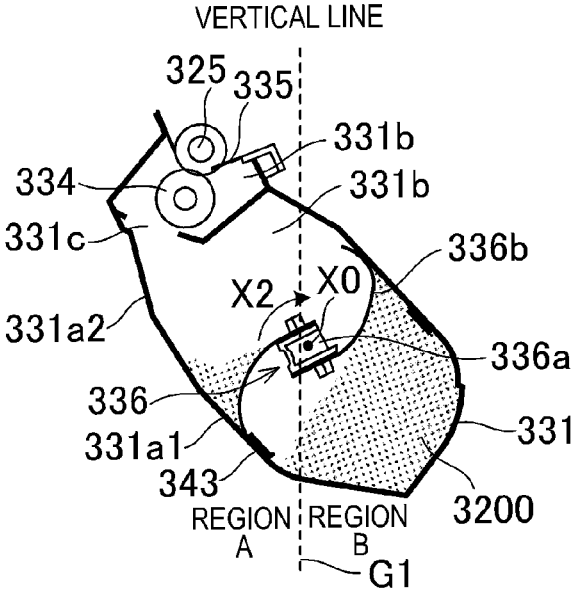

FIG. 33A is a conceptual drawing showing the posture of the developing unit and the position of the replenishing port according to an example of the present invention. FIGS. 33B to 33D are conceptual drawings showing the posture of the developing unit and the position of the replenishing port in the comparative example of the embodiment of the present invention.

First, as shown in FIG. 32, in the posture at the time of use, when a vertical line passing through the center of the stirring shaft 336*a* is drawn, of the two, left and right, regions on both sides of the line, a region including the restoring portion 331*a*2 is referred to as a region A, and a side not including the restoring portion is referred to as a region B.

At this time, the combination of the positions of the opening 331*c* and the accommodation chamber communication port 343 can be classified into four patterns shown in Table 3 and FIGS. 33A to 33D. When the opening 331*c* and the accommodation chamber communication port 343 are present across the space between the regions A and B, where the opening and the port enter the region B at least partially, they are considered to be in region B.

TABLE 3

| | Position of opening 331c | Position of accommodation chamber communication port 343 |
|---|---|---|
| Example 1 | Region B | Region B |
| Comparative example 1 | Region B | Region A |
| Comparative example 2 | Region A | Region B |
| Comparative example 3 | Region A | Region A |

First, in the present example, as shown in FIG. 33A, both the opening 331*c* and the accommodation chamber communication port 343 are in the region B.

More specifically, in the present example, when viewed along the rotation axis direction X1 of the stirring shaft 336*a* in the posture at the time of use, the vertical line G1 passing through the rotation center X0 of the stirring shaft 336*a* can be used as a reference. At this time, at least a part of the opening 331*c* and at least a part of the accommodation chamber communication port 343 are both positioned on one side G12 with respect to the vertical line G1. Further, the restoring portion 331*a*2 is located on the other side G11, which is a side different from the one side G12, with respect to the vertical line G1.

Meanwhile, in Comparative Example 1, as shown in FIG. 33B, the opening 331*c* is in the region B and the accommodation chamber communication port 343 is in the region A.

In Comparative Example 2, as shown in FIG. 33C, the opening 331*c* is in the region A, and the accommodation chamber communication port 343 is in the region B.

In Comparative Example 3, as shown in FIG. 33D, both the opening 331*c* and the accommodation chamber communication port 343 are in the region A.

First, the difference in the position of the communication port 343 of the accommodation chamber and the mixing state of the new toner and the old toner in the toner accommodation chamber 331*a* will be described.

When the accommodation chamber communication port 343 is in the region B as in the configuration of the present example, the new toner supplied for replenishment from the accommodation chamber communication port 343 is supplied into the old toner staying on the bottom of the toner accommodation chamber 331*a*, or upstream of the old toner in the rotation direction of the stirring sheet 336*b*. As a result, the stirring sheet 336*b* passes, due to the rotation thereof, through the old toner staying at the bottom of the toner accommodation chamber 331*a* until the restoring portion 331*a* is reached, and in this process, mixing with the old toner is actively performed and the mixture is conveyed to the developing chamber 331*b*.

Meanwhile, when the accommodation chamber communication port 343 is in the region A as in the configurations of Comparative Examples 1 and 3, the new toner used for replenishment is supplied into the old toner staying on the bottom of the toner accommodation chamber 331*a*, or upstream of the old toner in the rotation direction of the stirring sheet 336*b*.

In other words, the distance from the accommodation chamber communication port 343 to the restoring portion 331*a*2 is short, and the old toner is unlikely to be mixed with the new toner. Accordingly, the new toner reaches the restoring portion 331*a*2 and is conveyed to the developing chamber without being sufficiently mixed with the old toner.

Next, the difference in the position of the opening 331*c* and the mixing state of the new toner and the old toner in the toner accommodation chamber 331*a* will be described.

Figure 34:
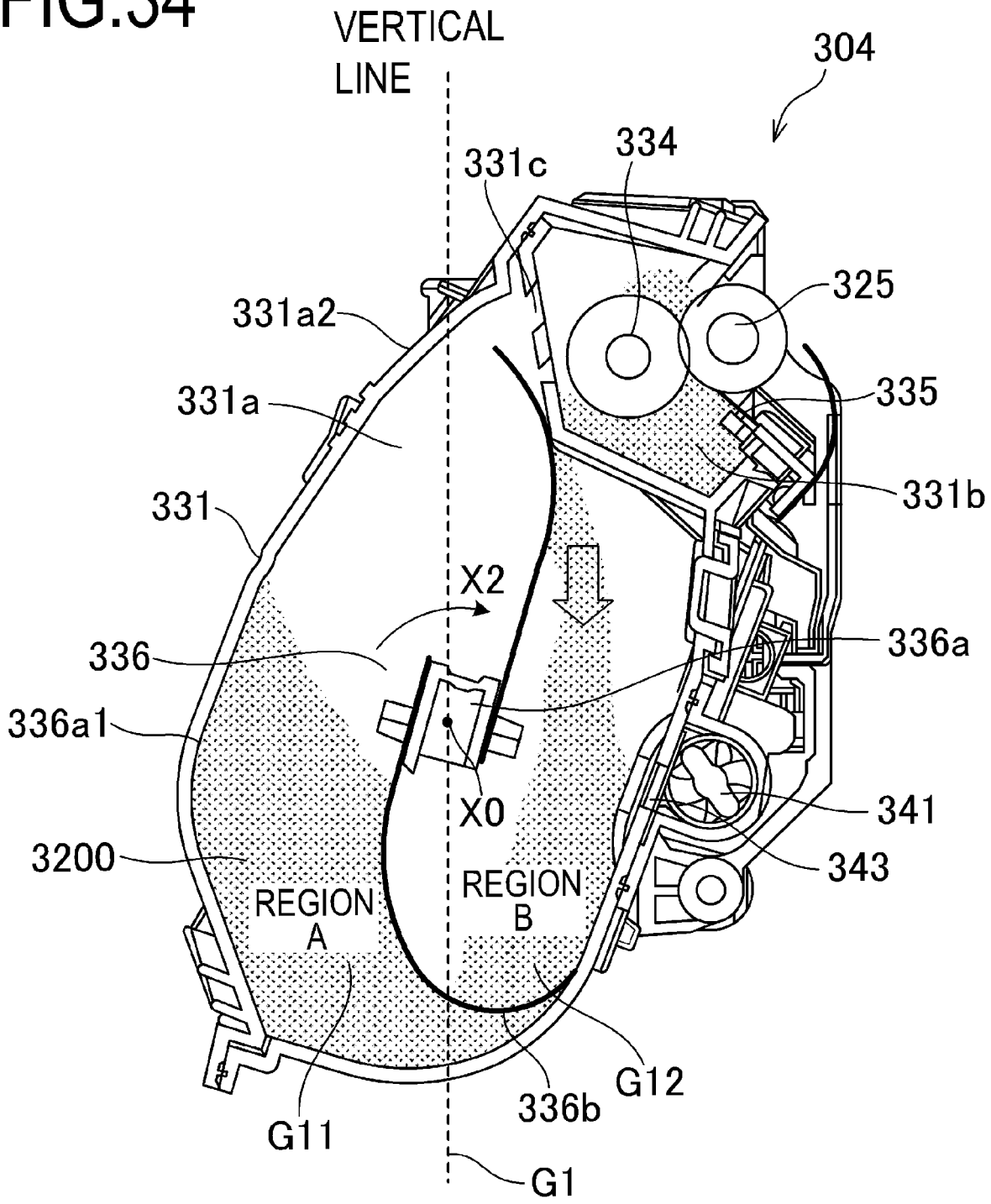
FIG. 34 is a conceptual drawing showing the circulation of toner in the developing unit according to Embodiment 6.

FIG. 34 is a conceptual drawing showing the circulation of toner in the developing unit according to an example of the present invention.

Specifically, FIG. 34 shows a state after one of the stirring sheets 336*b* has passed the restoring portion 331*a*2 and the toner has been conveyed to the developing chamber 331*b*. The toner that has not been conveyed to the developing chamber 331*b* is falling into the toner accommodation chamber 331*a*.

First, in the case where the opening 331*c* is located in the region B as in the configurations of the present example and Comparative Example 1, most of the toner that falls down to the toner accommodation chamber 331*a* without reaching the developing chamber 331*b* of the entire toner that flies toward the opening 331*c* falls to the region B (see FIG. 34). The toner that has fallen is stirred and mixed with the old toner staying at the bottom of the toner accommodation chamber 331*a*, and then conveyed to the developing chamber.

Meanwhile, in the case where the opening 331*c* is located in the region A as in the configurations shown in Comparative Examples 2 and 3, most of the toner that falls down to the toner accommodation chamber 331*a* without reaching the developing chamber 331*b*, of the entire toner that flies toward the opening 331*c*, falls to the region A. The toner that has fallen is lifted by the rotation of the stirring sheet, reaches the restoring portion, and flies. That is, the toner is conveyed to the developing chamber in a state with a small degree of stirring and mixing with the toner accumulated at the bottom of the toner accommodation chamber.

Thus, in the present example, when a vertical line is drawn so as to pass through the center of the stirring shaft in the posture at the time of use, the opening 331*c* and the accommodation chamber communication port 343 are arranged on the side (region B) different from that of the restoring portion 331*a*2, as in the configuration of the present example. As a result, the new toner and the old toner can be sufficiently stirred and mixed in the toner accommodation chamber 331*a* and then conveyed to the developing chamber 331*b*.

Therefore, it is possible to reduce uneven distribution of toners that differ in charging performance on the coat on the developing roller, and it is possible to suppress the occurrence of image defects such as the below-described "fogging", toner scattering and density unevenness.

In the present example, two sets of sheet members 336*b* are attached by shifting the attachment position on the stirring shaft 336*a*. As a result, it is possible to efficiently stir the toner in the toner accommodation chamber 331*a* and efficiently convey the toner to the developing chamber 331*b* as compared with the case where one sheet member 336*b* is provided.

Further, in the present example, the length (free length L) of the sheet member 336*b* is larger than the shortest distance (L1) from the stirring shaft 336*a* to the accommodation chamber communication port 343.

In other words, the sheet member 336*a* comes into contact with the accommodation chamber communication port 343 in a phase where the sheet member 336*b* overlaps the accommodation chamber communication port 343. As a result, it is possible to increase the conveying force for the new toner supplied for replenishment from the accommodation chamber communication port 343, and it is possible to efficiently mix the new toner with the old toner.

Effect Verification Test

In order to verify the effect of the present example, the tests described below were performed in combination with Comparative Examples 1, 2, and 3.

A two-sheet intermittent printing durability test was performed under an environment of normal temperature and normal humidity (temperature 23° C., humidity 60%). In this printing durability, horizontal lines with an image ratio of 1% were printed.

Further, the present test was started after filling 200 g of toner in the process cartridge 370, and control was performed to supply 10 g of toner for replenishment from the toner cartridge 309 each time the amount of toner decreased by 10 g. Then, printing durability was performed until the usage amount of the process cartridge 370 reached 100%, and the occurrence of fogging was determined according to the following criteria.

Next, an evaluation test for image defects due to "fogging".

The "fogging", as referred to herein, is an image defect in which toner is slightly developed in an unexposed portion, which is not intended to be printed, and appears like scumming.

The image forming apparatus was stopped while printing a solid white image. After development, the toner on the photosensitive drum before transfer was once transferred to a transparent tape, and the tape with the toner adhered thereto was attached to a recording paper or the like. Further, a tape having no toner adhered thereto was also attached at the same time on the same recording paper. The optical reflectance based on a green filter was measured with an optical reflectance measuring instrument (TC-6DS manufactured by Tokyo Denshoku Co., Ltd.) from above the tapes attached to the recording paper, the reflectance from the tape to which the toner adhered was subtracted from the reflectance from the tape to which the toner did not adhere to determine the reflectance amount of fogging, and this amount was evaluated as a fogging amount. The fogging amount was measured at three or more points on the tape and the average value was determined.

A: The fogging amount is less than 1.0%.

B: The fogging amount is 1.0% to less than 3.0%.

C: The fogging amount is 3.0% to less than 5.0%.

D: The fogging amount is 5.0% or more.

The evaluation results are shown in Table 4.

TABLE 4

| | Usage amount of process cartridge | | | | | |
|---|---|---|---|---|---|---|
| | 0% | 20% | 40% | 60% | 80% | 100% |
| Example | A | A | A | A | A | A |
| Comparative example 1 | A | A | A | A | B | B |
| Comparative example 2 | A | A | A | B | B | C |
| Comparative example 3 | A | A | B | C | C | D |

In the configuration of the present embodiment, the new toner and the old toner were sufficiently mixed in the toner accommodation chamber 331*a*, and as a result, the process cartridge was used to a greater degree and the occurrence of fogging could be suppressed even when the replenishment with the new toner was performed in the deteriorated state of the old toner.

Meanwhile, in the configuration of Comparative Example 1, since the accommodation chamber communication port 343 was in the region A, the new toner supplied for replenishment from the accommodation chamber communication port 343 was conveyed to the developing chamber 331*b* without being sufficiently mixed with the old toner. As a result, "fogging" occurred when the usage amount of the process cartridge was close to 100%.

Further, in the configuration of Comparative Example 2, since the opening 331*c* was located in the region A, most of the toner that was not conveyed to the developing chamber 331*b* and fell into the toner accommodation chamber 331*a* fell near the restoring portion 331*a*2, and it was difficult to mix this toner with the toner staying at the bottom of the toner accommodation chamber 331*a*. As a result, "fogging" occurred when the usage amount of the process cartridge was increased as in Comparative Example 1.

Further, in the configuration of Comparative Example 3, since the accommodation chamber communication port 343 and the opening 331*c* were both located in the region A, the mixing of toners in the toner accommodation chamber 331*a* became insufficient as compared with the configurations of Comparative Example 1 and Comparative Example 2. As a result, "fogging" occurred even when the usage amount of the process cartridge was relatively low.

As described above, there is a relation between the arrangement of the accommodation chamber communication port 343 and the opening 331*c* and the toner mixing state in the toner accommodation chamber 331*a*. By adopting the configuration of the present example, it was possible to suppress the occurrence of "fogging" without providing additional members or complicated configurations.

According to the present invention, the occurrence of "fogging" caused by the difference in toner charging ability could be suppressed while using a simple structure for toner replenishment.

The configuration of the present invention can be summarized as follows.

(1) The developing device (304) of the present invention has the developing frame (331) including the developing chamber (331*b*) in which the developer bearing member (325) for bearing a developer is accommodated, the developer accommodation chamber (331*a*) which is located below the developing chamber in a posture at the time of use and in which the developer is accommodated, and the communication port (331*c*) through the developing chamber and the developer accommodation chamber are communicated with each other; and the conveying member that is provided in the developer accommodation chamber (331*a*) and that conveys the developer from the developer accommodation chamber to the developing chamber (331*b*).

The conveying member (336) includes the rotatable rotating shaft portion (336*a*) and the elastically deformable sheet portion (336*b*) in which one end (336*b*1) is fixed to the rotating shaft portion and the other end (336*b*2) is a free end.

The developing device (304) further has the deforming portion (331*a*1) that is provided in the developer accommodation chamber (331*a*) and bends and elastically deforms the sheet portion by coming into contact with the free end (336*b*2) of the sheet portion (336*b*) when the sheet portion is rotated according to a rotation operation of the rotating shaft portion (336*a*); and the restoring portion (331*a*2) that is provided in the developer accommodation chamber (331*a*) at a position upstream of the communication port (331*c*) and downstream of the deforming portion (331*a*1) in the rotation direction (X2) of the rotating shaft portion (336*a*).

The restoring portion (331*a*2) is configured to cause the developer borne on the sheet portion to fly toward the communication port (331*c*) by releasing and restoring the sheet portion (336*b*) elastically deformed by the deforming portion (331*a*1).

Further, the developer accommodation chamber (331*a*) is provided with the replenishing port (343) for replenishing the developer from the outside to the developer accommodation chamber;

where a vertical line (G1) passing through the rotation center (X0) of the rotating shaft portion (336*a*) is taken as a reference when viewed along the rotation axis direction (X1) of the rotating shaft portion (336*a*) in a posture at the time of use, at least a part of the communication port (331*c*) and at least a part of the replenishing port (343) are both located on one side (G12) of the vertical line (G1), and the restoring portion (331*a*2) is located on the other side (G11) of the vertical line (G1).

(2) In the developing device of the present invention, the sheet portion (336*b*) may have the free length (L) greater than the shortest distance (L1) from the rotation center (X0) of the rotating shaft portion (336*a*) to the replenishing port (343).

(3) In the developing device of the present invention, in a posture at the time of use, the highest position (P11) of the replenishing port (343) may be located below the lowest position (P21) of the restoring portion (331*a*2). In the present invention, the lowest position of the restoring portion (331*a*2) is a position where a state in which the free end (336*b*2) of the sheet portion (336*b*) is in contact with the inner wall surface of the developing frame which constitutes the restoring portion (331*a*2) during rotation starts changing to a state of separation.

(4) In the developing device of the present invention, in a posture at the time of use, the highest position (P11) of the replenishing port (343) may be located below the highest position (P31) of the deforming portion (331*a*1). The highest position of the deforming portion (331*a*1) is a position where the distance to the rotation center X0 of the rotating shaft portion (336*a*) is the shortest on the inner wall surface of the developing frame constituting the deforming portion (331*a*1).

(5) In the developing device of the present invention, the sheet portion (336*b*) may include the first sheet portion (336*b*3) and the second sheet portion (336*b*4), and the first sheet portion (336*b*3) and the second sheet portion (336*b*4) may be attached to the rotating shaft portion (336*a*) at different positions (X21, X22) in the rotation direction (X2).

(6) In the developing device of the present invention, the first sheet portion (336*b*3) and the second sheet portion (336*b*4) may be fixed on both sides (336*a*1, 336*a*2) of the rotating shaft portion (336*a*) across the rotation center (X0), and the first sheet portion (336*b*3) and the second sheet portion (336*b*4) may be arranged so that free ends (336*b*2) thereof extend in opposite directions (D1, D2).

(7) In the developing device of the present invention, in a posture at the time of use, the highest position (P11) of the replenishing port (343) may be located above the developer level surface (LV) of the developer accommodated in the developer accommodation chamber (331*a*) in the unused state.

(8) In the developing device of the present invention, the developing chamber (331*b*) may be provided with the supply member (334) that is in contact with the developer bearing member (325) and supplies the developer to the developer bearing member.

(9) In the developing device of the present invention, the developer may be a one-component nonmagnetic developer.

(10) In the developing device of the present invention,

The developing device (304) may be detachably attachable to the image forming apparatus (3100) that forms an image.

(11) The process cartridge (370) of the present invention includes the image bearing member (301) that bears a developer image; and the developing device (304), wherein the process cartridge is detachably attachable to the image forming apparatus (3100).

(12) In the process cartridge of the present invention, the developer bearing member (325) may collect a developer remaining on the image bearing member (301) after the developer image has been transferred from the image bearing member (301).

(13) The image forming apparatus (3100) of the present invention includes at least one of the developing device (304) and the process cartridge (370), and the transfer member (358).

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2019-168211, filed on Sep. 17, 2019, No. 2019-168212, filed on Sep. 17, 2019, and No. 2019-168871, filed on Sep. 17, 2019, which are hereby incorporated by reference herein in its entirety.

What is claimed is:

1. A developing device comprising:

a frame having an accommodation chamber in which a developer is accommodated, and a replenishing port for replenishing a developer to the accommodation chamber from outside; and a stirring member stirring the developer in the accommodation chamber, the stirring member including a rotating shaft portion rotatably supported by the frame and a sheet member having one end fixed to the rotating shaft portion and another end as a free end, and the stirring member being rotatable according to a rotating operation of the rotating shaft portion, wherein, when the stirring member is rotated, the free end of the sheet member is capable of contacting an inner wall surface of the accommodation chamber in which the replenishing port is formed, wherein, a through hole penetrating in a thickness direction of the sheet member is provided in a region of the sheet member that comes into contact with the inner wall surface of the accommodation chamber, and wherein the through hole is provided in the sheet member so that $S1>L>S2$ is satisfied, where when the developing device is viewed from an axial direction of the rotating shaft portion, a position of the sheet member fixed to the rotating shaft portion is a position A;

a distance between the position A and a center position of the replenishing port in a rotation direction of the rotating shaft portion is L;

a length in the sheet member from the position A to one end of the through hole on the free end side of the sheet member is S1; and a length in the sheet member from the position A to the other end of the through hole on the rotating shaft portion side of the sheet member is S2.

2. The developing device according to claim 1, wherein the through hole is arranged at a position overlapping a position, where the replenishing port is provided, in an axial direction of the rotating shaft portion.

3. The developing device according to claim 1, wherein a ratio of a length of the through hole to a length of the sheet member in an axial direction of the rotating shaft portion is 0.2 or less.

4. The developing device according to claim 1, wherein the sheet member includes a first sheet member and a second sheet member, and the first sheet member and the second sheet member are attached at different positions in a circumferential direction of the rotating shaft portion.

5. The developing device according to claim 4, wherein the through hole is provided in the first sheet member and the second sheet member.

6. The developing device according to claim 4, wherein the first sheet member has a first sheet portion and the second sheet member has a second sheet portion, and the first sheet member and the second sheet member are attached to the rotating shaft portion in a state that the first sheet portion and the second sheet portion are overlapping in a thickness direction.

7. The developing device according to claim 6, wherein the first sheet portion is located on a downstream side and the second sheet portion is located on an upstream side in a rotation direction of the rotating shaft portion, and a free length of the first sheet portion from a fixed end fixed to the rotating shaft portion to a free end is greater than a free length of the second sheet portion, a free end of the second sheet portion is not in contact with the inner wall surface, and the free end of the first sheet portion is contactable with the inner wall surface.

8. The developing device according to claim 1, wherein the frame has a developing chamber which is provided above the accommodation chamber in a direction of gravity in a posture at a time of use and in which a developer bearing member bearing a developer is arranged, and the developer accommodated in the accommodation chamber is conveyed to the developing chamber by the stirring member.

9. The developing device according to claim 8, wherein the developing chamber is further provided with a supply member supplying the developer to the developer bearing member.

10. A cartridge comprising:

the developing device according to claim 1; and an image bearing member bearing a developer image, wherein the cartridge is detachably attachable to an apparatus main body of an image forming apparatus.

11. An image forming apparatus comprising:

the cartridge according to claim 10; and a transfer member.

12. An image forming apparatus comprising:

the developing device according to claim 1; and a transfer member.

13. A developing device comprising:

a developing frame including a developing chamber in which a developer bearing member for bearing a developer is accommodated, a developer accommodation chamber which is located below the developing chamber in a posture at a time of use and in which the developer is accommodated, and a communication port through which the developing chamber and the developer accommodation chamber are communicated with each other;

a conveying member provided in the developer accommodation chamber for conveying the developer from the developer accommodation chamber to the developing chamber, the conveying member including a rotatable rotating shaft portion, and an elastically deformable sheet portion which has one end fixed to the rotating shaft portion and another end as a free end;

a deforming portion, provided in the developer accommodation chamber, for bending and elastically deforming the sheet portion by coming into contact with the free end of the sheet portion when the sheet portion is rotated according to a rotation operation of the rotating shaft portion; and a restoring portion, provided in the developer accommodation chamber at a position upstream of the communication port and downstream of the deforming portion in a rotation direction of the rotating shaft portion, for restoring the sheet portion by releasing the deformation caused by the deforming portion, so as to convey the developer borne on the sheet portion toward the communication port, wherein, the developer accommodation chamber is provided with a replenishing port for replenishing a developer to the developer accommodation chamber from outside, and, wherein, when viewed along a rotation axis direction of the rotating shaft portion in a posture at a time of use, and a rotation center of the rotating shaft portion and a downstream end of the communication port in the rotation axis direction of the rotating shaft portion being connected by a straight line, regarding said straight line, the communication port is located on one side and the replenishing port is located on the other side, and the restoring portion is not provided on the other side where the replenishing port is located, but is provided on the one side where the communication port is located.

14. The developing device according to claim 13, wherein in a posture at a time of use, at least a part of the replenishing port is located below the rotation center of the rotating shaft portion.

15. The developing device according to claim 13, wherein in a posture at a time of use, a highest position of the replenishing port is located below a lowest position of the restoring portion.

16. The developing device according to claim 13, wherein in a posture at the time of use, a highest position of the replenishing port is located below a highest position of the deforming portion.

17. The developing device according to claim 13, wherein in a posture at a time of use, a highest position of the replenishing port is located above a developer surface of the developer accommodated in the developer accommodation chamber in an unused state.

18. The developing device according to claim 13, wherein the developing frame has a partitioning portion so that the developing chamber and the developer accommodation chamber are partitioned from each other, the partitioning portion includes a first partitioning portion and a second partitioning portion located upstream of the first partitioning portion, in a posture at a time of use, the second partitioning portion has a larger inclination angle with respect to a horizontal direction than the first partitioning portion does, and the communication port is provided in the second partitioning portion.

19. The developing device according to claim 18, wherein when viewed along a rotation axis direction of the rotating shaft portion in a posture at a time of use, and a vertical line that passes through a lowest position of the second partition portion at a lower end being a reference the replenishing port is located on a side opposite to the side where the communication port is located, regarding the vertical line.

20. The developing device according to claim 13, wherein the developing chamber is provided with a supply member that is in contact with the developer bearing member and supplies the developer to the developer bearing member.

21. The developing device according to claim 13, wherein the developer is a one-component non-magnetic developer.

22. The developing device according to claim 13, wherein the developing device is detachably attachable to an image forming apparatus that forms an image.

23. A process cartridge comprising:

an image bearing member bearing a developer image; and the developing device according to claim 13, wherein the process cartridge is detachably attachable to an image forming apparatus.

24. The process cartridge according to claim 23, wherein the developer bearing member collects a developer remaining on the image bearing member after the developer image has been transferred from the image bearing member.

25. An image forming apparatus comprising:

the process cartridge according to claim 23; and a transfer member.

26. An image forming apparatus comprising:

the developing device according to claim 13; and a transfer member.

27. A developing device comprising:

a developing frame including a developing chamber in which a developer bearing member for bearing a developer is accommodated, a developer accommodation chamber which is located below the developing chamber in a posture at a time of use and in which the developer is accommodated, and a communication port through which the developing chamber and the developer accommodation chamber are communicated with each other;

a conveying member provided in the developer accommodation chamber for conveying the developer from the developer accommodation chamber to the developing chamber, the conveying member including a rotatable rotating shaft portion, and an elastically deformable sheet portion which has one end fixed to the rotating shaft portion and another end as a free end;

a deforming portion, provided in the developer accommodation chamber, for bending and elastically deforming the sheet portion by coming into contact with the free end of the sheet portion when the sheet portion is rotated according to a rotation operation of the rotating shaft portion; and a restoring portion, provided in the developer accommodation chamber at a position upstream of the communication port and downstream of the deforming portion in a rotation direction of the rotating shaft portion, for restoring the sheet portion by releasing the deformation caused by the deforming portion, so as to convey the developer borne on the sheet portion toward the communication port, wherein, the developer accommodation chamber is provided with a replenishing port for replenishing a developer to the developer accommodation chamber from outside, and, wherein, when viewed along a rotation axis direction of the rotating shaft portion in a posture at a time of use, and a vertical line that passes through a rotation center of the rotating shaft portion being as a reference, at least a part of the communication port and at least a part of the replenishing port are both located on one side of the vertical line, and the restoring portion is located on the other side of the vertical line.

28. The developing device according to claim 27, wherein the sheet portion has a free length greater than a shortest distance from the rotation center of the rotating shaft portion to the replenishing port.

29. The developing device according to claim 27, wherein in a posture at a time of use, a highest position of the replenishing port is located below a lowest position of the restoring portion.

30. The developing device according to claim 27, wherein in a posture at the time of use, a highest position of the replenishing port is located below a highest position of the deforming portion.

31. The developing device according to claim 27, wherein the sheet portion includes a first sheet portion and a second sheet portion, and the first sheet portion and the second sheet portion are attached to the rotating shaft portion at different positions in the rotation direction.

32. The developing device according to claim 31, wherein the first sheet portion is fixed on one side of the rotating shaft and the second sheet portion is fixed on the other side opposite to the one side of the rotating shaft portion, across the rotation center, and a free end of the first sheet portion extends in a direction opposite to a direction that a free end of the second sheet portion extends in.

33. The developing device according to claim 27, wherein in a posture at a time of use, a highest position of the replenishing port is located above a developer level surface of the developer accommodated in the developer accommodation chamber in an unused state.

34. The developing device according to claim 27, wherein the developing chamber is provided with a supply member that is in contact with the developer bearing member and supplies the developer to the developer bearing member.

35. The developing device according to claim 27, wherein the developer is a one-component non-magnetic developer.

36. The developing device according to claim 27, wherein the developing device is detachably attachable to an image forming apparatus that forms an image.

37. A process cartridge comprising:

an image bearing member bearing a developer image; and the developing device according to claim 27, wherein the process cartridge is detachably attachable to an image forming apparatus.

38. The process cartridge according to claim 37, wherein the developer bearing member collects a developer remaining on the image bearing member after the developer image has been transferred from the image bearing member.

39. An image forming apparatus comprising:

the process cartridge according to claim 37; and a transfer member.

40. An image forming apparatus comprising:

the developing device according to claim 27; and a transfer member.

* * * * *